US005223659A

United States Patent [19]

Shiraki et al.

[11] Patent Number: 5,223,659

[45] Date of Patent: Jun. 29, 1993

[54] ELECTRONIC MUSICAL INSTRUMENT WITH AUTOMATIC ACCOMPANIMENT BASED ON FINGERBOARD FINGERING

[75] Inventors: Kazuyoshi Shiraki, Fussa; Shiro Ishiguro; Akinori Matsubara, both of Tachikawa, all of Japan

[73] Assignee: Casio Computer Co., Ltd., Tokyo, Japan

[21] Appl. No.: 875,542

[22] Filed: Apr. 27, 1992

Related U.S. Application Data

[60] Continuation of Ser. No. 553,978, Jul. 16, 1990, abandoned, which is a division of Ser. No. 343,032, Apr. 24, 1989, Pat. No. 4,966,052.

[30] Foreign Application Priority Data

| | | | |
|---|---|---|---|
| Apr. 25, 1988 | [JP] | Japan | 63-54539[U] |
| Nov. 25, 1988 | [JP] | Japan | 63-296227 |
| Nov. 25, 1988 | [JP] | Japan | 63-296228 |
| Nov. 25, 1988 | [JP] | Japan | 63-296229 |

[51] Int. Cl.[5] ..... G10H 1/38

[52] U.S. Cl. ..... 84/669; 84/DIG. 22

[58] Field of Search ..... 84/613, 637, 646, 650-652, 84/669, 715, 722-742, DIG. 22, DIG. 30

[56] References Cited

U.S. PATENT DOCUMENTS

| | | | |
|---|---|---|---|
| 4,248,118 | 2/1981 | Hall et al. | 84/DIG. 22 |
| 4,339,978 | 7/1982 | Imamura | 84/DIG. 22 |
| 4,379,420 | 4/1983 | Deutsch | 84/DIG. 22 |
| 4,433,601 | 2/1984 | Hall et al. | 84/DIG. 22 |

*Primary Examiner*—Stanley J. Witkowski

*Attorney, Agent, or Firm*—Frishauf, Holtz, Goodman & Woodward

[57] ABSTRACT

Root and type of a chord are discriminated at discriminators in accordance with the operation status on a fingerboard. The chord is designated according to a simplified fingering rule predetermined on the fingerboard so as to designate the chord. An automatic accompaniment or a manual play is performed according to the discriminated chord obtained at chord discriminating device

13 Claims, 35 Drawing Sheets

ONLY ROOT FRET POSITION → MAJOR

ROOT FRET POSITION + TWO POSITIONS → m7

ROOT FRET POSITION + 1 FRET ABOVE → minor

ROOT FRET POSITION + 2 FRETS ABOVE → 7th

Gmaj
FRET
1ST STRING
6TH STRING
(1) (2) (3) (4) (5) (6) (7)
(G3)

Gm
(9)
(G3)

Gm7
(8)
(G3)

Gmaj7
(4)
(G3)

Gdim
(5)
(G3)

| | STRING NUMBER j | CHORD TYPE |
|---|---|---|
| FRET NUMBER i | j = 1 | 7th$^{b9}$ |
| | 2 | aug |
| | 3 | maj |
| | 4 | maj7 |
| | 5 | dim |
| | 6 | maj |
| FRET NUMBER i-1 | 7 | m9 |
| | 8 | m7 |
| | 9 | m |
| | 10 | 7th |
| | 11 | sus4 |
| | 12 | maj |

FIG.29

ELECTRONIC MUSICAL INSTRUMENT WITH AUTOMATIC ACCOMPANIMENT BASED ON FINGERBOARD FINGERING

This application is a continuation of application Ser. No. 07/553,978, filed Jul. 16, 1990, now abandoned which in turn is a Divisional of Ser. No. 07/343,032 filed Apr. 24, 1989 (now U.S. Pat. No. 4,966,052 issued Oct. 30, 1990).

BACKGROUND OF THE INVENTION

1. Field of the Invention

The present invention relates to an electronic musical instrument which can provide an external or internal, electronically-operative sound source to synthesize musical tones, and, more particularly, to an electronic string instrument provided with a fingerboard and a plurality of strings, a chord discriminating apparatus incorporated into the electronic string instrument and a chord-using apparatus such as an automatic or manual accompaniment unit.

2. Description of the Related Art

In the field of electronic musical instruments, the keyboard instrument is the most successful on an industrial and commercial basis. The input technology for use in ordinary electronic digitized machines such as an electronic typewriter, a personal computer and an electronic calculator, has contributed to improvements of a keyboard serving as a main controller of keyboard instruments and input technology associated with such a controller. The MIDI (MUSICAL INSTRUMENT DIGITAL INTERFACE), which is then most popular of musical instrument interfaces, appears to be mainly developed for digital keyboard instruments. Today, there are a variety of electronic keyboard instruments available on the market, some for professional uses, some for amateurs and some as toys for children.

Needless to say, to sufficiently master one instrument, whether it is a traditional instrument or an electronic musical instrument, generally, one has to practice considerably and requires a considerable time for it. The first thing to be learned by learners who use a musical instrument for the first time would be the basic operation of the instrument. Learners may already have sufficient musical feeling, but usually find it difficult to express music through musical instruments in which they are not experienced. It is therefore very advantageous to provide aiding or helping tools for those with less experience to help them show their musical expressions or to help learners develop a musical feeling.

One of such tools has already been devised as a simplified chord designation technology or an automatic accompaniment technology in the field of electronic keyboard instruments. This tool is disclosed in a number of documents. For instance, U.S. Pat. No. 4,353,278 discloses a chord discriminating apparatus which discriminates a chord from key operation data defined by simplified finger positioning and the subsequent key operation (striking or pressing keys) done with respect to a keyboard provided on the left side of a electronic keyboard instrument. According to the logic of the chord discrimination, the root of a chord is specified by that of two operated keys which generates the lowest tone or highest tone, and the type of the chord is determined by the type of the remaining key (black key or white key). Another chord discriminating apparatus for use in an electronic keyboard instrument is disclosed in U.S. Pat. No. 4,499,807, in which when one key is operated, the pitch of the key specifies the pitch of the root and a major is designated as the type of a chord, and when two keys are operated, a minor is discriminated as a chord type and the pitch of the root is determined by the pitch of one of the keys. When three or more keys are operated, a seventh chord is discriminated as a chord type and the root is defined by the key with the highest or lowest note. U.S. Pat. No. 4,217,804 discloses an electronic keyboard instrument which automatically plays an arpeggio in accordance with key operation data from a keyboard and an arpeggio pattern. This instrument comprises mean for assigning pitch order attributes to the individual pitches of a plurality of keys, and arpeggio pattern generator means for generating the pitch order attributes at timings at which individual musical tones are generated. The generated pitch order attribute data of an arpeggio pattern is decoded in accordance with the pitch order attribute and pitch of an operated key to be a pitch representing a specific frequency, and a musical tone having this decoded pitch will be generated and sounded. Therefore, this structure cannot generate a pitch other than what is specified by an operated key. An automatic accompaniment unit for use in a keyboard instrument is also known, which comprises pattern generator means for generating pitch interval data from a root (a pitch relative to the root) at a generation timing of each musical tone. This unit further comprises chord discriminator means for discriminating the root and type of a chord from operated keys on the keyboard. The pitch interval data from the tone generation control means generator means of the is sent to decoder means where it is corrected in accordance with the discriminated chord type and is combined with the root of the chord to be a pitch having a specific value. A musical tone having this pitch will be generated from a sound source.

It should be noted that the above techniques have been proposed and developed in association with a musical instrument having a keyboard, i.e., a musical instrument having an array of keys which are basically arranged in a linear pitch array and are struck or pressed. In general, it is considered difficult to apply the principles of such techniques to musical instruments which apparently differ from the keyboard type in, not only structure but also characteristics and modes of musical performance.

It seems useful to briefly discuss the characteristics, history and state of the art of an electronic string instrument.

As compared with electronic keyboard instruments, the history of electronic string instruments is shorter although the root of ordinary string instruments goes back to ancient times. Analog-operative "electric" guitars are very successful at modern times. String instruments differ from keyboard instruments significantly in playing method. With regard to a guitar, for instance, musical tones are generally generated by plucking or strumming one or more strings. The pitch of a tone is basically determined by the operation position pressed on the associated string on a fingerboard with a finger. In other words, each tone is determined and generated by the positioning of a string with the left fingers and plucking or strumming of the string with the right fingers. This is in contrast to what is involved in keyboard instruments in which one or a plurality of keys are selected and struck or pressed to generate associated tones. Due to the structural advantage, most string instruments are portable and are typically held by a player while playing a musical piece. This produces a feeling of integration between a player and a string instrument, which is not the case with the use of keyboard instruments.

Although the history of electronic string instruments is relatively short, various propositions have been made to digitize or computerize string instruments. Great efforts have been made particularly to improvements of an input or sensor device associated with strings and a fingerboard which are main play controllers of a guitar type string instrument or a signal processor associated with such an input or sensor device. Typical performance control inputs, which are detected and evaluated by an electronic string instrument and are used for a sound source of a synthesizer, are the position of a string pressed on the fingerboard or the operating length of a vibrating string or its equivalent pitch, the time of string plucking (or strumming) and sometimes the intensity of the string plucking. For instance, U.S Pat. No. 4,468,999 teaches a string/fret detecting apparatus for use in an electronic guitar, in which a plurality of metal strings are sequentially and periodically driven by a string driver. Conductive frets on the fingerboard are sequentially and periodically scanned by a fret scanner, which receives an electric signal of a string through a fret in contact with the string and discriminates the fret by a differential system. The string driver drives one string at a time in accordance with the value of a string counter, so that the string in contact with the discriminated fret is specified by the string count attained at that point of time. U.S. Pat. No. 4,658,690 also discloses a string-driven type string/fret position detecting apparatus. In this apparatus, a fret comprises a plurality of mutually-insulated, conductive segments arranged in such a way that adjacent fret segments partially overlap each other across the fingerboard (while maintaining the insulation). This string/fret position detecting apparatus can detect a plurality of string/fret positions, and these strings extending on the fingerboard are separate from the strings (trigger strings) which are disposed on the body of a string instrument and are to be plucked or strummed. According to the guitar type electronic string instrument disclosed in U.S. Patent application Ser. No. 069,612, filed Jul. 7, 1987, a matrix array of pressure-responsive fret switches are embedded in the fingerboard body. Each fret switch is associated with each string extending on the fingerboard and is provided between adjacent frets thereon. The fret switch array is scanned by an array scanner or a program and an activated fret switch or the operation position of each string pressed on the fingerboard is detected. U.S. Pat. No. 4,723,468 discloses an apparatus for detecting string/fret positions and the operation lengths of strings utilizing ultrasonic waves. An ultrasonic wave generator operative by a pulse is provided at the bridge of the strings and transmits an ultrasonic pulse. The transmitted ultrasonic wave is reflected by the fret on the fingerboard which is in contact with a string, and the ultrasonic echo is returned to the bridge through the string in the opposite direction and is received by an ultrasonic wave receiver provided at the bridge. The time between the transmission of the transmitted pulse and reception of the received pulse, i.e., the time required for the ultrasonic wave to reciprocate the operation length of the string, is measured and the associated, activated fret is specified. U.S. Patent application Ser. No. 112,780, filed Oct. 22, 1987, corresponding to U.S. Pat. No. 5,018,428 proposes a string/fret detecting apparatus of a pitch extraction type, which extracts a pitch from a signal from an electromagnetic pickup of a string. This pitch extracting apparatus comprises an analog circuit and a digital signal processor which is controlled by software (a pitch extraction algorithm). The analog circuit detects the zero crossing point, peak, etc. of the picked-up signal and sends the detection results to the digital signal processor. In accordance with the pitch extraction algorithm, the digital signal processor finds effective zero crossing points (whose interval corresponds to the pitch or basic frequency of string vibration) and measures the time between the effective zero crossing point to attain a pitch.

French Patent FR8606571; FR2598-017-A discloses a string-plucking or violin type electronic string instrument. According to the embodiment disclosed, a strength gauge for detecting the bow pressure with respect to strings is adhered to the flexible stick of the bow. The hair of the bow is constituted by a bundle of 50 silicon carbide wires having 1000 Ω/cm and is applied thereacross with a DC voltage of about 5 V. Each string is conductive and serves as a cursor for a potentiometer constituted by the bow hair. When the hair contacts a string, a voltage indicating the contact position (instantaneous position of the bow) is formed on the string. Resistive tracks of carbon are embedded in the fingerboard in association with the individual strings, and a DC voltage of about 5 V is applied across each track. For each track, a conductive wire which selectively contacts the track when pressed, is disposed. The tracks serve as the potentiometer and the conductive wires serve as the cursors. When strings are pressed against the fingerboard, therefore, signals representing the pressed positions are formed on the conductive wires. These signals, which include a signal representing the bow pressure from the strength gauge with respect to the strings, a signal from a operated string that represents the instantaneous position of the hair with respect to the string, and a signal from a conductive wire representing the position of the string pressed against the fingerboard, are utilized to control a synthesizing sound source.

Of course, these efforts and propositions concerning string instruments generally relate to evaluation of performance control inputs in "electronic" string instruments, and their objectives are essential to actually realize the potential of a sound source for electronically synthesizing musical tones in response to properly evaluated tone parameters. However, there are still important aspects in electronic string instruments which should be developed, and which are concerned with the technique for providing aid and help to players, particularly those who do not have enough experience in string instruments. This technique is what the present invention is directed to. Regretfully, in the field of electronic string instruments, there are very few documents published which are concerned with the play-aiding, field. One of the documents is U.S. Pat. No. 4,295,402, issued Oct. 20, 1981. The disclosed technique relates to correction of chord designation including an error in an electronic guitar. A fret position detector detects operation positions (a set of operation positions of string/fret operation positions) on a fingerboard with frets, which are determined by (erroneous) fingering done for chord designation with respect to the fingerboard. The set of operation positions is converted into a set of associated pitches, each of which is expressed by one of 12 bits so that all the pitches can be set within one octave. The converted data is then input to a chord/root detector, which has a plurality of matching or correlation filters and counters provided for different chord types. Each correlation filter is first supplied with 12 bits Si representing the set of pitches from the fret position detector. During a checking process, these 12 bits Si are sequentially circulated so as to move a reference bit position or a root from C to B. The correlation filters further receive reference pitch data representing chord types, as filter coefficients, which are equivalent to 12 bits Ri that make the bit positions of the chord members to be "1." The outputs of the correlation filters are given by $$\sum_{i=1}^{12} EX - OR\ (Si,Ri).$$

The outputs (correlation values) are measured by the correlation counters. The type of a chord is specified by that correlation filter which has given the greatest correlation value, and the root of the chord is specified by the reference bit position given at the point of the maximum correlation value. In other words, this structure is based on the signal theory concerning the signal-to-noise ratio. However, the disclosed technique is not utilized for a purpose of discriminating a chord from the operation positions on the fingerboard formed by "simplified" fingering for chord designation. The latter technique is suggested in Japanese Patent Disclosure No. 63-210893, according to which each chord type is assigned to each string and the root of each chord (from C to B) is assigned on each fret on the fingerboard. A chord is specified by pressing one point on the fingerboard. Accordingly, a positioning detector means detects one operated string/fret position. The type of a chord is discriminated from the string data at the operation position from the positioning detector means, and the root of the chord is discriminated from the fret data at the operation position. With the above arrangement, since the pitch on the same fret is assigned to every string, most players who enjoy playing traditional string instruments, more or less, would feel it unnatural. Another example is disclosed in Japanese Utility Model Disclosure No. 63-128596, whose grantee is the same as the present application. In this example, separate regions on a fingerboard with frets are used respectively as a chord type designating region and a root designating region. According to one embodiment disclosed in the document, the region or track on the fingerboard which is associated with the sixth string defines the root designating region and those tracks on the fingerboard which are associated with the first to fifth strings define the chord type designating region. This arrangement has a shortcoming similar to that of the previous example.

SUMMARY OF THE INVENTION

Accordingly, there is a great need for an electronic string instrument which can present simplified chord designation which is easier to learn. In a broader sense it is very desirable to provide a play aiding apparatus or tool for use in an electronic string instrument, which is advantageous and helpful for players, particularly those with less experience in string instruments.

It is therefore a primary object of this invention to provide an electronic string instrument or which it is easy for even a player with insufficient experience to play a musical piece.

It is another object of this invention to provide a chord discriminating apparatus for use in an electronic string instrument which permits a player to easily designate the desired chord.

It is a further object of this invention to provide an electronic string instrument which permits a player to add an accompaniment while designating a chord by simplified fingering.

According to one aspect of this invention, there is provided an chord discriminating apparatus for use in an electronic string instrument having a fingerboard and a plurality of strings with a plurality of tracks defined on the fingerboard to be associatable with the strings and extending along a lengthwise direction thereof, the apparatus comprising:

positioning detector means for detecting operation positions on the fingerboard determined in accordance with simplified positioning on the fingerboard executed for chord designation;

pitch assigner means for assigning pitches to individual two-dimensionally arranged positions on the fingerboard in such a manner that each of the pitches depends on both of first and second components of each of the two-dimensionally arranged positions on the fingerboard, the first component indicating in which of the plurality of tracks the each position lies and the second component being a lengthwise component associated with a lengthwise direction of the fingerboard;

root discriminator means, coupled to the positioning detector means and the pitch assigner means, for selecting one of the operation positions as a root designation position and preparing a pitch of a musical tone associated with the selected root designation position to thereby discriminate a root of a chord; and type discriminator means, coupled to the positioning detector means, for discriminating a type of a chord from the operation positions.

With the above structure, a two dimensional pitch assignment to the fingerboard is utilized to designate the root of a chord and the entire region on the fingerboard to which such pitch assignment is executed is utilized to designate the type of the chord. Generally speaking, this technique is suitable for the characteristics of traditional string instruments, and provides such a feasibility to introduction, access, development or expansion to unomitted, perfect fingering which is very difficult for beginners, with simplified fingering or positioning and pressing modes executed for chord designation.

The term "track" in the present specification generally means an area on a fingerboard which can be associated with a plurality of strings to be plucked or rubbed in the sense of detection or recognition; this area is typically fixed but may be variable according to the bending of the associated strings, depending on the type of the positioning detector means or string/fret detector means. Therefore, a plurality of strings, which should not necessarily be plucked or rubbed, may or may not be stretched on the fingerboard. If the strings are not stretched on the fingerboard, although it is desirable that visible or viewable track marks or signs be provided on the fingerboard, they are not essential as far as the correlation between the tracks and strings can be recognized or is satisfied from the view point of motion.

The term "chord" is typically expressed by a plurality of pitches but may be expressed by one pitch. The term "root" is used in a broad sense and is also called a fundamental. A chord may include a chord with one root, which is apparent in the tonal period where Western classics were commonly practiced (nearly 18th century to 19th century), and a polychord having two or more roots. For instance, one polychord is constituted by one or more members of a lower structured chord and one or more members of an upper structured chord formed on the lower structured chord. Such a polychord is often expressed in the form of "X/Y" or "X ON Y," for example, "C maj on D," and if the chord Y has one member, the polychord is called "chord on bass," "on-bass chord" or "bass-affixed chord" due to the member being the lowest note or bass, or called "fraction chord" (in Japan) in view of the symbol "X/Y."

The positioning detector means may be realized by any known string/fret position detecting apparatus, string pitch extracting apparatus or string operation length detecting apparatus, which are all described in the "BACKGROUND" section.

The term "coupled" should be interpreted in a broad sense, and two or more means or elements coupled together may be realized by discrete circuits or common hardware (e.g., a microprocessor or microcomputer controlled by a program). With the use of a microprocessor, the term "coupled" normally means logical or functional connection under the control of a program.

Within the teachings of the invention, various "simplified" fingering operations are possible with respect to the fingerboard. In one mode, each chord is specified by one or a plurality of operation positions on the fingerboard which lie within a relatively narrow range that can be easily covered by fingers. In another mode, most chords are specified by pressing or holding a plurality of fingers on a plurality of positions in a nearly straight line on the fingerboard. In the third mode, at least some chords are specified by operation positions as a subset of those operation positions on the fingerboard which are given at a time a same chord is specified using an ordinary acoustic string instrument. These examples of chord designation can also be applied to a structure in which a plurality of strings extend on the fingerboard in the lengthwise direction thereof.

It is desirable that the operation position on the fingerboard for specifying the root be easily distinguished from the remaining operation positions. In one mode, the fingerboard extends between a head and a body of an electronic string instrument and the root is specified by that of the operation positions which is located at a far end (closest to either the head or body). In another mode, the root operation position is defined by the pitch region attained by conversion of the operation position. For instance, the pitch of the root is specified by the lowest or highest one of operated pitches or the pitches associated with the operation positions. The operation positions may be converted into pitches which all fall within one octave.

The fingerboard may be of a fretless type such as a violin type or may have frets (ridges or marks spaced with intervals across the fingerboard) like that of a guitar.

The term "operation position" includes the status of a string or track which is not in contact with fingers depending on the type of the positioning detector means. From the view point of internal processing speed or structure, it is advantageous that the root discriminator means deals only with data of positions on the fingerboard which are pressed by or in contact with fingers or positions which are pressed against the fingerboard by fingers or equivalents. In this respect, the "operation position" is sometimes used in the latter sense.

It is preferable that the pitches assigned by the pitch assigner means are normally associated with those pitches assigned when executing a fingering operation to the fingerboard for playing a melody, for example.

Another aspect of this invention relates to the technique of using discriminated chords for playing an accompaniment.

According to one structural example, a manual playing apparatus coupled to the aforementioned chord discriminating apparatus is provided. This manual playing apparatus comprises:

string/pitch assigner means, coupled to the root discriminator means and the type discriminator means of the chord discriminator means, for assigning pitches to the plurality of strings in accordance with discriminated root and type;

vibration detector means for detecting occurrence of vibration of each of the plurality of strings; and tone generation control means, coupled to the vibration detector means and the string/pitch assigner means, for referring to the string/pitch assigner means to control tone generation upon reception of a signal from the vibration detector means. It is preferable that the signal from the vibration detector means includes data to specify that string which has started vibrating and the tone generation control means control generation of a musical tone having a pitch assigned to the specified string by the string/pitch assigner means. The tone generator means may receive all the pitches from string/pitch assigner means in response to any signal from the vibration detector means which indicates the start of string vibration, and controls the simultaneous generation of musical tones having these pitches. In another modification, the string/pitch assigner means assigns pitches only to some of the plurality of strings and inhibits operation of the tone generation control means with respect to remaining strings.

It is sometimes preferable that a sequence of musical tones forming an accompaniment line be automatically generated in response to a discriminated chord without string plucking or rubbing. For this purpose, an automatic accompaniment unit coupled to the above-described chord discriminating apparatus is provided. This automatic accompaniment unit comprises:

accompaniment pattern generator means for generating a pitch attribute chord of each musical tone;

pattern decoder means, coupled to the accompaniment pattern generator means and chord (root and type) discriminator means, for decoding the given pitch attribute chord in accordance with the discriminated chord and converting the resultant data into a pitch having a specific frequency; and control means, coupled to the pattern decoder means, for controlling generation of a musical tone having the decoded pitch.

The pitch attribute mentioned here is concerned with a vertical component of a musical tone and generally means the property or characteristic of the musical tone which is detected in the wave or flow of pitches formed by that musical tone and those musical tones succeeding to, following or around the former musical tone along the horizontal axis or time axis. For instance, the pitch attribute of a musical tone is expressed by the pitch distance or pitch interval from the root. According to another example, the pitch attribute of a musical tone is expressed by a pitch order in a ground of pitches; the pitch order indicates how high or low the subject pitch is among the pitch group and it may be combined with an octave number. In the latter case, signals representing the operation positions from the positioning detector means are converted into corresponding pitches (which typically fall within one octave) and pitch orders are later assigned to the pitches. A pair of the pitch and the pitch order is input to the pattern decoder means, and the pitch order included in the accompaniment pattern is converted into a pitch representing a specific frequency, by referring to the input pair of the pitch and pitch order.

Those players who hardly have experiences in string instruments, need an unnecessarily long time to position fingers to designate a chord and may often feel it difficult to change a chord, i.e., execute another positioning string pressing operation, in synchronism with an accompaniment rhythm. As compared with fingering for chord designation, string plucking can be performed relatively easily in synchronism with a rhythm or at the timing at which a chord should be altered.

Another aspect of this invention is concerned with an automatic accompaniment unit for use in an electronic string instrument which can ensure a chord alteration in an accompaniment line at the proper timing. This automatic accompaniment unit renders a chord specified by the operation positions from the positioning detector means invalid or inoperable until a string is plucked or rubbed and accepts it as an effective chord, which is used in the accompaniment line, thereafter. According to one structural example, the automatic accompaniment unit comprises:

vibration detector means for detecting occurrence of vibration of the plurality of strings;

pattern generator means for automatically generating an accompaniment pattern;

tone generation control means, coupled to the pattern generator means, for controlling preparation of an accompaniment sound based on a chord and the accompaniment pattern; and chord updation means, coupled to the vibration detector means, the positioning detector means and the tone generation control means, for upon detection of start of vibration of any of the plurality of strings, supplying a chord specified by the operation positions at that point of time to the tone generation control means in immediate response to a signal supplied from the vibration detector means at the point of time and updating that chord which is to be referred to for preparation of the accompaniment sound by the tone generation control means, by the supplied chord.

A discriminated chord may be supplied from the aforementioned chord discriminating apparatus to the tone generator means.

Although the term "accompaniment" in the present specification means a secondary part of a main melody, it may be a "solo" when the main melody or the other part of the melody is not actually played.

BRIEF DESCRIPTION OF THE DRAWINGS

FIG. 29 is a diagram illustrating the correlation between chord types attained by the chord designation method shown in FIGS. 28A to 28E and the operation positions on the fingerboard;

DETAILED DESCRIPTION OF THE PREFERRED EMBODIMENT

To begin with, several basic arrangements of this invention based on various principles will be explained, followed by a description of specific embodiments of the invention.

Basic Arrangements

Figure 1:
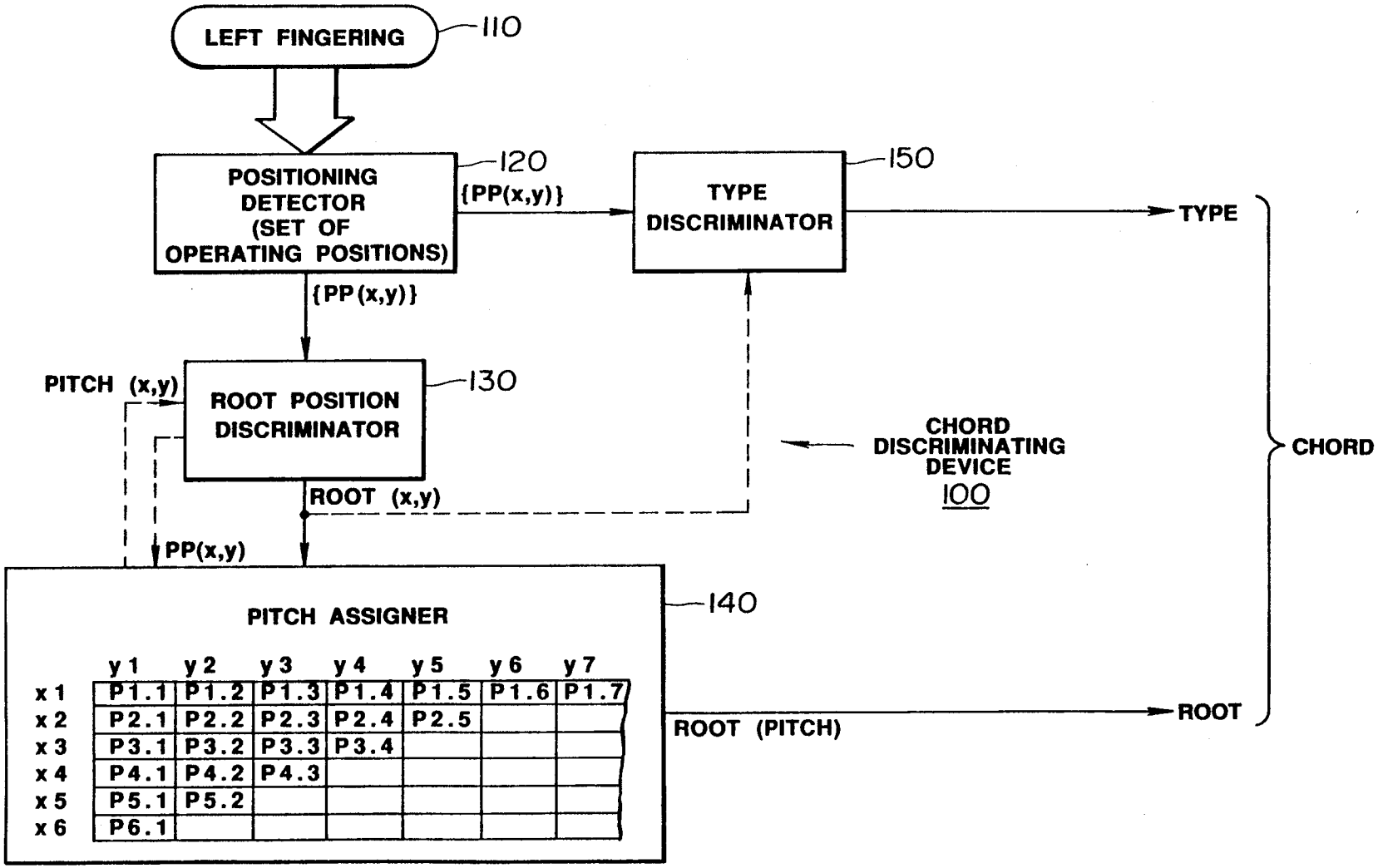
FIG. 1 is a block diagram illustrating the functional structure of a chord discriminating apparatus according to this invention.

FIG. 1 is a block diagram illustrating the functional structure of a chord discriminating apparatus 100 of an electronic string instrument according to this invention and other optional functions indicated by the broken lines. By executing simplified fingering 110 to a fingerboard (not shown) for chord designation, corresponding operation positions are formed on the fingerboard. In a case where a plurality of (e.g., six) strings (not shown) are stretched along the length of the fingerboard, through the fingering 110, one or more strings are pressed against the fingerboard at the proper positions or operation positions. A plurality of strings, which can be plucked or rubbed, are provided at a string instrument. If these strings do not lie on the fingerboard, a plurality of tracks equal in number to the strings are defined in the lengthwise direction of the fingerboard. These tracks can, therefore, be associated with the individual strings. In other words, the tracks are equivalent to the strings. In this respect, therefore, the terms "track" and "string" are used hereafter as interchangeable.

A positioning detector 120 detects operation positions defined by the fingering 110, to be accurate, a set [PP (x,y)] of operation positions. The positioning detector 120 can be realized by any well-known positioning detector as exemplified in the "BACKGROUND" section. A root position discriminator 130 receives data representing the set [PP (x,y)] of operation positions from the positioning detector 120 and selects one of them as a root designation position ROOT (x,y). The data of selected root designation position ROOT (x,y) is input to a pitch assigner 140, which is designed in such a way that, to assign pitches to the individual positions on the fingerboard, each of the pitches (indicated by the elements indicated by "P" with the numerals representing the string numbers and the lengthwise positions) depends on both of first and second components of each of the two-dimensionally arranged positions on the fingerboard, the first component (indicated by an element with "x" affixed with the associated string number in FIG. 1) indicating in which of the plurality of tracks or strings the each position belongs and the second component or lengthwise component (indicated by an element "y" affixed with the associated numeral representing the lengthwise position in FIG. 1) being a component associated with a lengthwise direction of the fingerboard or the string in question at that position. The two dimensional pitch array [Pi,j] is stored in a storage region of a memory which constitutes a look-up table. For the desirable pitch assignment, the linear pitch array, for example, [P2,j] associated with the second string has a half-tone pitch interval between its adjoining elements P2,k and P2,k-1. In addition, there are specific pitch intervals between the pitch elements associated with the axis across the fingerboard (i.e., y axis), such as P1,1, P2,1, P3,1, P4,1, P5,1 and P6,1. With the use of such pitch assignment, it is possible to compute the pitch at an arbitrary position on the fingerboard from a small amount of pitch data elements. For instance, given the pitch intervals PI1, PI3, PI4 and PI5 from the pitch P1,1 of the position PP (1,1) and the pitches of the positions P (2,1), p (3,1), p (4,1), P (5,1) and P (6,1) and the half-tone pitch interval (which can be represented by a value "1") between the adjoining positions PP (x,y) and PP (x-1,y) along the y axis, the pitch P5,8 at the position P (5,8) can be attained as follows:

$$P5,8 = P1,1 + PI5 + 7.$$

Upon reception of the root designation position ROOT (x,y) from the root position discriminator 130, the pitch assigner 140 converts it into a pitch ROOT (PITCH) (shown simply as "ROOT" in FIG. 1) in accordance with the two dimensional pitch assignment and outputs the result. The root "ROOT" is one element to represent a chord (indicated as "CHORD" in FIG. 1). The remaining element to specify a chord is a type (indicated as "TYPE" in FIG. 1). The type of a chord, "TYPE," is generated by a type discriminator 150. The type discriminator 150, which is coupled to the positioning detector 120, analyzes a set of operation positions [PP (x,y)] supplied from the detector 120 and produces a chord type data, "TYPE." CHORD is specified by a combination of TYPE and ROOT.

The broken lines shown in FIG. 1 to connect between blocks exemplify alternative arrangements of the chord discriminating apparatus 100. In one such arrangement, the root position discriminator 130 sends each operation position PP (x,y) to the pitch assigner 140 and receives the pitch data "PITCH (x,y)" at that operation position PP (x,y) from the pitch assigner 140. Repeating this process for other operation positions provides a set of pitches [PITCH (x,y)] and a set of operation positions [PP (x,y)], the individual elements in the former set being associated with those in the latter set in one-to-one relation. Then, the root position discriminator 130 acquires the pitch of the root, ROOT (PITCH), from the pitch set [PITCH (x,y)] in accordance with the logic of root pitch selection. At this point of time, the root position discriminator 130 already knows the root designation position ROOT (x,y).

FIG. 1 also shows the broken line indicating the way to supply the data, ROOT (x,y), indicating the root operation position, from the root position discriminator 130 to the type discriminator 150. This will be described in detail later referring to FIG. 5.

Figure 2:
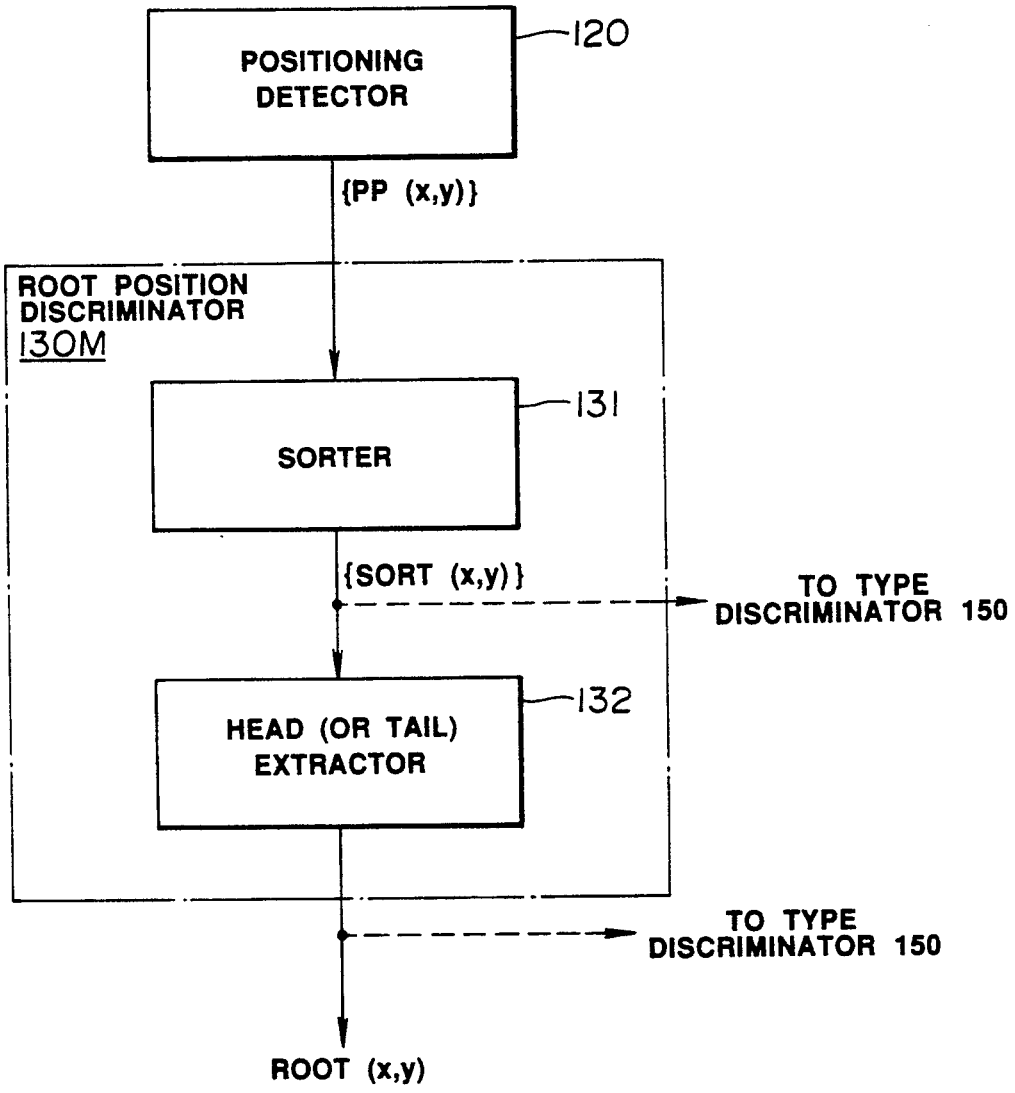
FIG. 2 is a block diagram illustrating the functional structure of a root position discriminator shown in FIG. 1.

FIG. 2 exemplifies one preferred configuration of the root position discriminator 130M. The positioning detector or scanner 120 detects a set of operation positions [PP (x,y)] associated with a designated chord, and a method of detecting these operation positions depends on the type and the scanning algorithm of the positioning detector. It is assumed in FIG. 2 that the results of the scanning of the positioning detector 120 are given to the root position discriminator 130M as a set of operation positions [PP (x,y)]. Such a set [PP (x,y)] is stored typically as position data, each element of the position data representing on operation position. In other words, a set of operation positions can be considered as a linear array of operation positions. In this case, the root designation position ROOT (x,y) exists somewhere in the linear array. This linear array is called a source linear array, and a linear array, in which an element indicating the root designation position ROOT (x,y) is an element with a known number in the linear array, is called an object or destination array. From this point of view, the function of the root position discriminator is to rearrange the elements of the source array to attain an object array. According to the system of the chord discriminating apparatus, the root designation position can always be defined from any instance of a set of operation positions associated with chord designation, thus always requiring sorting to convert the source array into the object array.

In consideration of the above point, the root position discriminator 130M shown in FIG. 2 has a sorter 131 for converting a source array [PP (x,y)] into an object array [SORT (x,y)]. In the illustrated example, the sorted array [SORT (x,y)] has its first or last element which represents the root designation position ROOT (x,y). A head (or tail) extractor 132 extracts an element indicating such a root designation position ROOT (x,y) from the sorted array [SORT (x,y)] and outputs it.

FIGS. 3A to 3D illustrate four examples of the priority order of sorting. For instance, in the priority order map of FIG. 3A, the highest priority exists at the position defined by x=6 and y=1 (such a position will be hereinafter indicated by (6,1), for example), and the positions of lower priority exist at (5,1), (4,1], (3,1), (2,1) and (1,1) along the y row in order, then moving to the next y row, at (6,2), (5,2), (4,2), (3,2), (2,2) and (1,2); this continues to the last y row.

FIG. 2 also shows a broken line indicating the way to couple the sorted array to the type discriminator 150 and another broken line indicating the way to supply the root designation position, ROOT (x,y), from the head extractor 132 to the type discriminator 150. These information transmissions are effective for the function of the type discriminator 150. This will be described in detail later referring to FIG. 5.

From the systematic point of view, the function of the sorter 131 can be incorporated in the scanning logic unit of the positioning detector 120. For instance, the scanning logic unit scans the fingerboard in the modes shown in FIGS. 3A to 3D. When the scanning logic unit finds an operation position, it stores its position data into a buffer which can serve as a FIFO or LIFO. Such a buffer may be considered as the above-described linear array. This arrangement eliminates the need of means for resorting the resultant linear array.

To discriminate a chord type, the type discriminator 150 shown in FIG. 1 can perform the matching of a set of operation positions [PP (x,y)] with a set of reference type patterns; each type pattern consists of a set of positions indicating a chord type. When the set of operation positions coincides with one type pattern, the chord type assigned to that type pattern is what a play has intended and specified to use. In this approach, the matching and the search for the chord type can be executed in exhaustive type or British museum type, and there may be a considerable number of reference type patterns set in the type discriminator 150 depending on the number of designatable chord types. In such a case, the type discrimination takes time. Further, with the use of a memory for storing reference type patterns as data, a larger memory capacity would be required accordingly. Needless to say, it is desirable to use a type discriminator which can search the proper chord type quickly.

Figure 5:
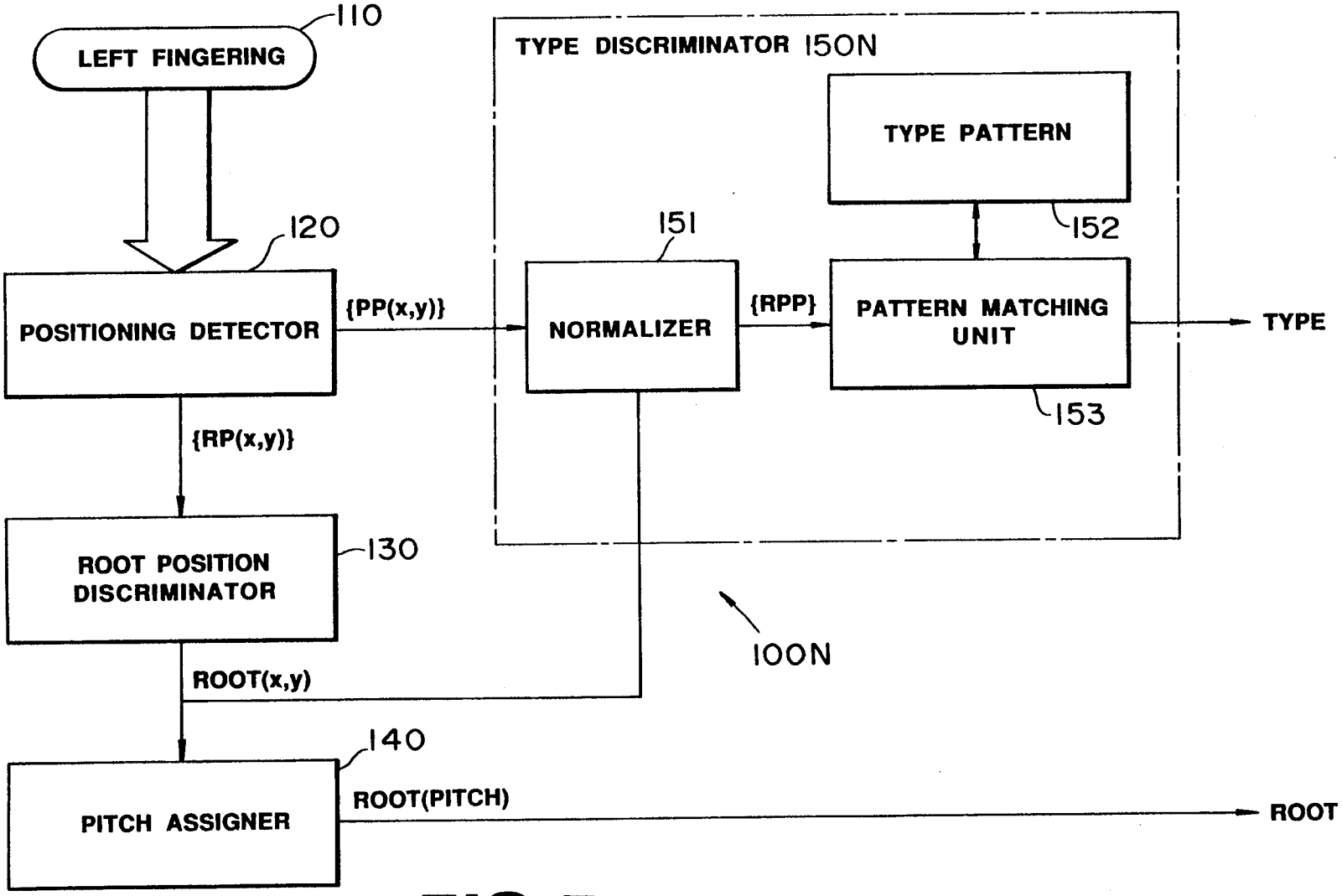
FIG. 5 is a block diagram illustrating another modification of the functional structure of a chord discriminating apparatus, more particularly, the functional structure of a type discriminator.

FIG. 5 illustrates a chord discriminating apparatus 100N which is provided with a desirable type discriminator 150N. In this example, the type discriminator 150N includes a normalizer 151 which receives a set of operation positions [PP (x,y)] from the positioning detector 120 and a root designation position ROOT (x,y) from the root position discriminator 130. The normalizer 151 normalizes the set of operation positions using the root designation position ROOT (x,y) so that each operation position is expressed by position data relative to the root position ROOT (x,y). Since the relative position of the root itself is (0,0), the root element can be eliminated from a set of relative positions [RPP]. This set of relative positions [RPP] is supplied to a pattern matching unit 153 which executes a matching test with respect to a set of reference type patterns 152. Each reference type pattern is expressed by a set of relative positions. It should be understood from the above that the type discriminator 150N shown in FIG. 5 has an advantage of shortening the checking time in the pattern matching unit 153 because only one type pattern needs to be prepared for each chord type. The type patterns are normalized and do not include an element indicating a root.

To further shorten the time required to discriminate a chord type, it is possible to supply the sorted operation positions [SORT (x,y)] (described above with reference to FIG. 2) to the type discriminator 150N in place of an unsorted source array [PP (x,y)]. The individual reference type patterns or the linear array of relative positions is arranged in such a way that the elements are ordered in accordance with the sorting priority of the array [SORT (x,y)]. This approach does not require sorting in the pattern matching unit 153 or normalizer 151 in the type discriminator 150N.

Figure 4:
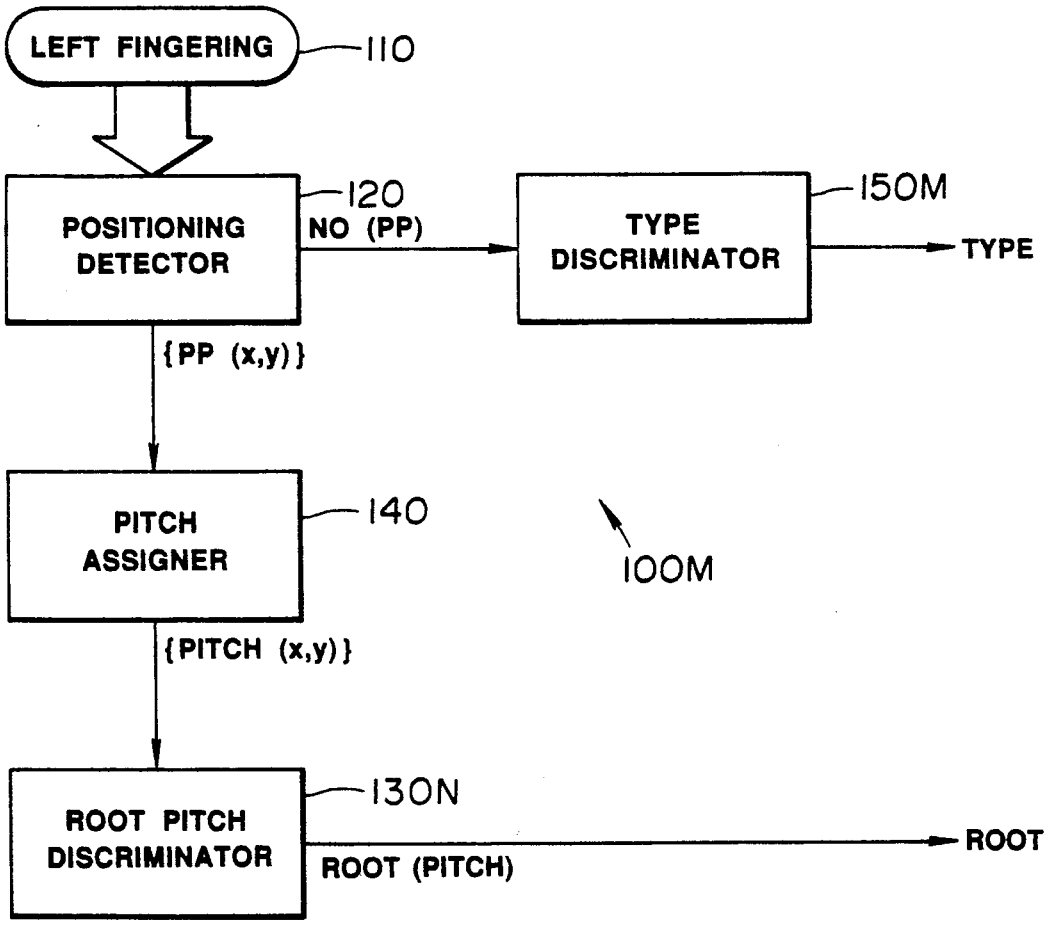
FIG. 4 is a block diagram illustrating a modification of the functional structure of a chord discriminating apparatus.

Sometimes, a chord including a relatively small number of types may be sufficient for a player, particularly, a beginner. In such a case, the chord discriminating apparatus, or particularly, the chord type discriminator can have a significantly simple configuration, which is exemplified in FIG. 4. According to a chord discriminating system 100M shown in FIG. 4, a chord type depends on the quantity of operation positions on the fingerboard. The illustrated positioning detector 120 includes a counter (not shown) for counting the number of operation positions detected during scanning. The counting result, indicated by NO (PP) in FIG. 4, is supplied to the type discriminator 150M which converts the received data into a data format for TYPE. If TYPE has the same format as NO (PP), the illustrated type discriminator 150M can actually be eliminated. In other words, the counter for counting the number of operation positions serves as a type discriminator.

A positioning detector of a pitch extraction type (see the background) monitors electric signals from a string pickup or electric signals representing the result of string plucking or string rubbing and vibration of a string and extracts the fundamental frequency components of the signals. During normal operation of an electronic string instrument, such a fundamental frequency component can be used as the frequency or pitch of a musical tone generated from a sound source. This type of positioning detector may be incorporated in the present chord discriminating apparatus. This arrangement can eliminate the need for an "electronic" pitch assigner as shown in FIG. 1, if desired. This is because the physical properties of a plurality of strings stretched over the fingerboard provides a "mechanical" or "acoustic" pitch assigning mechanism such as the one provided in an ordinary string instrument.

Figure 6:
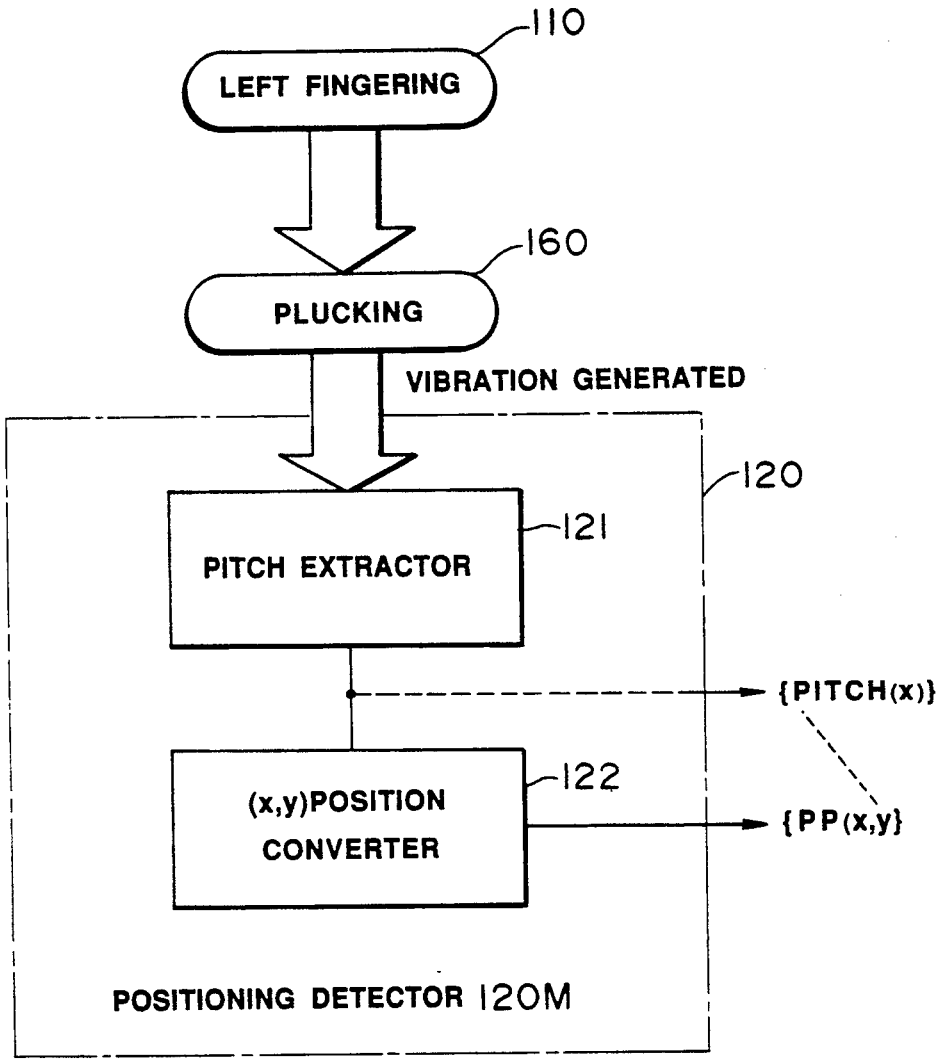
FIG. 6 is a block diagram illustrating a modification of the functional structure of a pitch extraction type positioning detector.

FIG. 6 illustrates a chord discriminating apparatus designed along the above approach. Left-hand fingering 110 forms operation positions on the fingerboard (not shown). Under this circumstance, a proper string is plucked (160) to vibrate the string. The string vibration is converted into a corresponding electric signal by, for example, an electromagnetic pickup (not shown) attached to the string, and the signal is supplied to a pitch extractor 121 in the positioning detector 120M. The pitch extractor 121 extracts the fundamental frequency component PITCH (ST) of the signal. Apparently, this frequency or pitch value PITCH (ST) is a function of the operation position, tension, size and other physical properties of the string in question. Although the pitch extractor 121 is indicated by one box in FIG. 6, it internally includes a plurality of pitch extracting modules prepared for the individual strings. The outputs of all the pitch extracting modules constitute a set of operation pitches [PITCH (ST)]. The illustrated positioning detector 120M also has a converter 122, coupled to the pitch extractor 121, for converting each received operation pitch PITCH (ST) into an operation position PP (x,y) on the fingerboard. All the converted operation positions or a set of operation positions [PP (x,y)] is supplied to the type discriminator and root position discriminator as shown in FIG. 1. FIG. 6 illustrates the broken line with the rightward arrow which implies the use of the set of operation pitches [PITCH (x)] outside the positioning detector 120M. For instance, the pitch set [PITCH (x)] may be supplied to the root position discriminator 130 (see FIG. 1).

There are several ways to express chords. One example has already been described with reference to FIG. 1, and according to this example, one chord "CHORD" is expressed by "TYPE" and "ROOT." A chord may be expressed as a set of pitches. Such pitches are generally called members of the chord. In general, there exist sets of pitches of many chords (if pitches are considered as the absolute values of frequencies) for a combination of one TYPE and ROOT. When these absolute pitch values are arranged to be close to one another, a chord is said to be at a closed position. In the case of the opposite pitch arrangement, a chord is said to be at an open position. With the chord member of the lowest tone being a root, a chord is said to be at the root position, and with other chord member being the lowest tone, a chord is said to be at the inverting position. It is often desirable to normalize a set of chord pitches in an electronic musical instrument so that every chord member at least temporarily falls within one octave. According to some systems, one pitch combination is always assigned to a combination of one TYPE and ROOT. For instance, it is possible to prepare a memory for storing a set of pitches at a memory location specified by TYPE and ROOT.

Figure 7:
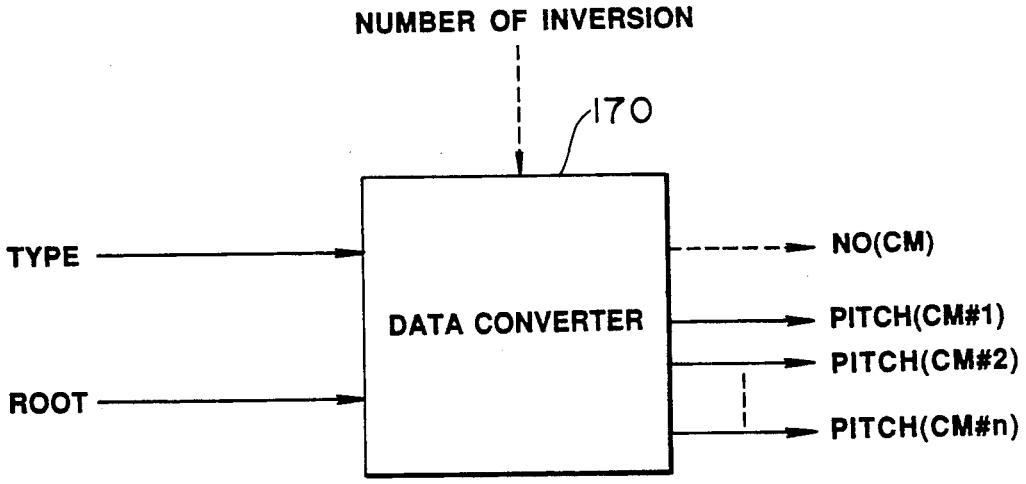
FIG. 7 is a block diagram illustrating a data converter for converting chord expressing data into another format.

The above discussion is exemplarily illustrated in FIG. 7. A data converter 170 converts TYPE and ROOT into a set of pitches (from PITCH (CM#1) to PITCH (CM#n)). The data converter 170 can provide a set of pitches [PITCH (CM)] in accordance with the number of inversions. (In FIG. 7, the inversion number is illustrated as being supplied to the data converter 170 via a broken line; the inversion number may be variable.) For an apparatus in use, the data converter 170 can output the number of chord members NO (CM). Some systems use means for inversely converting a set of pitches [PITCH (CM)] into a combination of TYPE and ROOT.

A description will now be given of a chord-utilizing apparatus, which uses chords given from a chord discriminating apparatus, as have been explained referring to FIGS. 1 through 6.

Figure 8:
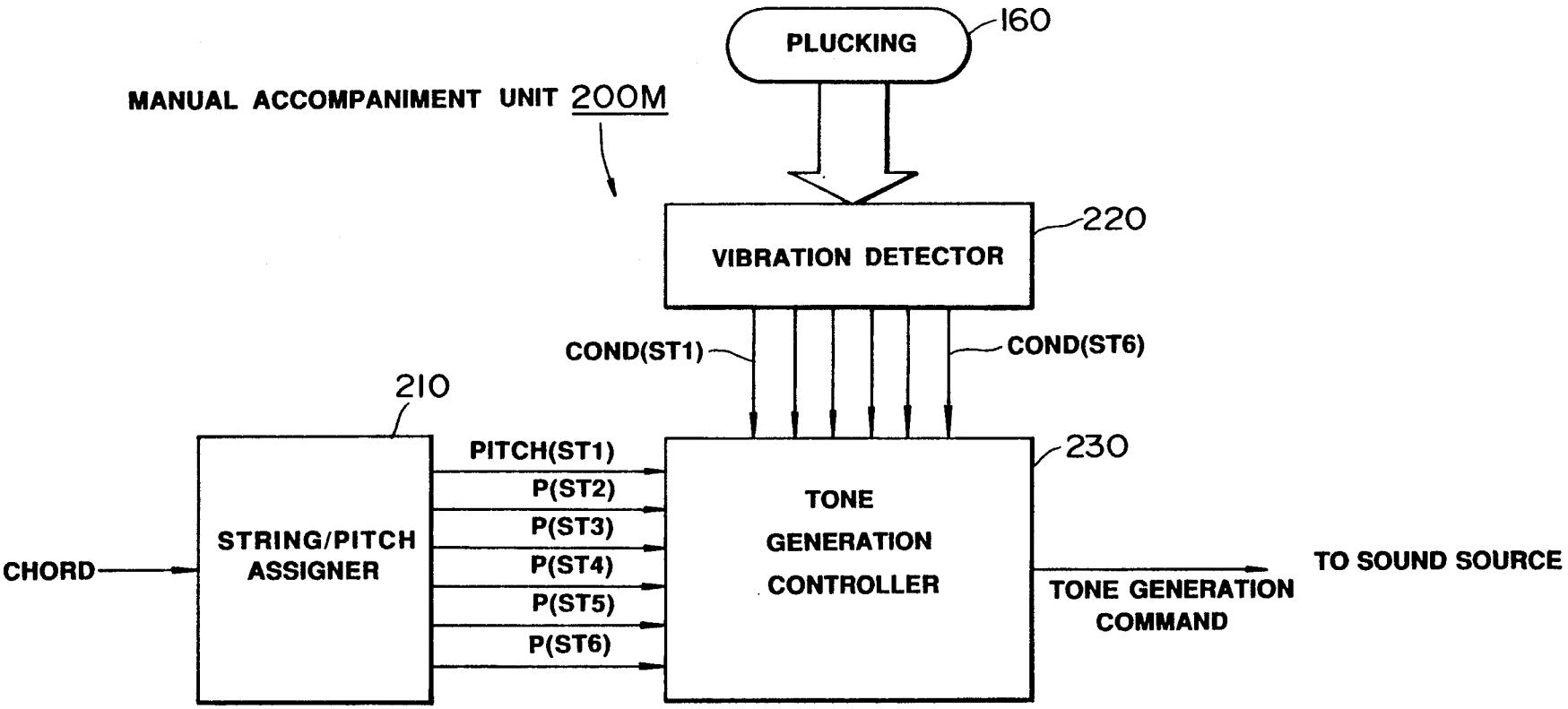
FIG. 8 is a block diagram illustrating the functional structure of a manual accompaniment unit which can be coupled to a chord discriminating apparatus shown in FIG. 1, 4 or 5.

Let us first refer to FIG. 8 illustrating a manual accompaniment unit 200M of an electronic string instrument according to one aspect of this invention. This manual accompaniment unit 200M has a string/pitch assigner 210 which receives a chord "CHORD." The CHORD, which has been discriminated by a chord discriminating apparatus as described above, is given by a proper format, such as a combination of TYPE and ROOT (see FIG. 1), a set of pitches (see FIG. 7) or a chord identifying number. The string/pitch assigner 210 produces pitch data PITCH (ST) for each string in accordance with the received chord, whatever the format is, and the string/pitch assigning logic. For instance, the illustrated PITCH (ST1) represents the pitch for string 1. The remaining section of the manual accompaniment unit 200M serves to generate and sound a musical tone at the pitch determined by the string/pitch assigner 210 in response to the plucking or rubbing of the associated string. That is, plucking a string (160) vibrates the string. This vibration is detected by the associated one of string vibration monitor modules of a vibration detector 220 and a string trigger signal representing the start of the string vibration is generated; these modules are constituted by a plurality of independent string pickups and associated electronic signal processing sections. Each vibration monitor module may be designed to produce other signals concerning the state of the associated string. One of those additional signals represents the speed or intensity of string plucking. Another signal represents the amplitude or level of vibration. A further signal indicates that the string vibration is stopped. Outputs COND (ST1) to COND (ST6) of the vibration detector 220, representing the statuses of the individual strings, are supplied to a tone generation controller 230. When the status signal or COND (STx) (x=1, . . . , 6) represents the start of vibration of the x-th string, the tone generation controller 230 interprets this signal as a note ON request signal from that string, selects the pitch data PITCH (STx) assigned to the string and sends a tone generation command including the pitch data or a message to a sound source. As a result, the sound source will generates a musical tone according to the data specified by the tone generation command. When plucking speed data of the string is also supplied to the tone generation controller 230, this controller generates a tone parameter such as an envelope using the received data and sends it as part of the tone generation command to the sound source.

The above description should make clear the general operation of the manual accompaniment unit shown in FIG. 8 which functions in combination with the chord discriminating apparatus shown in FIG. 1. A player can perform the desired accompaniment by plucking the proper strings while designating a chord typically through simplified fingering with respect to the fingerboard with the left hand. Each musical tone in the accompaniment is generated immediately after plucking the associated string, and its pitch depends on a chord designated by the simplified fingering and the string-/pitch assigning logic set in the string assigner. The pitch of a musical tone may or may not belong to the members of the chord.

In some cases, it is desirable that the tone generation controller 230 does not respond to plucking of a certain string to thereby inhibit generation of a musical tone. Such a function is advantageous for those players who practice playing the desired accompaniment part, such as arpeggio or obligato, by plucking a string or strings at the proper timing and with the proper intensity with right fingers or a pick, while pressing the strings on the fingerboard with left fingers with a simple method for designation of a chord. This can be achieved by the string/pitch assigner 210 assigning pitches only to some of the strings which depend on the received CHORD. In this case, an "inhibition" value is given to the remaining strings (PITCH (STx)="INHIBIT (STx)"). Accordingly, the tone generation controller 230 will not be operative to the string trigger signal that indicates the plucking of a string having such an inhibition value.

Figure 9:
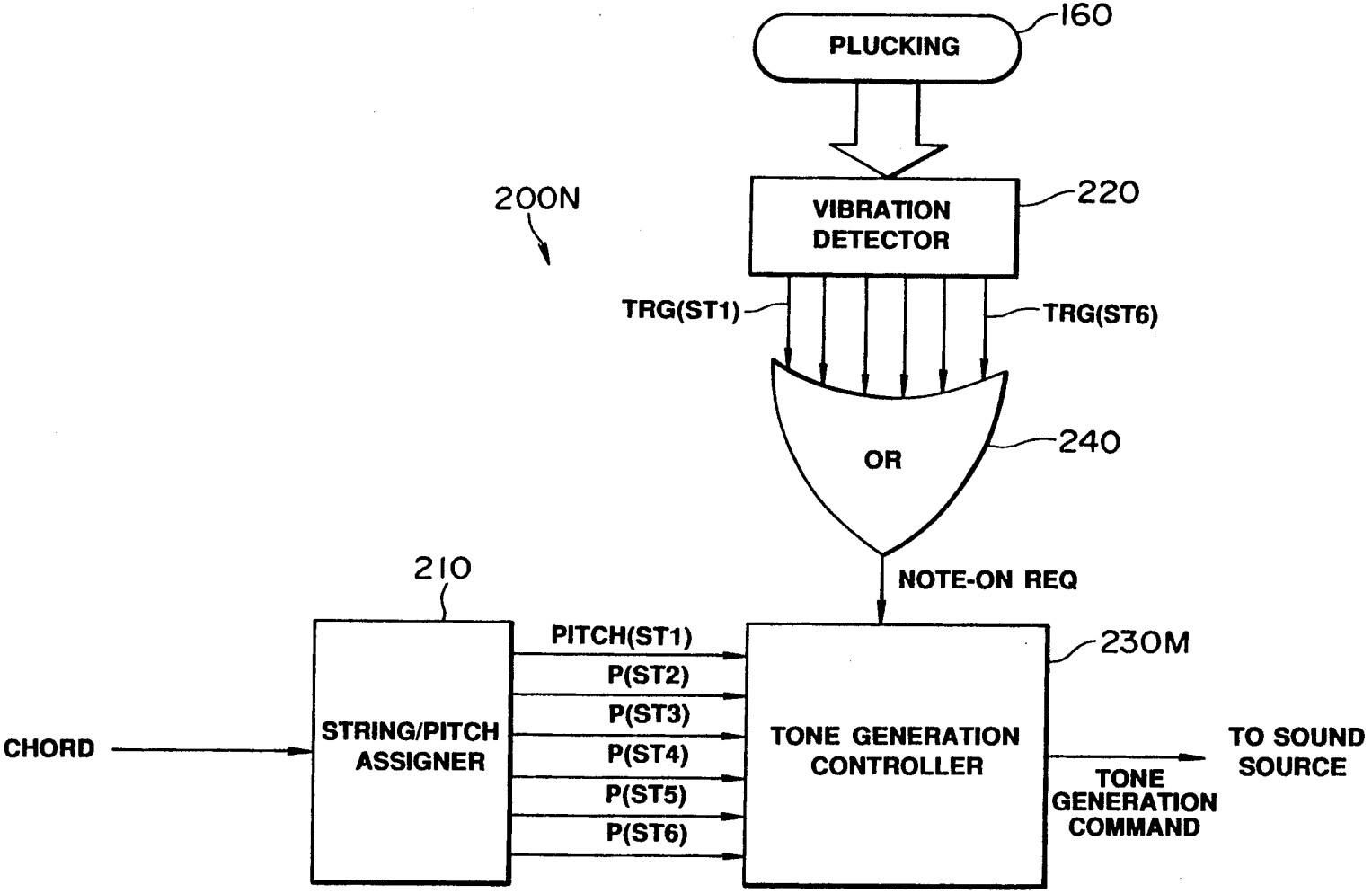
FIGS. 9 is a block diagram illustrating a modification of the functional structure of a manual accompaniment unit.

FIG. 9 illustrates a manual accompaniment unit 200N similar to the one shown in FIG. 8. According to the unit of FIG. 9, however, an OR circuit 240 is provided between the vibration detector 220 and the tone generation controller 230M. This OR circuit 240 receives signals TRG (ST1) to TRG (ST6), indicating the start of vibrations of the associated strings, from the vibration detector 220, and prepares and supplies a NOTE-ON REQ signal representing a note ON request to the tone generation controller 230M, whenever any string starts vibrating. In response to the request, the tone generation controller 230M accepts all the pitch data PITCH (ST1)-PITCH (ST6) from the string/pitch assigner 210 (except those which are associated with the strings having the "inhibition" value) and sends a plurality of tone generation commands including these pitch data to the sound source, thus permitting the sound source to simultaneously generate a plurality of musical tones having these pitches.

As a modification, selective coupling means may be provided to permit the individual signals TRG (ST1)-TRG (ST6) from the vibration detector 220 to be coupled directly to the tone generation controller 230M in first mode and permit the OR circuit 240 to attain a logical OR of these signals in second mode, thus coupling the resultant signal NOTE-ON REQ to the tone generation controller 230M.

Figure 10:
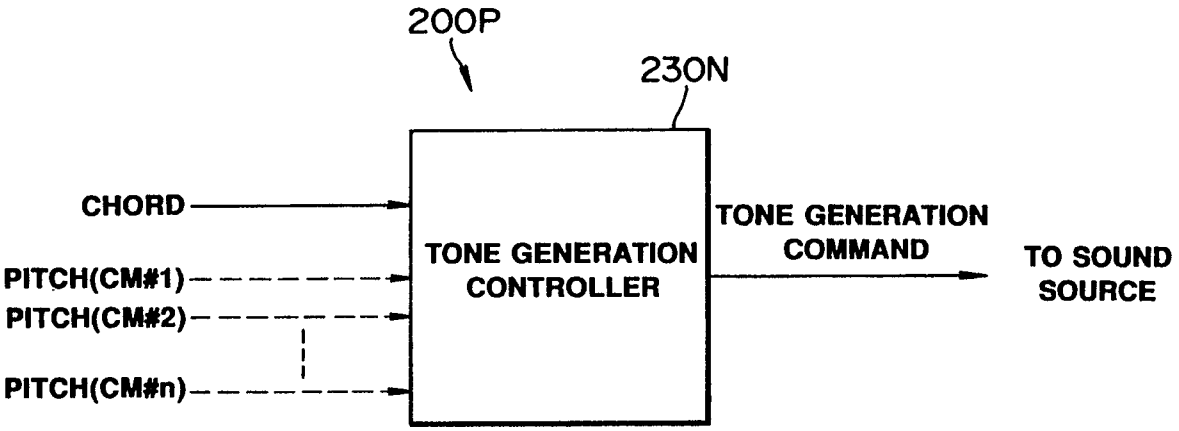
FIG. 10 is a block diagram illustrating another modification of the functional structure of a manual accompaniment unit.

FIG. 10 illustrates a very simple manual accompaniment unit denoted by 200P. This manual accompaniment unit 200P is constituted by a single means or a tone generation controller 230N which receives a "CHORD" discriminated by the chord discriminating apparatus (see FIG. 1, for example). Upon reception of a new chord, the tone generation controller 230N produces every member data of the chord, [PITCH (CM)], and controls the sound source using these data to thereby prepare and sound musical tones having the pitches as specified by PITCH (CM#1)-PITCH (CM#n), i.e., a chord tone. The member data PITCH (CM#1)-PITCH (CM#n) may be prepared by the data converter 170 as shown in FIG. 7. Such a data converter may be provided outside or inside the tone generation controller 230N.

Although the accompaniment unit 200P shown in FIG. 10 has a very simple structure, it has the following shortcoming depending on the skills of players. For those players who are not really acquainted with string instruments, it is usually difficult to position and press fingers on the fingerboard for a chord change at the proper timing. It is regrettable that the structure shown in FIG. 10 operates in synchronism with the chord discriminating apparatus and generates a chord tone every time the chord discriminating apparatus discriminates a new chord from the operation positions on the fingerboard. Such inconvenience will be more prominent in an automatic accompaniment system which plays an accompaniment by decoding an automatic accompaniment pattern that is repeatedly generated in accordance with a chord given from the chord discriminating apparatus, probably due to rhythm components of the accompaniment pattern. In a case where complete, unomitted fingering on the fingerboard is required for chord designation, those players who are lacking in experience would certainly require more time to a chord.

Figure 11:
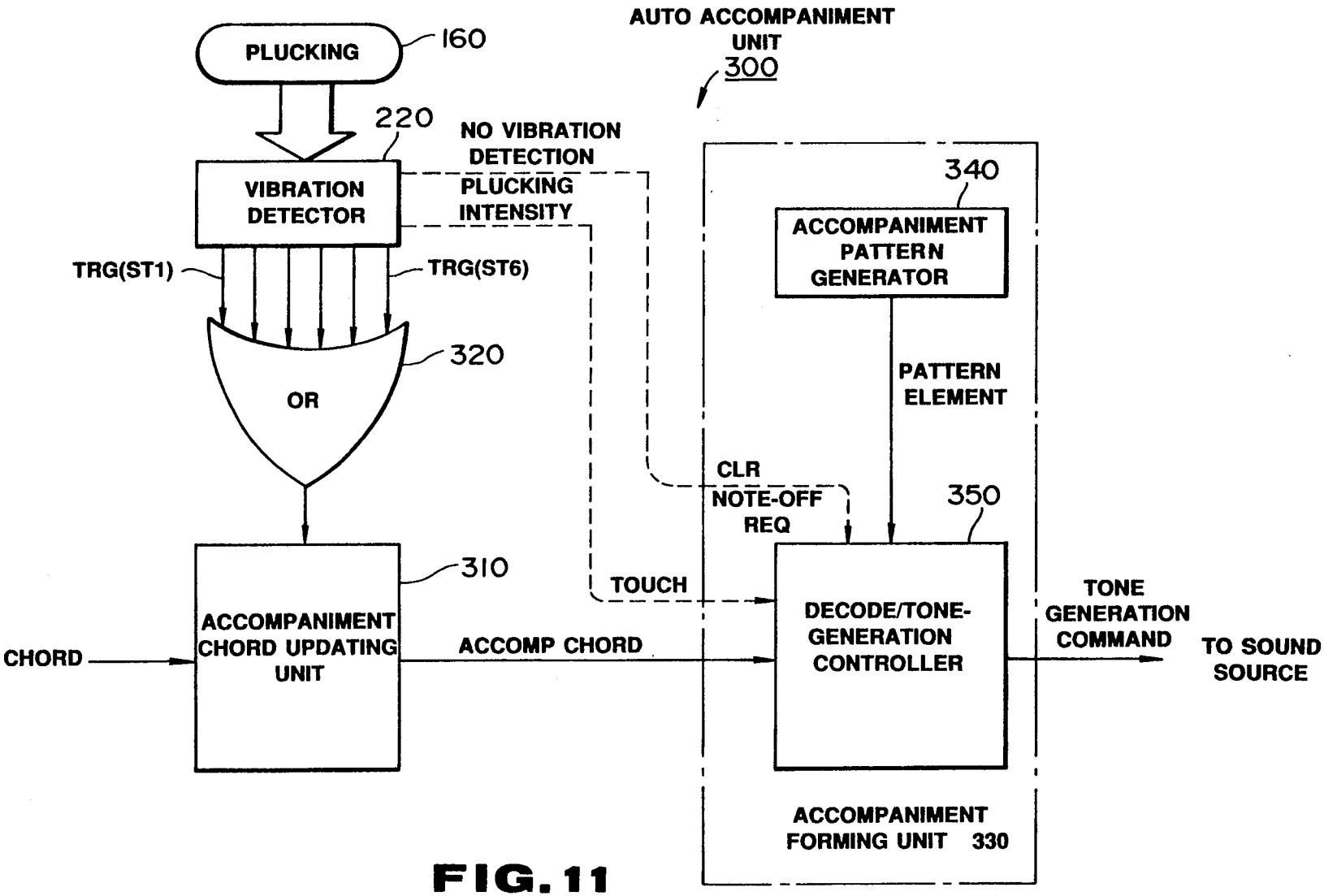
FIG. 11 is a block diagram illustrating the functional structure of an automatic accompaniment unit which can be coupled to a chord discriminating apparatus shown in FIGS. 1, 4 or 5.

FIG. 11 exemplifies a preferred arrangement of an automatic accompaniment unit (as denoted by 300) which is designed to overcome the disadvantage of the previous arrangement. The automatic accompaniment unit 300 has an accompaniment chord updating unit 310 which receives CHORD. The CHORD is chord information specified by a combination of operation positions formed on the fingerboard by simplified fingering or unomitted fingering. In other words, any chord discriminating apparatus of an electronic string instrument, including the one explained referring to FIGS. 1 through 6, can be a source of the CHORD to be supplied to the accompaniment chord updating unit 310. As has already been described, a chord may take an arbitrary form, such as a combination of a root and a type, a set of pitches of chord members or a chord identifying number. The chord updating unit 310 updates a chord (indicated by ACCOMP CHORD) used in an accompaniment forming unit 330 in response to the plucking or rubbing of strings of an electronic string instrument. For this function, the chord updating unit 310 has one other input port at which it receives a signal from the OR circuit 320, i.e., a signal attained by ORing signals TRG (ST1)-TRG (ST6) which indicate the start of vibrations of the individual strings and are generated from the vibration detector 220 in response to the plucking 160, etc. In response to the signal from the OR circuit 320 (which becomes active when any string vibrates), the chord updating unit 310 sends CHORD existing at the first input port to the accompaniment forming unit 330. The accompaniment forming unit 330 receives the CHORD at its decode/tone generation controller 350. Even when any string is plucked or rubbed, a chord used by the accompaniment forming unit 330 is updated each time. The accompaniment forming unit 330 has a pattern generator 340 which generates pattern elements representing pitch attributes of musical tones at their tone generation timings (as determined by the rhythm components of the accompaniment pattern). Upon reception of the individual pattern elements, the decoder of the controller 350 decodes the pattern elements into pitches in accordance with an accompaniment chord (ACCOMP CHORD). Then, a tone generation command including the acquired pitch data is produced and is sent to the sound source for generation of a musical tone having the pitch.

From the above, it should be understood that the arrangement shown in FIG. 11 is advantageous for players of string instruments, particularly, those players who are not acquainted with string instruments. This is because even such players lacking in experience are likely to easily pluck strings at the proper timing according to the rhythm of an accompaniment pattern and the fingering with the left hand (positioning or repositioning of fingers on the fingerboard, followed by securely pressing the strings there on the fingerboard with the fingers) for chord designation can be carried out leisurely prior to plucking of the strings. In this manner, the flow of a harmony to be generated, expressed in an accompaniment line to be played and felt from the line can be timely controlled by a chord which is prepared in advance by a leisurely fingering and becomes active or effective by plucking or rubbing of an arbitrary string.

Some players may desire to practice plucking a proper single string or a plurality of proper strings, not an arbitrary string, which depend on a chord prepared by the left fingers. Such players may be unlikely to wish updating an accompaniment chord by plucking or rubbing erroneous strings. This can be realized by replacing the OR circuit 320 shown in FIG. 11 with the proper string-responsive logical unit. Such a logical unit can be constituted by a string selector, which receives CHORD (as discriminated by the chord discriminating apparatus) and produces a signal representing selection of one or more strings which depend on the chord, and a trigger decoder which is coupled to the string selector and sends, to the accompaniment chord updating unit, only those of the trigger signals TRG (ST1)–TRG (ST6) from the vibration detector 220 which ar associated with the strings (effective strings) selected by the string selector, as a chord updating command. A more refined trigger decoder issues the chord updating command only in response to nearly simultaneous plucking or rubbing of all the strings selected by the string selector. Such a trigger decoder may be constituted by a trigger time monitor, which checks if the trigger signals of all the effective strings are generated from the vibration detector 220 within a specific short period of time and issues the chord updating command only upon generation of the trigger signals.

The accompaniment forming unit 330 may receive other performance control parameters than ACCOMP CHORD; this is exemplified by two broken lines connecting the vibration detector 220 with the decode/tone generation controller 350 in FIG. 11. One of the connecting lines carries a stationary detection signal, generated from the vibration detector 220 when vibrations of all the strings are stopped. This signal can be used to clear the accompaniment chord in the decode/tone generation controller 350. For instance, upon reception of the clear signal, the tone generation controller 350 sends a command about all notes being OFF to the sound source, releases a musical tone being generated and goes in no-operation mode in which the controller 350 does not produce any note ON commands to the sound source. This no-operation mode continues until a new accompaniment chord is given from the chord updating unit 310. At this point, the decode/tone generation controller 350 returns to the ordinary operation mode. With the above arrangement, a player can intentionally stop playing an accompaniment or hold off the accompaniment temporarily. During deactivation of the accompaniment forming unit 330, the player may play the ordinary melody part.

The second connecting line indicated by the broken line carries a signal representing the speed or intensity of string plucking. The tone generation controller 350 of the accompaniment forming unit 330 can control the attack envelope or volume of a musical tone using this signal.

Figure 12:
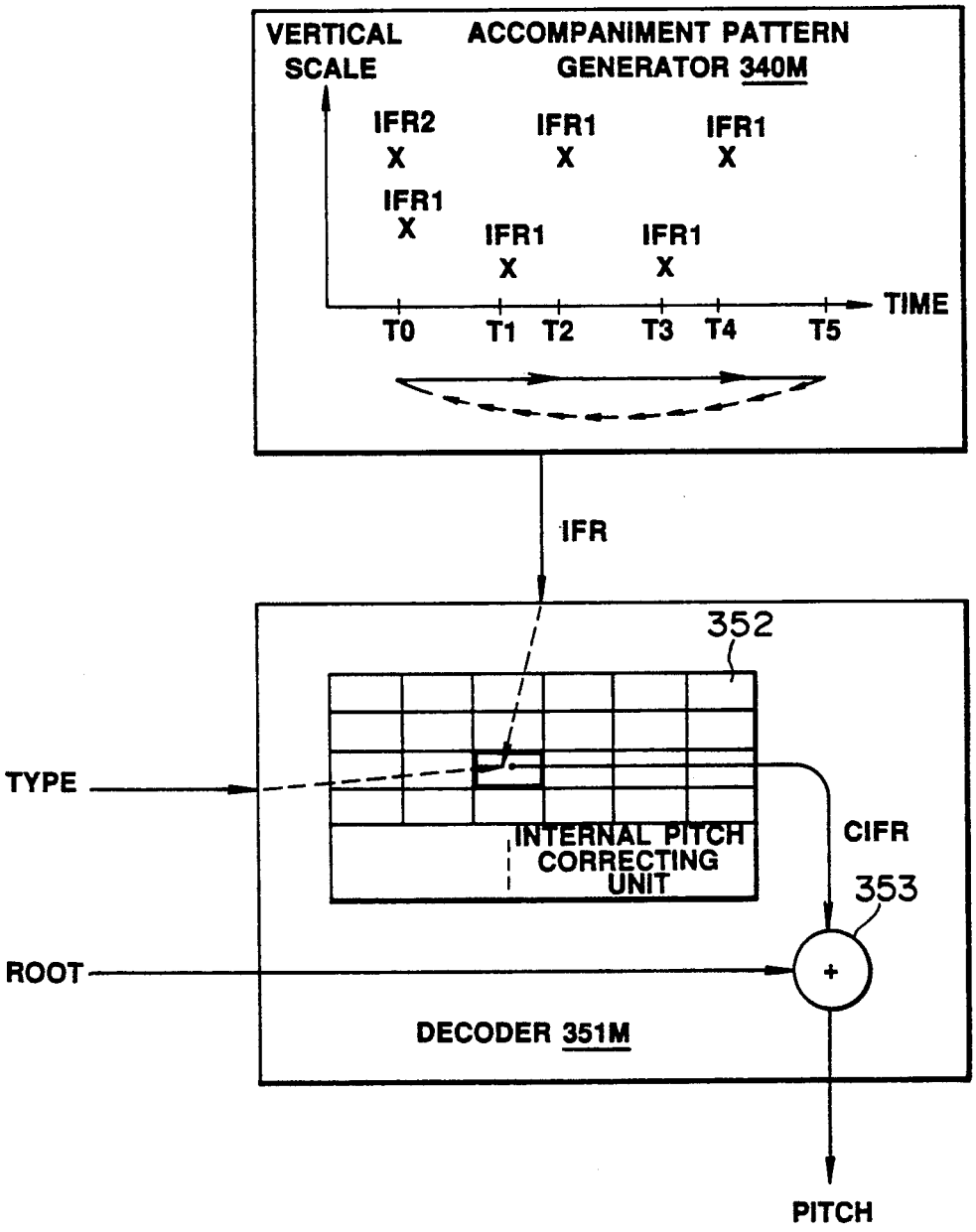
FIG. 12 is a block diagram illustrating a modification of the functional structure of an accompaniment forming unit shown in FIG. 11.
Figure 13:
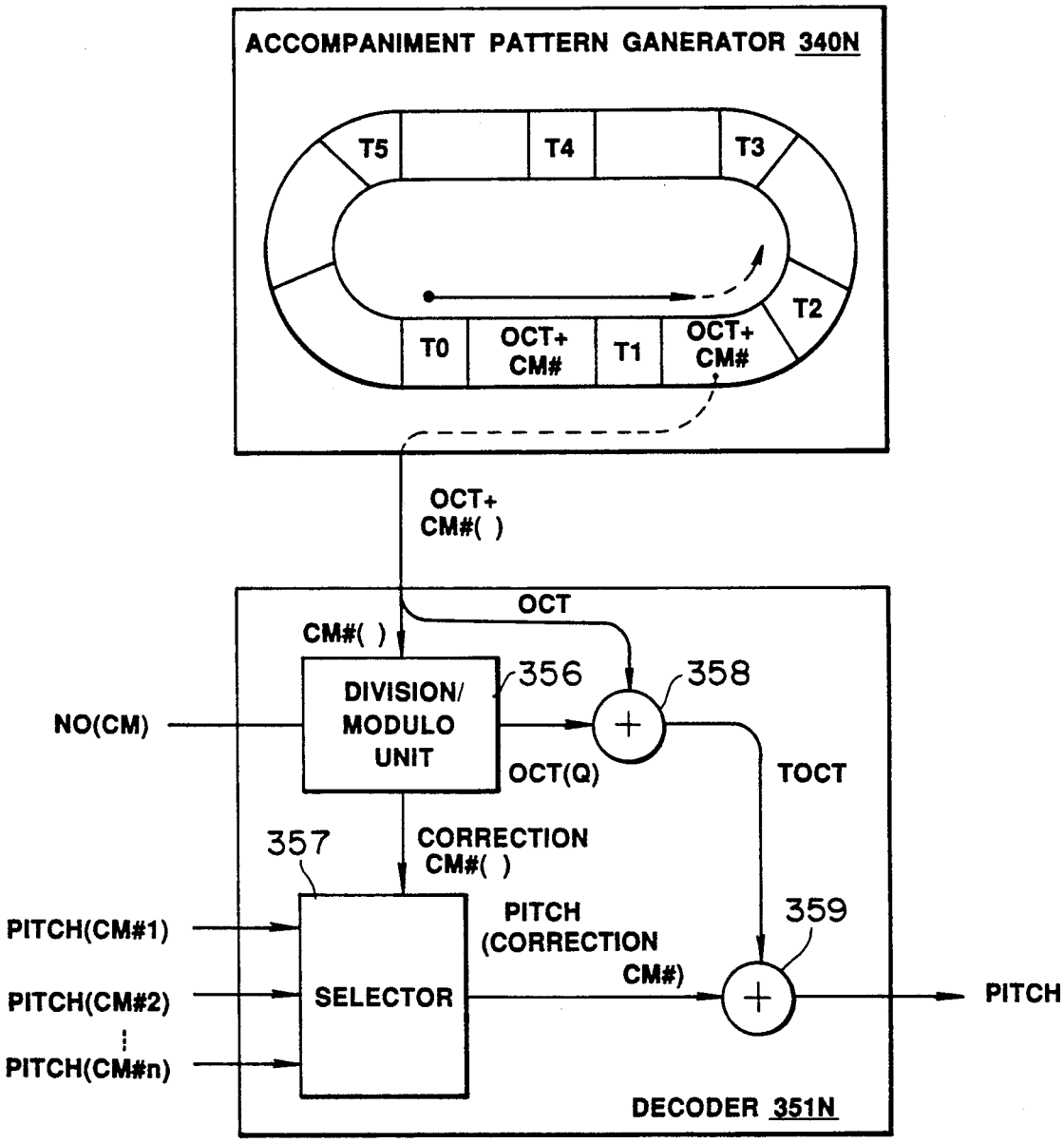
FIG. 13 is a block diagram illustrating a modification of the functional structure of the accompaniment unit shown in FIG. 11.

The accompaniment pattern in the pattern generator 340 and the logic for pattern decoding in the controller 350 may take various forms, two of which are exemplified in FIGS. 12 and 13.

Referring to FIG. 12 first, the accompaniment pattern generator 340M has an accompaniment pattern with lengths as indicated by musical times (T5–T0). The tone elements of the accompaniment pattern each consist of a horizontal or time component and a vertical component or pitch attribute. According to the illustrated accompaniment pattern, two tone elements IFR1 and IFR2 having vertical components with different levels are generated at time T0, another tone element IFR1 having another vertical component is generated at time T1, and so forth. The accompaniment pattern typically has a length of one to several measures. When the end of the accompaniment pattern (as indicated by T5) is reached, the accompaniment pattern generator 340 returns to the beginning of the pattern (indicated by T0) and repeats the accompaniment pattern. In the case illustrated in FIG. 12, each value of the pitch attribute of the accompaniment pattern (hereinafter generally called IFR) represents the pitch interval or distance from the root of a chord. Such pitch intervals IFR are supplied to a pattern decoder 351M from a pattern generator 340M at a timing for the horizontal component or rhythm component of the accompaniment component. The decoder 351M has a pitch interval correcting unit 352, which may be constituted by a look-up table, and a column of the decoding table is specified by the pitch interval IFR from the pattern generator 340M. The decoder 351M is also designed to be able to receive a accompaniment chord (ACCOMP CHORD) from the chord updating unit 310 (FIG. 11) which is expressed by a combination of TYPE and ROOT. A row of the decoding table 352 is specified by TYPE. Corrected pitch interval CIFR is written at a location on the decoding table 352 specified by the TYPE and IFR. This corrected data CIFR is output from the decoding table 352 and is then input to an adder 353 where it is added with ROOT to produce PITCH representing the desired frequency. This PITCH is supplied to the tone generation controller (not shown).

In the second example shown in FIG. 13, a pattern generator 340N supplies a pitch attribute generally represented by OCT+CM#( ) to a decoder 351N at a timing for the rhythm component of the accompaniment pattern. Each pitch attribute included in the accompaniment pattern is constituted by an octave number OCT and a chord member number CM#. The decoder 351N also receives a chord of another form, namely, the pitches of the individual chords, PITCH (CM#1)-PITCH (CM#n), and the number of chord members NO (CM). NO (CM) and CM# ( ) are input to a division/modulo unit 356 of the pattern decoder 351N where CM# ( ) is divided by NO (CM). The remainder is input as corrected CM# ( ) to a selector 357, which in turn selects the pitch "PITCH (corrected CM#)" of a chord member which coincides with the remainder from a set of pitches of chord members and outputs the selected pitch to an adder 359. The quotient of the division, OCT (Q), is input to an adder 358 where it is added with an octave component OCT included in the pitch attributes of the accompaniment pattern to produce TOCT. TOCT is input to the adder 359 where it is added with PITCH (corrected CM#) to be pitch representing a specific frequency and the resultant pitch is supplied to the tone generation controller (not shown).

For diagrammatic simplicity, FIGS. 12 and 13 do not illustrate the accompaniment pattern having a pair of note ON and note OFF commands. The accompaniment pattern typically includes such a pair of note ON and OFF commands, the former command being affixed with the aforementioned pitch attribute and the latter command being affixed with a pitch attribute having the same value. This determines the length or continuous duration of each musical tone (e.g., the length of an eighth note or a quarter note). For a more refined accompaniment pattern, a velocity is added to the note ON and OFF commands. A simple accompaniment pattern should not necessarily require the note ON and OFF commands on the accompaniment pattern memory. The timing for the pitch attribute is considered to be the note ON timing. Often, there are accompaniment patterns which are changed to another pattern in response to a manual operation. According to this invention, the technique of generating an accompaniment pattern and the pattern decoding technique can be of a known type.

Specific Embodiments

Figure 14:
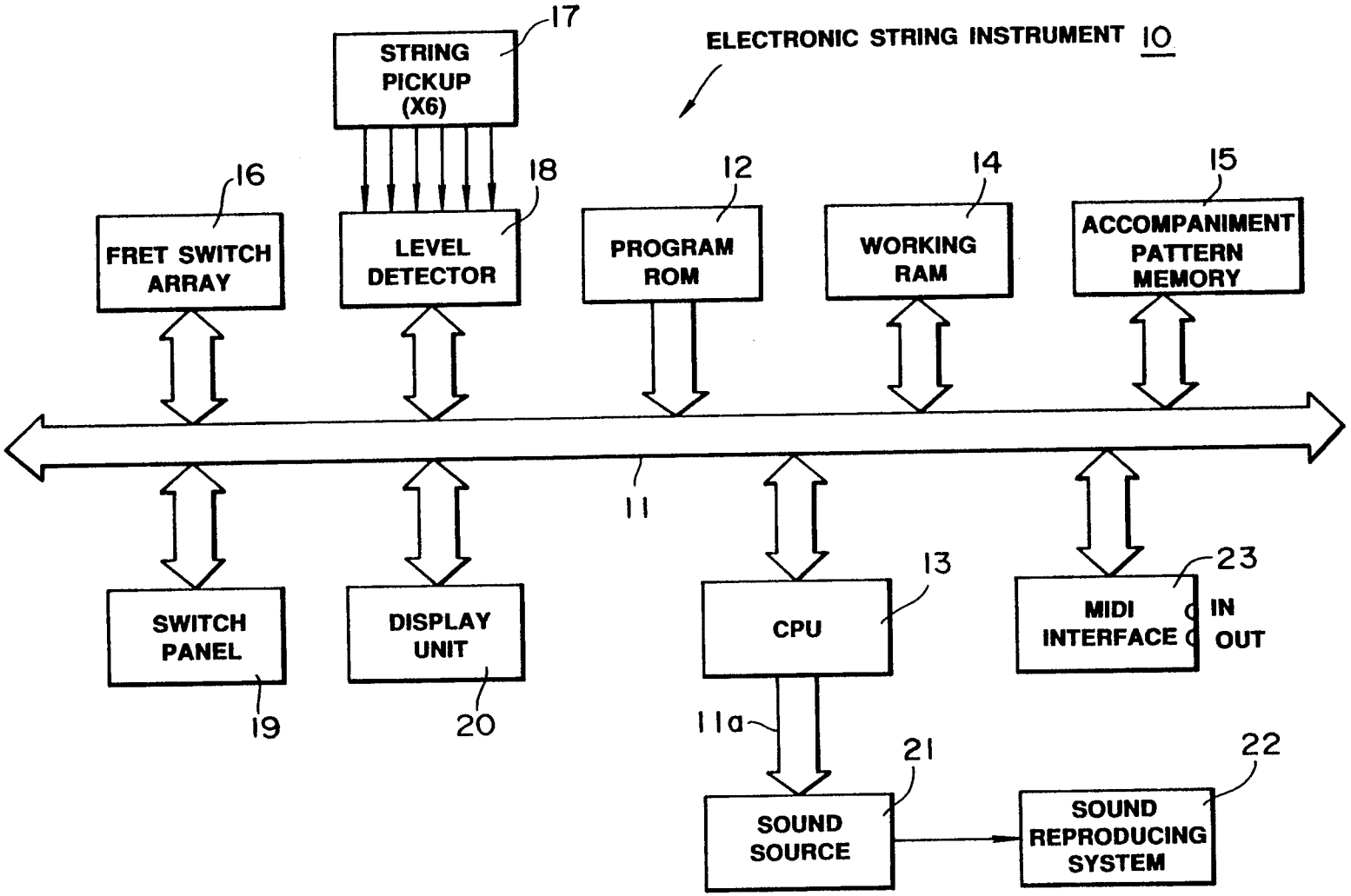
FIG. 14 is a block diagram illustrating the general structure of an electronic string instrument according to one embodiment of this invention.

FIG. 14 illustrates the general arrangement of an electronic string instrument 10 of a guitar type embodying this invention. Various elements are mutually coupled together through a bus 11 as illustrated. The general operation of the electronic string instrument 10 (see FIG. 16) is controlled by a CPU 13 which executes a system program stored in a program ROM 12. The ROM 12 also stores a constant as well as other permanent table and patterns. A working RAM 14 is accessed for data reading and data writing by the CPU 13, and serves to store status parameters of the system, such as selected timbre identifier, selected rhythm identifier, tempo data, string status data, fingerboard status data, system menu identifier, voice assign table, pointer, flag, time data and intermediate data. The accompaniment pattern memory 15 stores a plurality of accompaniment patterns data (including the bass pattern and rhythm pattern).

A fret switch array 16 comprises a plurality of pressure-responsive switches disposed in matrix on the fingerboard (not shown) with frets, and each switch is located between the adjoining frets immediately under six strings (not shown) stretched in the lengthwise direction of the fingerboard. When a string is pressed against the fingerboard with fingers, the associated switch will be activated. In accordance with the system program, the CPU 13 periodically scans the fret switch array 16 to monitor the status of the fingerboard or the operation positions thereon. A string pickup 17 comprises six independent electromagnetic pickups attached to the respective strings at the plucking section (strumming section) of the electronic string instrument, and each pickup converts the acoustic or mechanical vibration of a string into a corresponding electric signal. A level detector 18 receives six electric signals representing vibration from the string pickup 17 and detects the peaks or the vibration levels of the individual cycles of the electric signals. The CPU 13 reads out and analyzes these level data in accordance with the system program, and produces or discriminates the string status parameters, such as vibration start (triggering) of a string, a trigger velocity and string release status.

A switch panel 19 comprises a plurality of switches and volumes, including a mode select switch, data input switch, timbre select switch, rhythm select switch, rhythm start/stop switch, tempo volume, loudness volume and power switch; these switches and volumes are disposed on the body (not shown) of the string instrument. A display unit 20 comprises a plurality of LEDs and LCDs to indicate the present status of the system and data. A sound source 21, which may be constituted by a TDM polyphonic sound source (a plurality of voice modules), synthesizes musical tones in response to a command received over a bus 11*a* from the CPU 13. The synthesized musical tone is sent to a sound reproducing system 22 from which it is generated outside. A MIDI interface 23, having a known structure, receives MIDI data supplied to its input port IN and sends out MIDI data from its output port OUT, under the control of the CPU 13. To accurately maintain the MIDI communication speed, the illustrated MIDI interface 23 is designed to be able to interrupt a currently-running program.

Figure 15:
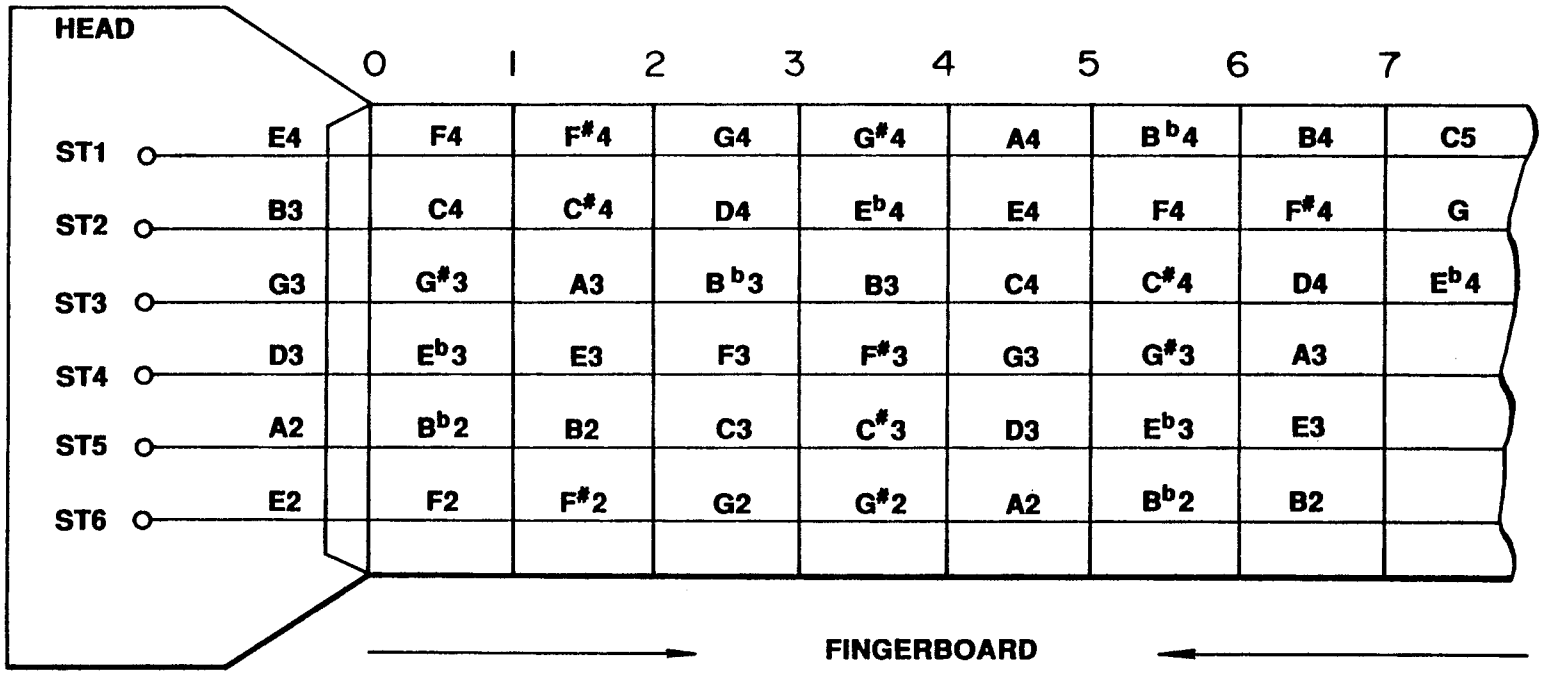
FIG. 15 is a diagram illustrating pitch assignment to a fingerboard.

FIG. 15 exemplifies pitch assignment with respect to the fingerboard which is selected when the electronic string instrument 10 is in a simplified chord designation mode. It should be understood that this pitch assignment is the same as the pitch assignment for an ordinary 6-string acoustic guitar or the one determined by the acoustic properties of the strings and the fret positions on the fingerboard. Further, the pitch assignment is the same as the one selected when the electronic string instrument 10 is in normal play mode. In the illustrated pitch assignment map, the numerals affixed to the individual letters indicate octave numbers. For instance, F4 in the fret 1 at the first string ST1 represents F or fa of the fourth octave. In a mode to designate chord simplification, the electronic string instrument 10 can ignore these octave numbers.

Figure 16:
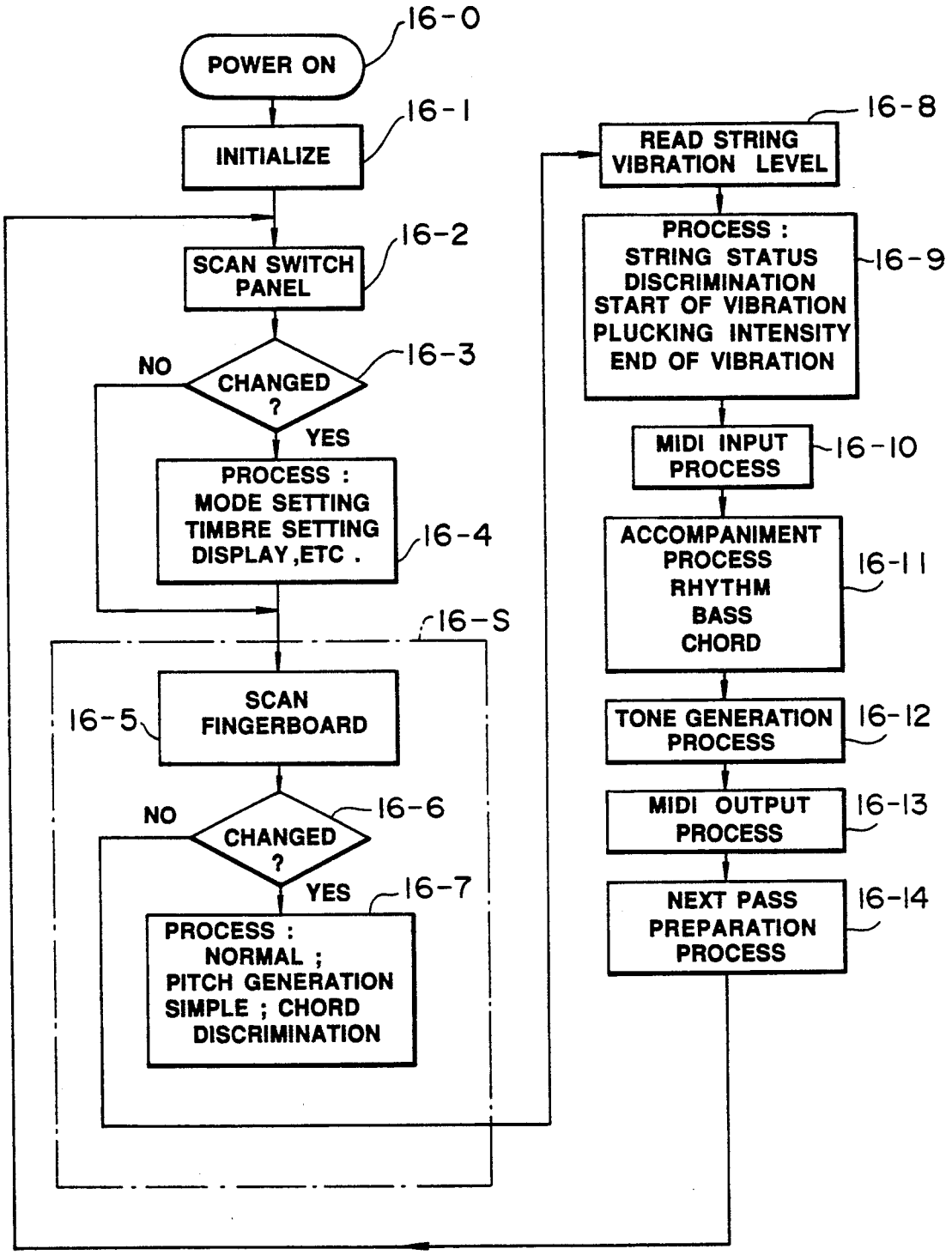
FIG. 16 is a flowchart for the general operation of the electronic string instrument shown in FIG. 14.

FIG. 16 is a flowchart of the general operation of the electronic string instrument 10. When power is turned on (16-0), the CPU 13 executes an initializing routine 16-1 of the system program to perform the clearing, initialization and storage allocation of various data, etc. Thereafter, the CPU 13 repeatedly runs a main program briefly described in steps 16-2 to 16-14. More specifically, the CPU 13 scans the switch panel 19 (step 16-2) to check if the status of the panel 19 is changed (16-3), and executes the routine 16-4 when there is a change in the panel status. In the routine 16-4, the CPU 13 executes operations, such as selective mode setting, updating of a selected timbre, updating of tempo data, preparation for MIDI message transmission, and control of the display unit 20. Subsequently, the program advances to a fingerboard scanning/process program as specified by the block 16-S. This subprogram 16-S consists of a fingerboard scanning routine 16-5 for detecting the status of the fret switch array 16 and a fingerboard data process routine 16-7 which is executed when there is a change in the status of the fingerboard or operation positions (this event being indicated by YES in the discrimination step 16-6). The process routine 16-7 is executed in accordance with the operation mode as determined in the step 16-4; for example, in normal mode, pitch data corresponding to newly-detected one or more operation positions on the fingerboard is produced and in chord simplification designating mode, a process for discriminating a chord from the operation positions is executed. After execution of the subprogram 16-S, the CPU 13 reads level data of string vibration from the level detector 18 (16-8) and selectively performs discrimination of the string status (start of vibration by plucking the string, end of string vibration, etc.) and computation of plucking velocity (16-9). Subsequently, the CPU 13 executes an input MIDI data process routine 16-10 including the decoding of MIDI data (if any) transmitted from an external electronic string instrument and received by an interrupt program (not shown). The next routine 16-11 is an accompaniment process where accompaniment patterns (including a rhythm-only pattern, bass pattern and chord accompaniment pattern) are selectively prepared and decoded. At this point of time on the main program, data necessary for controlling the sound source 21 has been prepared. Accordingly, the main program advances to a tone generation process (sound source control) routine 16-12 where voice assign is selectively executed and commands including the desired data (the note ON command, note OFF command and commands for alteration of other tone parameters) are sent to the sound source 21. In the routine 16-13, the CPU 13 prepares a MIDI message (if any) to be transmitted. Finally, the CPU 13 prepares what is necessary for the next pass of the main program (including resetting of the desired flag and increment of a pass counter) (16-14), and then returns to the head of the main program (routine 16-2).

The invention relates to a chord discriminating apparatus incorporated in an electronic string instrument, which discriminates a chord specified by simplified fingering on a fingerboard (positioning fingers with respect to strings on the fingerboard and pressing the strings against the fingerboard at that position), and to an apparatus which uses discriminated chords (e.g., a manual or automatic accompaniment unit or an accompaniment unit operative with man-machine cooperation). The following detailed description will be given of an electronic string instrument 10 as an exemplary embodiment with regard to the above points.

CHORD DISCRIMINATION—EXAMPLE 1

In general, a process to "designate," "produce" or "synthesize" chords has the opposite relation with a process to "analyze," "discriminate" or "identify" chords. According to this invention, chord designation is performed by a player of an electronic string instrument while discrimination of a designated chord is executed by the instrument. With these points in mind, a statement "designating a chord" is interchangeable with a statement "discriminating or determining or identifying a chord" without confusion and such interchange is convenient sometimes. The meaning of such statements should be clear from the context in which they are used.

Figure 17A:
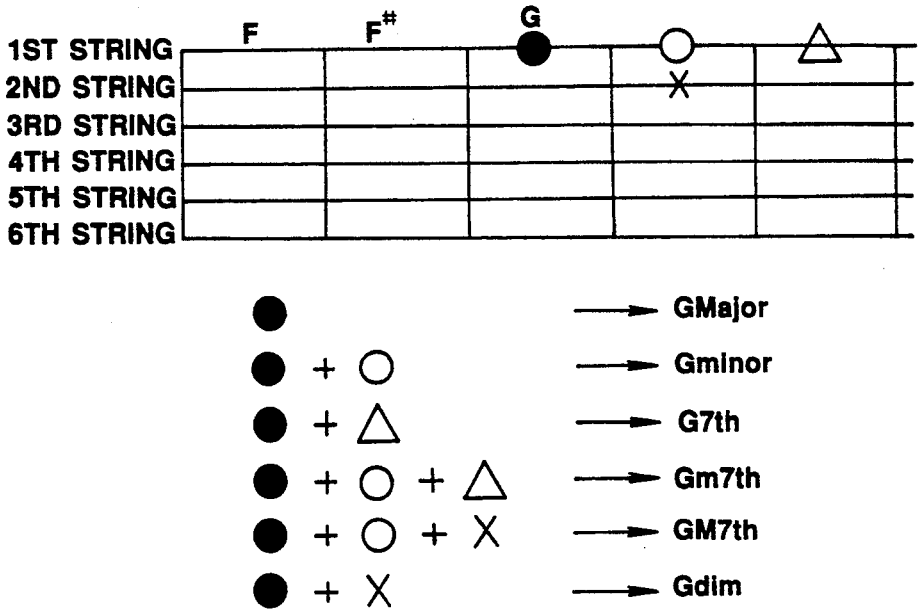
FIGS. 17A and 17B show diagrams illustrating a chord designation method executed by simplified fingering done to a fingerboard.
Figure 17B:
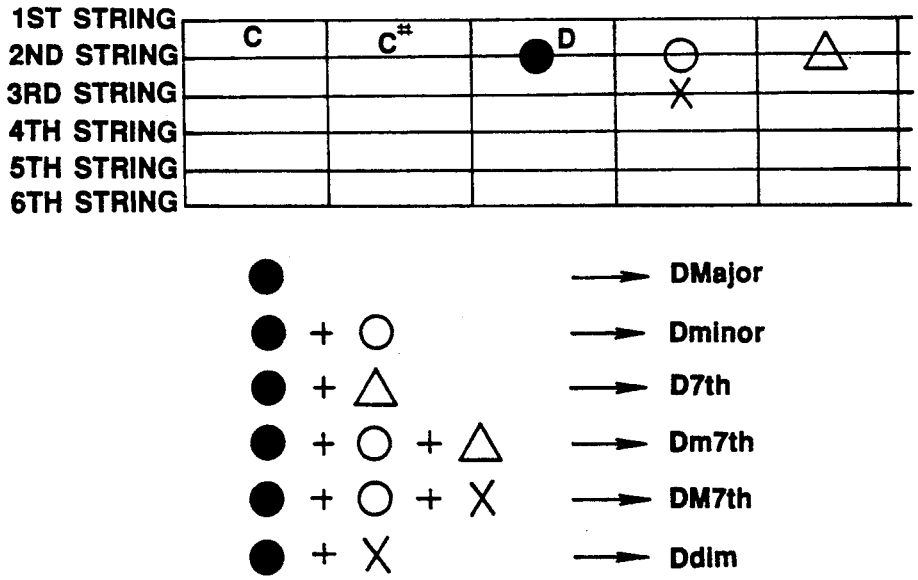

FIGS. 17A and 17B ilustrate the first example of a chord designating or discriminating method by means of a diagram of a fingerboard with frets. In FIGS. 17A and 17B, the black circle represents the root fret position (root designation position). As illustrated, of one or more operated fret positions, the one closest to the head of the fingerboard is the root fret position. The pitch associated with the root fret position is the same as the one generated when playing an ordinary melody (see FIG. 15). For instance, when the third fret of the first string is the root fret position, the pitch is G (see FIG. 17A), and when the third fret of the second string is the root fret position, the pitch is D (see FIG. 17B). The types of chords are defined by a combination of the root fret position and operated fret positions close to the former position. With only the root fret position, the chord type is a MAJOR, with the root fret position and a position one fret above of the same string being pressed, it is a minor, and with the root fret position and a position of the same string, two frets above, being pressed, it is a seventh (7th). With the root fret position and positions of the same string, one fret and two frets above, being pressed, the chord type is a minor seventh (m7th), with the root fret position and positions of the same string and an adjacent string, both one fret above, being pressed, it is a major seventh (M7th), and with the root fret position and a position of an adjacent string, one fret above, being pressed, it is a diminished (dim). The fixed relationships set forth above are defined by the CPU 13 of the FIG. 14, as will become clear from the following description of the determination of types of chords.

Figure 18:
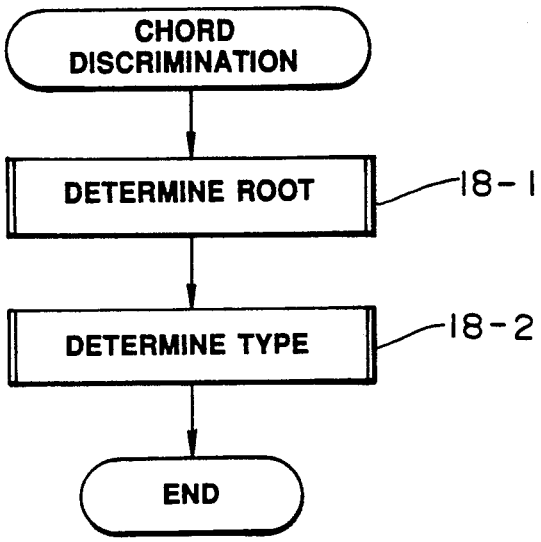
FIG. 18 is a simplified flowchart for chord discrimination.

The electronic string instrument 10 can discriminate a chord designated by a player in the mode shown in FIGS. 17A and 17B. When the electronic string instrument 10 is in a predetermined operation mode, this chord discrimination is executed with the fingerboard scanning/process program 16-S schematically illustrated in the flowchart of FIG. 16. As illustrated in FIG. 18, the chord discriminating routine basically consists of a process 18-1 for determining the root of a chord and a process 18-2 for determining the type of the chord.

Figure 19:
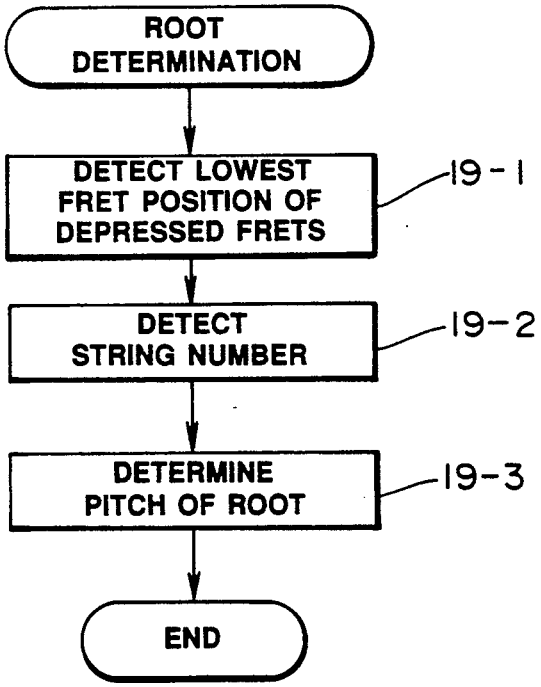
FIG. 19 is a flowchart for determining the root of a chord according to the chord designation method shown in FIGS. 17A and 17B.

With reference to FIGS. 19 (root determination) and 20 (type determination), a detailed description will be given of the root determination and type determination according to the chord designation or discrimination (1) already discussed referring to FIGS. 17A and 17B. In the root determination process in FIG. 19, the CPU 13 first detects the lowest one of pressed fret positions (19-1). The CPU 13 then checks With which string the lowest fret position is associated (19-2). Pitch data is then acquired (19-3) using the fret number attained in step 19-1 and the string number attained in step 19-2. The data conversion here is the same as the one executed for an ordinary melody with respect to the same fret number and same string number. As a result, of the operated fret positions detected by a pressed-string detector 1, the one closest to the head is taken as the root fret position and a pitch is associated as a chord root with that position in a similar manner involving playing of a melody.

Figure 20:
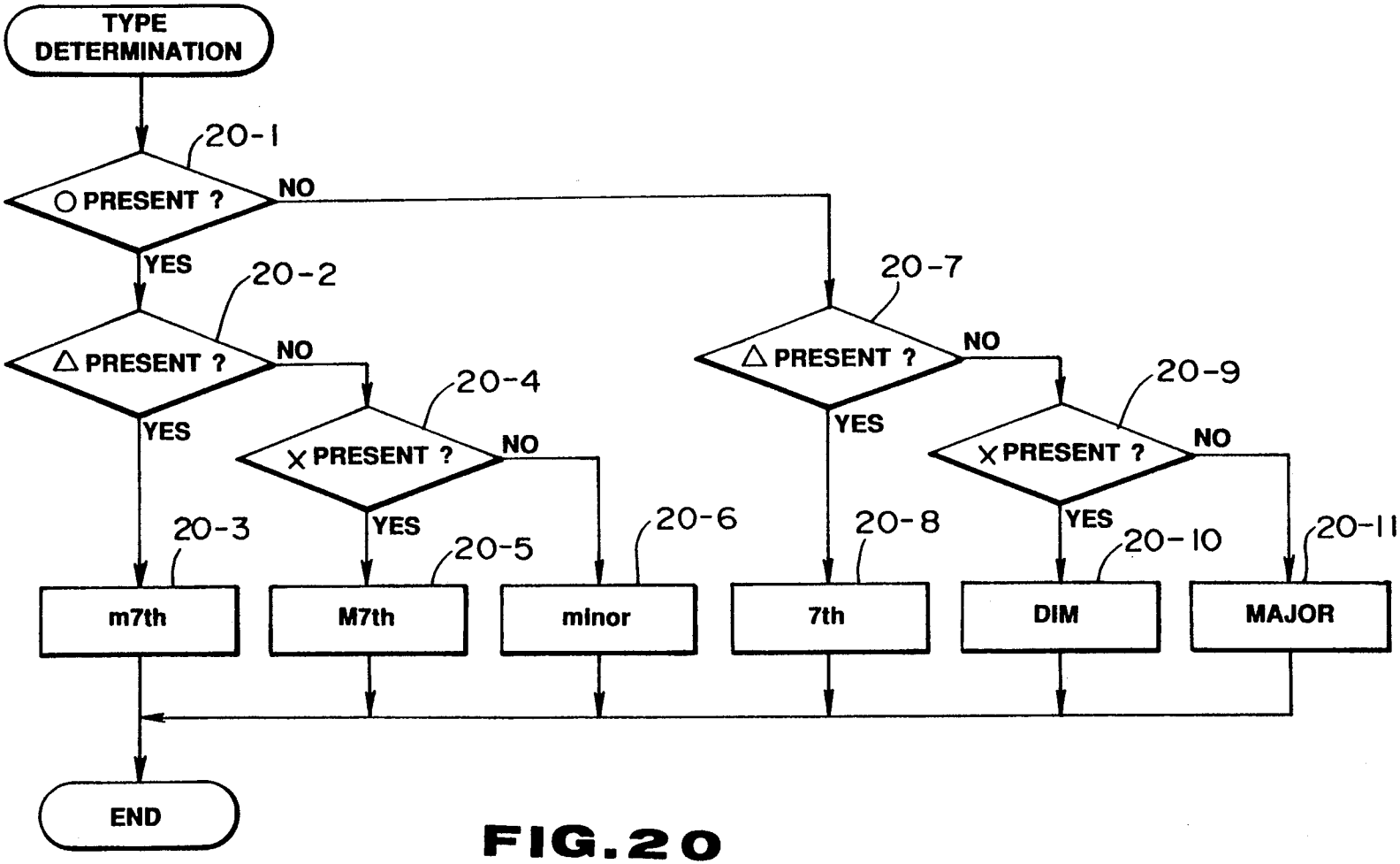
FIG. 20 is a flowchart for determining the type of a chord according to the chord designation method shown in FIGS. 17A and 17B.

After determination of the root (pitch indicated by the black circle in FIGS. 17A and 17B) in the above manner, the type of a chord is determined by the method illustrated in FIG. 20. ○, Δ, x in the flowchart of FIG. 20 mean the same as those shown in FIGS. 17A and 17B; ○ indicates the position of the same string one fret above the root fret position, Δ is the position of the same string two frets above the root fret position, and x is the position of an adjacent string one fret above the root fret position. It is checked in step 20-1 whether or not the fret position marked by ○ is operated, and if affirmative, it is checked in step 20-2 whether or not the fret position marked by Δ is operated. If affirmative in step 20-2, it means that in addition to the root fret position, positions of the same string one fret and two frets above are operated. Therefore, the chord type is determined to be m7th (20-3). If the decision in step 20-2 is negative, it is then checked in step 20-4 whether or not the fret position marked by X is operated. If affirmative in step 20-4, it means that in addition to the root fret position, positions of the same string and an adjacent string, both one fret above, are operated. Therefore, the chord type is determined to be M7th (20-5). If the decision in step 20-4 is negative, it means that in addition to the root fret position, the position of the same string one fret above is operated, not the position of the same string two frets above nor the position of an adjacent string one fret above. Therefore, the chord type is determined to be minor (20-6). If the decision in step 20-1 is negative, it is then checked in step 20-7 whether or not the fret position marked by Δ is operated. If affirmative in step 20-7, it means that in addition to the root fret position, the position of the same string two frets above is operated, not the position above one fret. Therefore, the chord type is determined to be 7th (20-8). If the decision in step 20-7 is negative, it is checked in step 20-9 whether or not the position marked by X is operated. If affirmative in this step, it means that in addition to the root fret position, the position of an adjacent string one fret above is operated, not the position of the same string one fret above string one fret above. Therefore, the chord type is determined to be DIM (20-10). If the decision in step 20-9 is negative, no other fret position than the root fret position is operated, i.e., neither the positions of the same string one fret and two frets above the root fret position, nor the position of an adjacent string one fret above is operated. In other words, only the root fret position has been operated. Therefore, the chord type is determined to be a MAJOR (20-11). The chord discrimination described referring to FIGS. 17A and 17B is realized by the above manner.

Referring again to FIGS. 17A and 17B, according to the illustrated chord designation method, every chord can be designated by operation positions including within a narrow range on the fingerboard over which fingers can easily be spanned. Further, it should be understood that every chord can be designated by the operation positions lying in a nearly straight line on the fingerboard. Furthermore, the root designation position is at the end of the operation positions, i.e., closest to the head, so that the root designation position can always be a reference position for a player to designate a chord. Most players already know a pitch assigned to such a root designation position, so that they need not learn it again.

CHORD DISCRIMINATION—EXAMPLE 2

Figure 21:
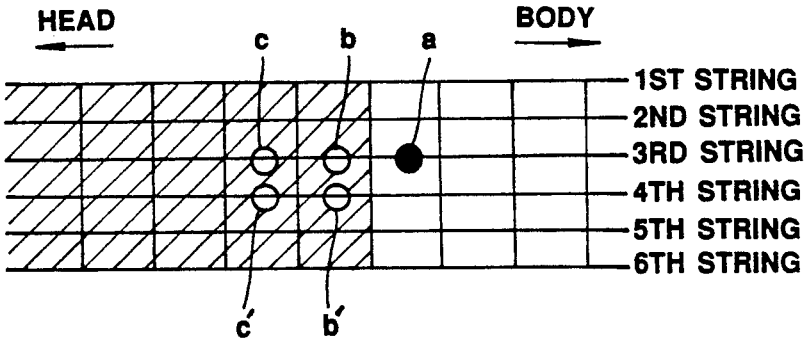
FIG. 21 is a diagram illustrating another chord designation method.

FIG. 21 illustrates the second example of a chord designating or discriminating method by means of a diagram of a fingerboard with frets. In this example, the highest of the operated fret positions (on the side of the body) is the root fret position (see the black circle denoted by a). The pitch assigned to the root fret position is the same as the one given in the first example which is attained when playing an ordinary melody. The types of chords are determined by the number of operated fret positions and mutual positional relation between the operated fret positions close. More specifically, with only one fret position being operated, the chord type is a MAJOR, with two fret positions being operated, it is a minor or seventh (7th), and with three fret positions being operated, it is a minor seventh (m7th). In a case where two fret positions are operated, when one of them is one fret above the root fret position, the chord type is a minor, and when it is two frets above the root fret position, the chord type is a m7th. It should be noted that the restriction of those operated fret positions excluding the root fret position with respect thereto is reduced. For instance, with three frets being operated, two other fret positions than the root fret position may be anywhere as long as they are below the root fret position (within the shaded range shown in FIG. 21). In either case where the frets a, b and c are operated in FIG. 21 or the frets a, b′ and c′ are operated, therefore, the m7th can be designated. With two frets being operated, it is necessary to designate either the minor or 7th distinctly; in the first case, the root fret and a fret, one fret above, are simultaneously pressed and in the second case, the root fret and a fret, two frets above, are simultaneously pressed. However, the fret simultaneously pressed together with the root fret may lie on any string. For instance, the same minor can be designated by simultaneously pressing either frets a and b or frets a and b′, or the same 7th can be designated by simultaneously pressing either frets a and c or a and c′.

Figure 22:
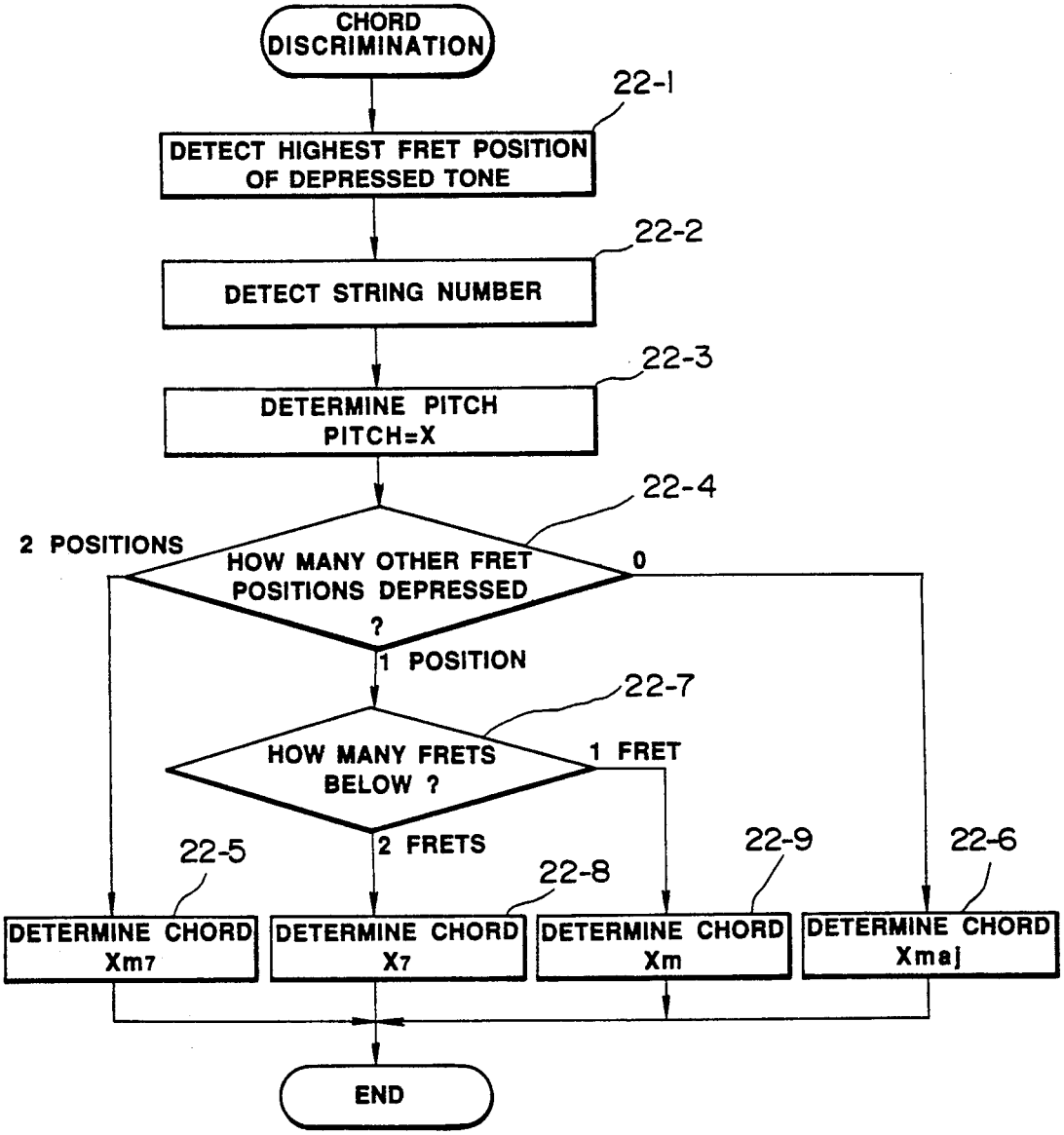
FIG. 22 is a flowchart for determining the type of a chord according to the chord designation method shown in FIG. 21.

To achieve the above-described chord designation, the CPU 13 operates along the flowchart shown in FIG. 22. The highest of the operated fret positions is detected in step 22-1, and its string number is detected in step 22-2. The pitch X of the root is determined from the highest fret position and the string number in step 22-3. The root of a chord has been determined by this point of time. Then, the number of operated fret positions other than the root one will be discriminated in step 22-4. When two fret positions other than the root fret position are operated, the chord type is determined to be a m7th chord, Xm7, (22-5). When no other frets positions than the root fret position are operated, the chord type is determined to be a major chord, XMAJ (22-6). When one other fret position than the root fret position is operated, it is discriminated in step 22-7 whether the position is one fret or two frets above the latter position. If it is the former case, the chord type is determined to be a 7th chord X7 (22-8), and in the latter case, it is determined to be a minor chord, Xm, (22-9).

As describe above, according to the second example, the chord types are determined by the number of operated frets and the mutual relation between the frets, thus eliminating the need to strictly specify a combination or type of fret positions to be operated for each chord type. This can permit a player to designate the same chord with a relatively rough or simple fingering. In addition, this example is advantageous in that a chord can also be designated by a complicated fingering as per the first example.

CHORD DISCRIMINATION—EXAMPLE 3

FIGS. 23A to 23E illustrate the third example of the chord designation or discrimination.

In this example, of one or more operation positions, the closest to the head is the operation position for determining the root of a chord. In FIGS. 23A to 23E, therefore, the fifth fret position is the root designation position. In this case also, the pitch associated with each fret position is the same as the one assigned for playing an ordinary melody. Since the illustrated root designation position lies on the third string, the pitch of the root is C.

The types of chords depend on the status of the fingerboard area on the left side (head side) of the root designation position but close to that position. When only one fret is operated, the chord type is a major (see FIG. 23A), when a fret position to the left of the root fret position is operated, the chord type is a 7th (see FIG. 23B), when a fret position two frets left to the root fret position is operated, the chord type is a minor (see FIG. 23C), and when fret positions one fret and two frets left to the root fret position are both operated, the chord type is a m7th (see FIGS. 23D and 23E). It should be noted that the string components of the designated positions with respect to the root designation position do not influence the positional components across the fingerboard and chord types can be determined by the fret distance along the length of the fingerboard between the designated positions and the root designation position or by a combination of these positions.

Figures 23A, 23B, 23C, 23D, 23E:
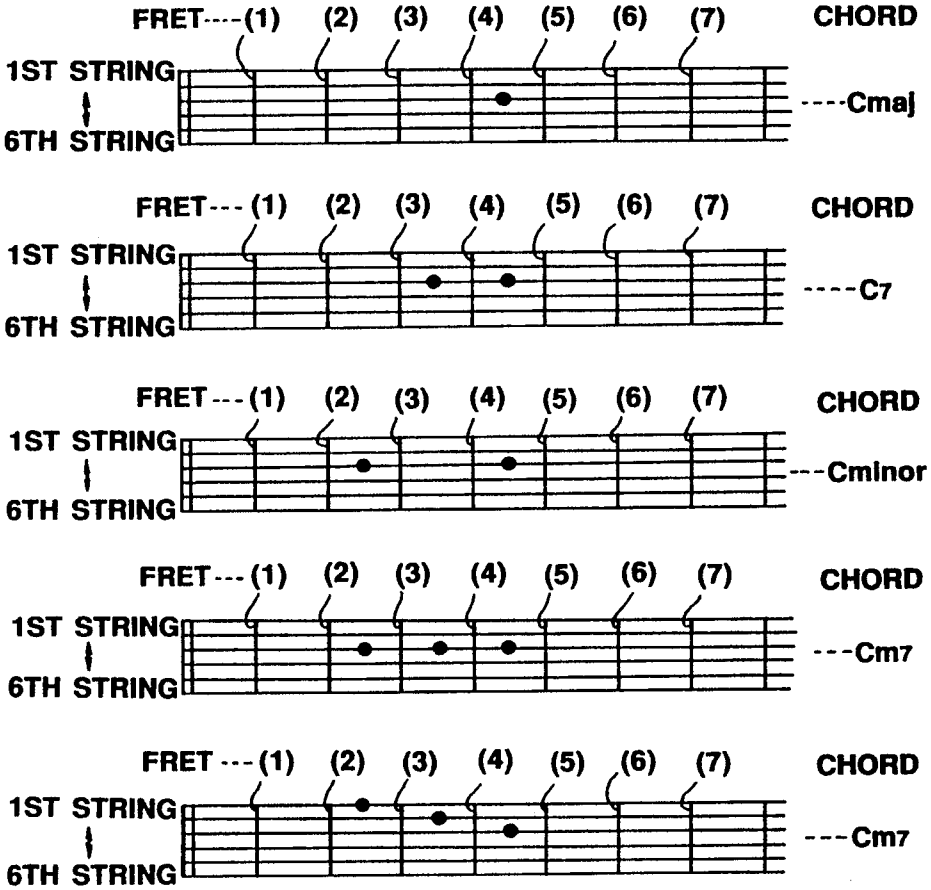
FIGS. 23A to 23E show diagrams illustrating another chord designation method.
Figure 24:
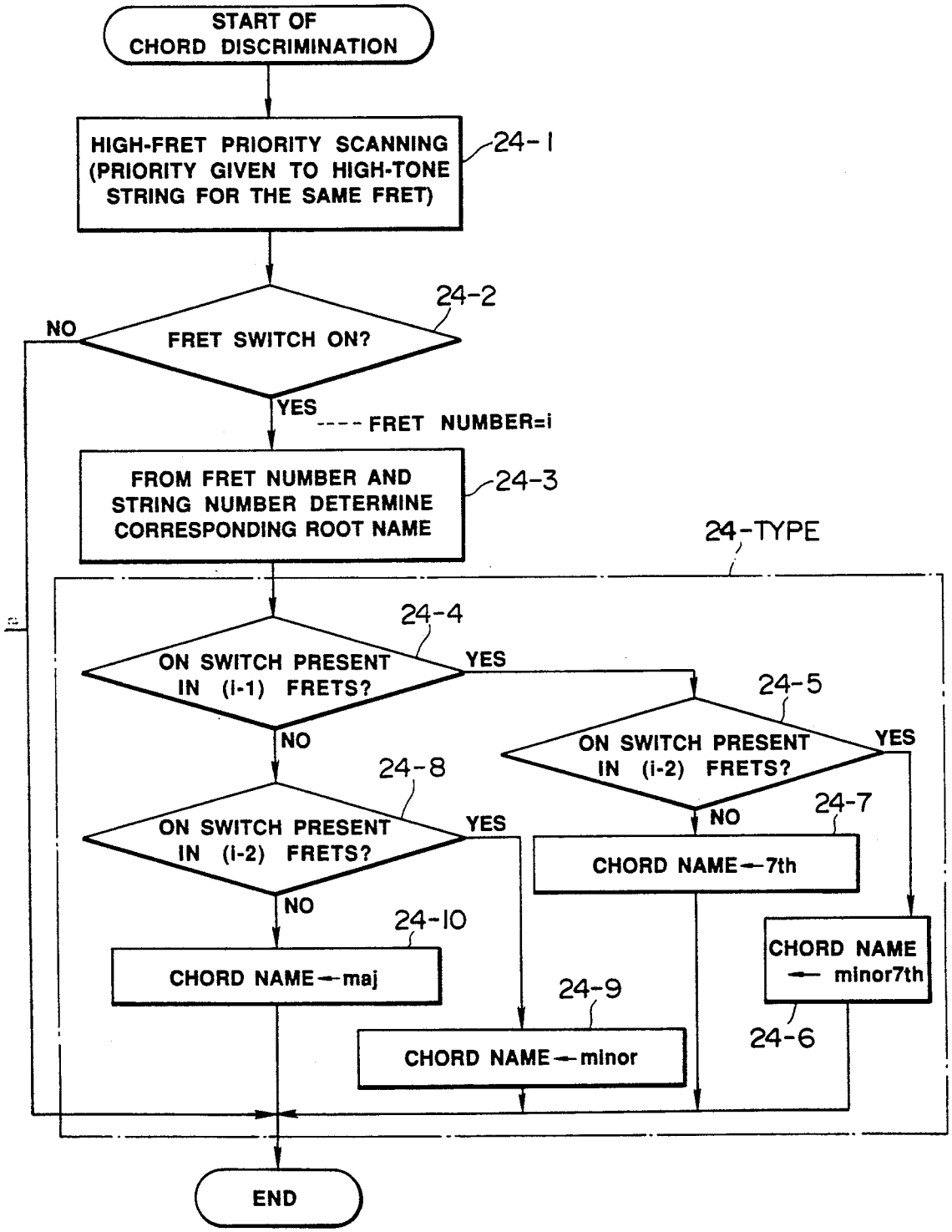
FIG. 24 is a flowchart for chord discrimination according to the chord designation method shown in FIGS. 23A to 23E.
Figure 25A:
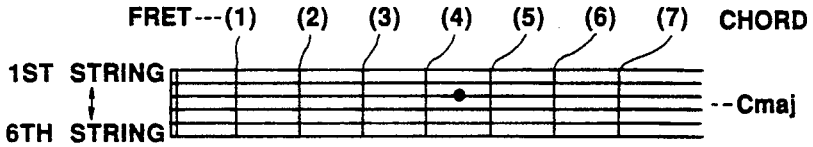
FIGS. 25A to 25E show diagrams illustrating a further chord designation method.
Figure 25B:
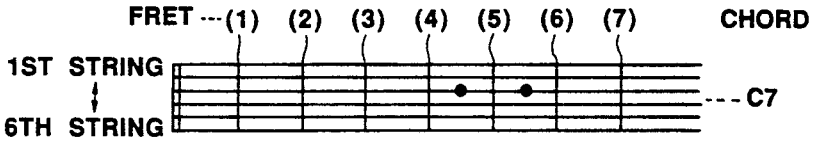
Figure 25C:
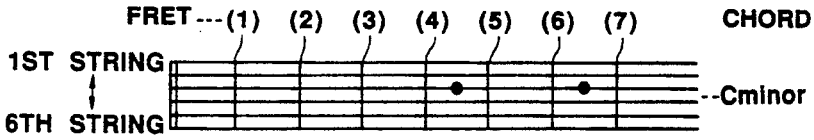
Figure 25D:
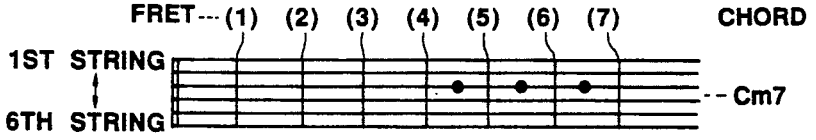
Figure 25E:
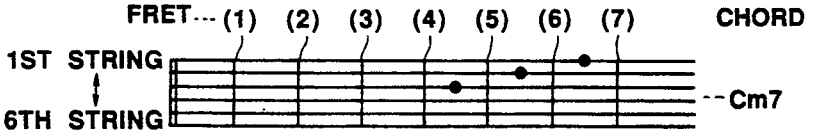

FIG. 24 illustrates a flowchart of a program for detecting the operation positions on the fingerboard given for chord designation according to the chord designating method (3) and discriminating an intended chord. According to this program, the CPU 13 scans the fingerboard and the fret switch array 16 in the order shown in FIG. 3D (step 24-1). This scanning consists of a main scanning for scanning the first string position to the sixth one across the fingerboard and a subscanning for moving to the right by one along the length of the fingerboard upon completion of one main scanning and repeating the main scanning there so that the scanning advances from the body side toward the head in the lengthwise direction of the fingerboard. Hereinafter, the scanning as shown in FIGS. 3A to 3D is called width-first scanning. During such width-first scanning (type of FIG. 3D), when an activated fret switch is detected, the position (i,j) (i: fret number and j: string number) of that fret switch specifies the root according to the chord designation map shown in FIGS. 23A to 23E, and the pitch of the root can be computed from the fret number i and string number j assigned to the first fret switch found according to the pitch assignment map (see FIG. 15) (This process is indicated by steps 24-2 and 24-3 in FIG. 24.) This completes the root discrimination of an intended chord. The CPU 13 then executes a process enclosed within the block 24-TYPE in FIG. 24 for chord discrimination; this process will be described in detail below. The scanning fret position is moved to the left of the root position by one to select a fret column i-1 and this fret column is scanned from the first string to the sixth one to check if there exists an activated fret switch (step 24-4). If affirmative in this step, the statuses of six fret switches disposed along the fret column i-2, one fret further left to the previous fret column, should be checked (step 24-5). If the fret column i-2 also contains an activated fret switch, the chord type is a m7th according to the chord designating method as shown in FIG. 23D or 23E (step 24-6). If the decision in step 24-5 is negative, the chord type is determined to be a 7th (step 24-7) and the flow returns to step 24-4. If the decision in this step is negative, i.e., if the fret column i-1 to the left of the root designation position contains no activated fret switches, the flow jumps to step 24-8 where it is checked whether or not the fret column i-2, one column further left to the previous one, contains any activated fret switch. If the fret column i-2 contains an activated fret switch, the chord type is a minor (step 24-9), and if it does not, the chord type is a major (step 24-10).

In the above manner, the chord discriminating program shown in FIG. 24 permits the CPU 13 to execute the width-first scanning of the type D with respect to the fingerboard (fret switch array), discriminate the root designation position by the two dimensional positions of the activated fret switch first found, convert the positions into the pitch of the root, check the statuses of 12 fret switches in two fret columns, one and two columns left to the discriminated root designation position, and discriminate the chord type according to the results. It is obvious that this process is in accordance with the rules of the chord designation shown in FIG. 24 and chord discrimination is completed within the shortest time possible (as far as the sequential program control is concerned). This program may be modified in such a way that the entire region of the fingerboard is scanned first to detect a set of scanned positions and store the set in a linear array in a memory, the array of operation positions are sorted later in accordance with the priority of the type of FIG. 3D, and the sorted array is checked from one end to the other to discriminate the root and type of a chord. Means for scanning the fingerboard may be realized by hardware without a program control. Further, exclusive hardware for chord discrimination may replace a combination of the chord discriminating program and the CPU 13, although such a modification lacks flexibility.

CHORD DISCRIMINATION—EXAMPLE 4

The fourth example of the chord designation or discrimination should be easily understood from FIGS. 25A to 25E illustrating the fingerboard with operation positions marked by black circles. This example is similar to the third example described with reference to FIGS. 23A to 23E; the only difference lies in that the root position on the fingerboard is defined to be that of the operation positions which is the closest to the head as compared with its being closest to the body in the third example.

Figure 26:
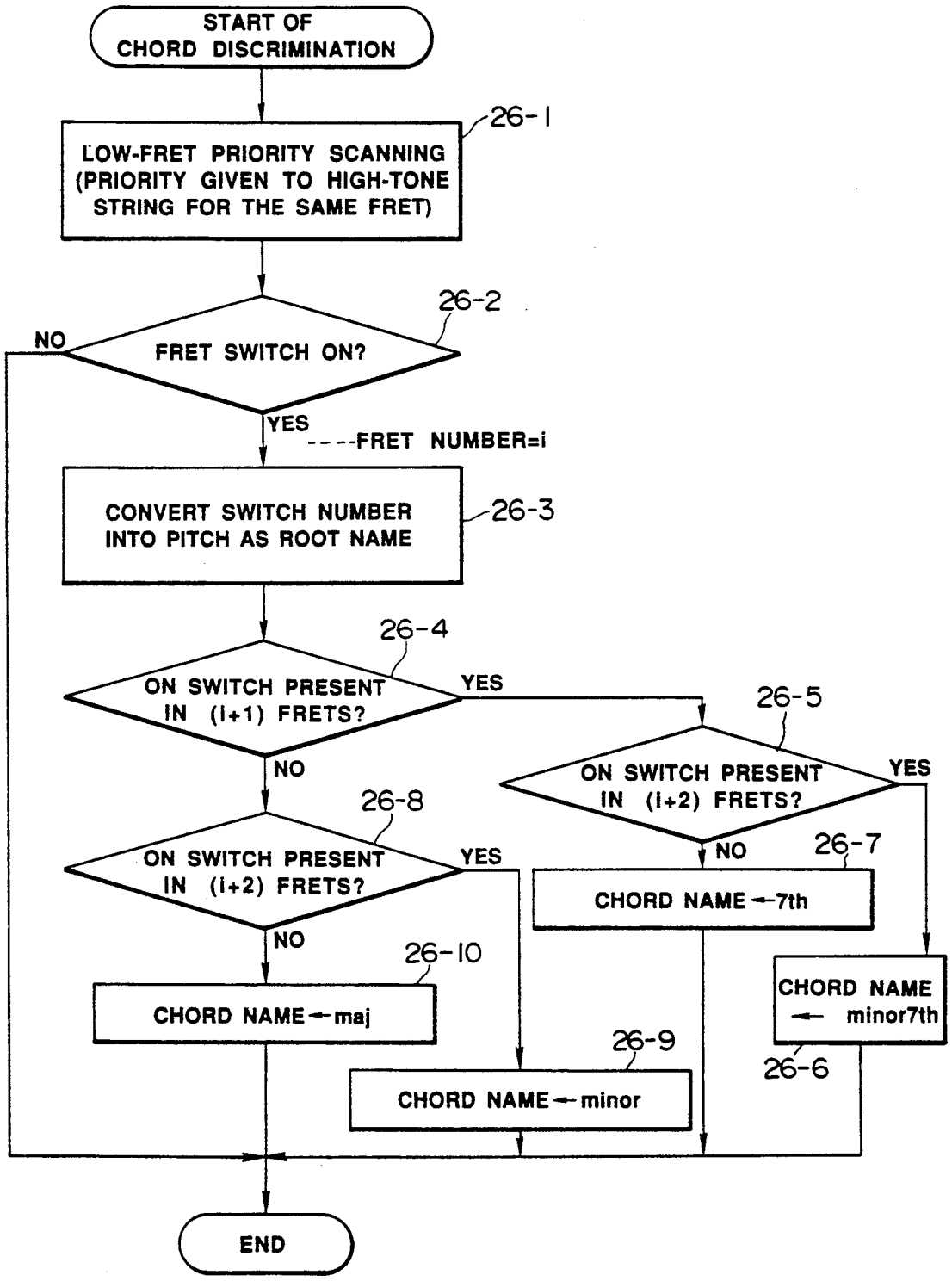
FIG. 26 is a flowchart for chord discrimination according to the chord designation method shown in FIGS. 25A to 25E.
Figure 27A:
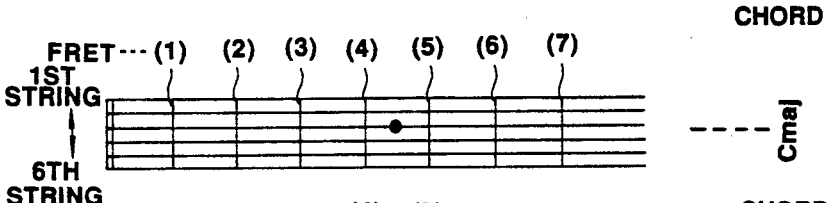
FIGS. 27A to 27H show diagrams illustrating an expanded version of the designation method shown in FIGS. 25A to 25E.
Figure 27B:
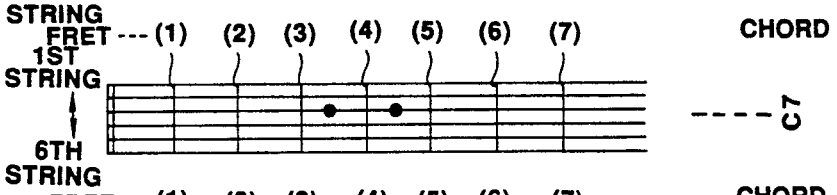
Figure 27C:
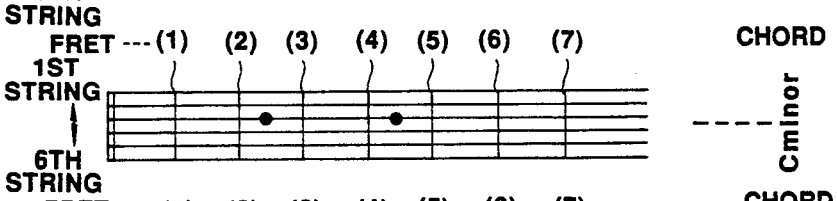
Figure 27D:
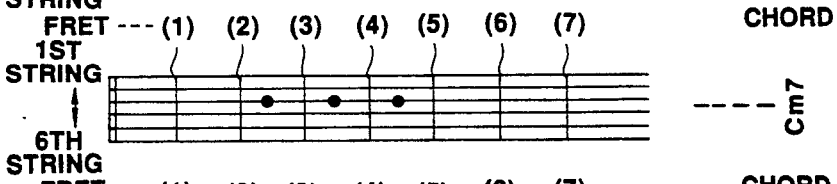
Figure 27E:
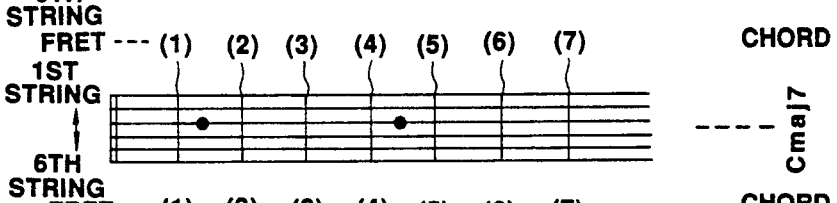
Figure 27F:
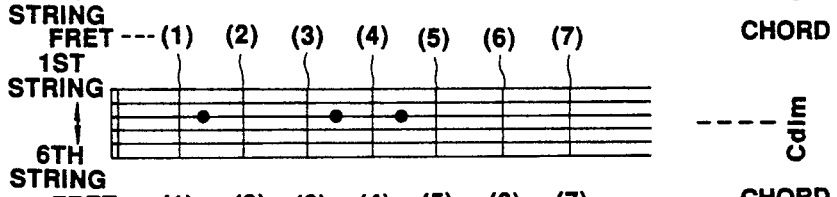
Figure 27G:
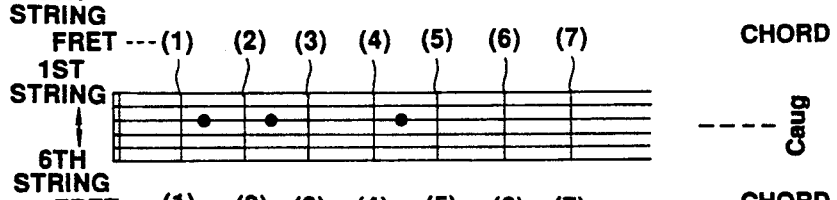
Figure 27H:
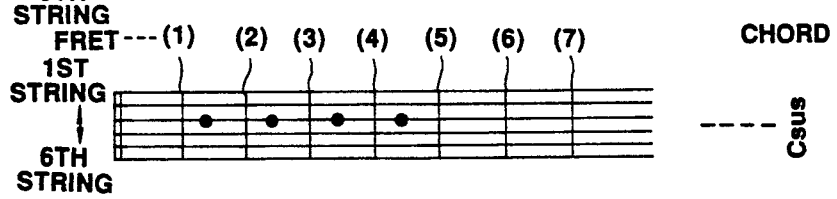

To achieve the above, the CPU 13 operates along the flowchart shown in FIG. 26. This chord discrimination process is the same as the one involved in the third example except for the following points:

1) The width-first scanning of the type C is employed in place of the type D (FIG. 3D) in the routine 26-1, i.e., the scanning advances from the fret switch located at the first fret at the first string toward the one located at the sixth string along the fret column.
2) A fret column i+1 one column right to the root position is scanned in the routine 26-4.

3) A fret column i+2, one column further right to the previous one is operated in the routine 26-5 or 26-8.

A further explanation of the fourth example will be omitted below.

CHORD DISCRIMINATION—EXAMPLE 5

The fifth example of the chord designation or discrimination should be easily understood from FIGS. 27A to 27H illustrating the fingerboard with operation positions marked by black circles. Actually, this example is an extension of the third example (FIGS. 23A to 23E), and the extended sections are illustrated in FIGS. 27E to 27H. In short, the fifth example uses up to three fret columns from the fret column of the root position (they are located to the left of the root position) for designation of a chord type. The "major seventh" is designated by two operation positions, a combination of the root position lying on an arbitrary fret column i and a position on an arbitrary string on a fret column i-3. The "diminished" is designated by operation positions within the root fret position i and other fret columns i-1 and i-3, the "augmented" is designated by operation positions within the root fret column i and fret columns i-2 and i-3, and the "suspended" is designated by operation positions within four consecutive fret columns including the one having the root position.

Realization of means for discriminating a chord designated along the above rules would be easy for those skilled in the art by making an obvious modification to the program shown in FIG. 24.

The chord designation in FIGS. 27A to 27H may be interpreted differently. All the operation positions shown in FIGS. 27A to 27H lie on a straight line (on a string, in particular). It would be sometimes desirable that a chord can be designated or discriminated simply by a combination of certain operation positions on a straight line. In this case, it is desirable to execute the length-first scanning on the fingerboard. According to this scanning method, the fingerboard is scanned along tracks extending in association with the strings in such a way that upon completion of the scanning of one track, the next track is scanned until the last track is reached. The first operation position detected during the scanning of one track is discriminated as the root position. Then, three positions next to the root position on the same track will be checked. From the result, a chord type is discriminated.

CHORD DISCRIMINATION—EXAMPLE 6

Figures 28A, 28B, 28C, 28D, 28E:
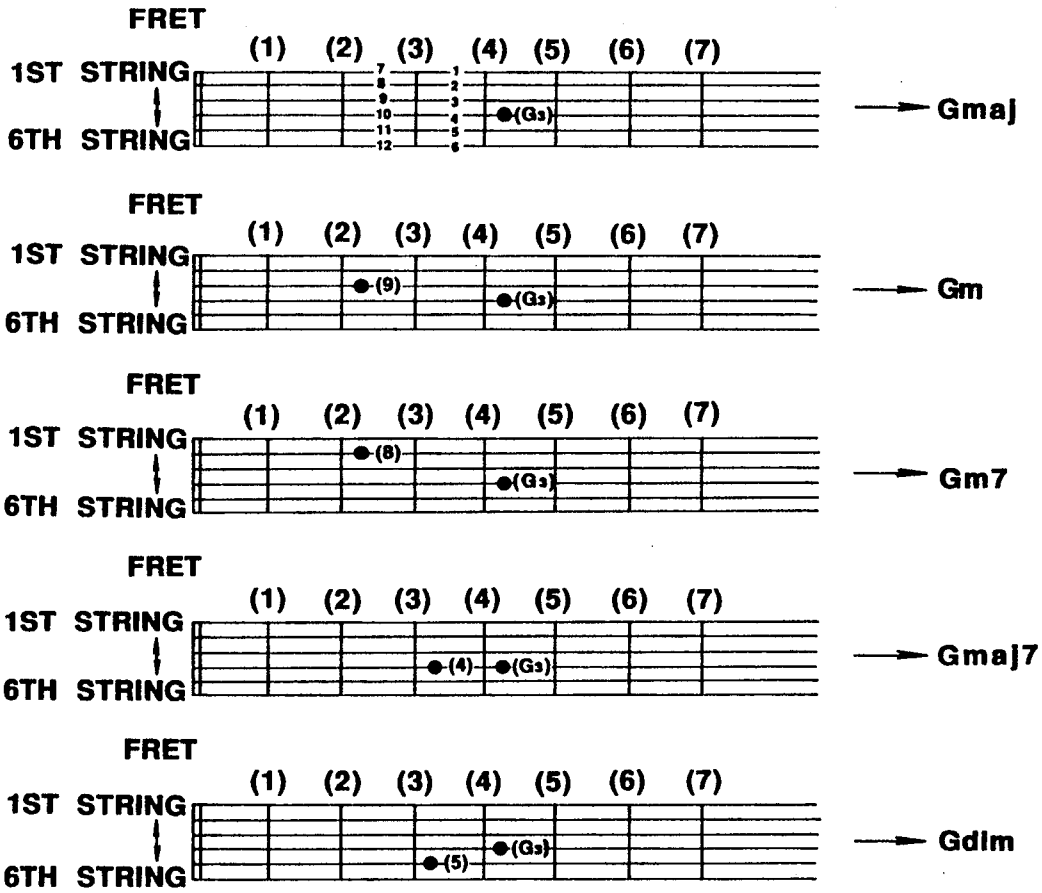
FIGS. 28A to 28E show diagrams illustrating a still further chord designation method.

The sixth example of the chord designation or discrimination should be easily understood from FIGS. 28A to 28E illustrating the fingerboard with operation positions marked by black circles and FIG. 29 illustrating a table of chord types. In this example, the root position is specified by that of operation positions which is at an edge of the fingerboard as viewed from the lengthwise direction thereof (closest to the body in FIGS. 28A to 28E). As compared with the first to fifth examples, the sixth example depends not only the fret numbers (Y components) in the lengthwise direction of the fingerboard but also track numbers or string numbers (X components) across the fingerboard. With the use of the terms "X" or "width" and "Y" or "length," the examples 1 to 5 employ chord type designation/discrimination rules based on the Y or length components, while the example 6 employs rules based on both of X and Y components. The numerals from "1" to "12" in the table shown in FIG. 29 correspond to the numerals affixed to the fingerboard in FIG. 28A. These numerals in FIG. 28A are located within two fret columns next to the root designation position marked by the black circle. The numeral "1" is affixed above the first string within the fret column adjacent to the root fret column, numeral "2" above the second string, and so forth to the numeral "6" affixed above the sixth string. The numeral "7" is affixed above the first string within the next fret column to the previous column, numeral "8" above the second string, and so forth to the numeral "12" affixed above the sixth string. It should be understood from the table shown in FIG. 29 that these numerals and positions are identifiers of chord types. For example, the numeral or position "1" means the seventh chord (7th b9) with a flat ninth, and j=2 means an augmented chord (aug). It should be clear from the table that these 12 positions indicate unique chord types. A set of 12 different chords is considered sufficient for many players to play an accompaniment; all of these 12 positions are located in a region sufficiently close to the root position. In a broader sense, the chord type designation method based on X and Y components can provide a greater number of chords than the method based only on the X components.

Figure 30:
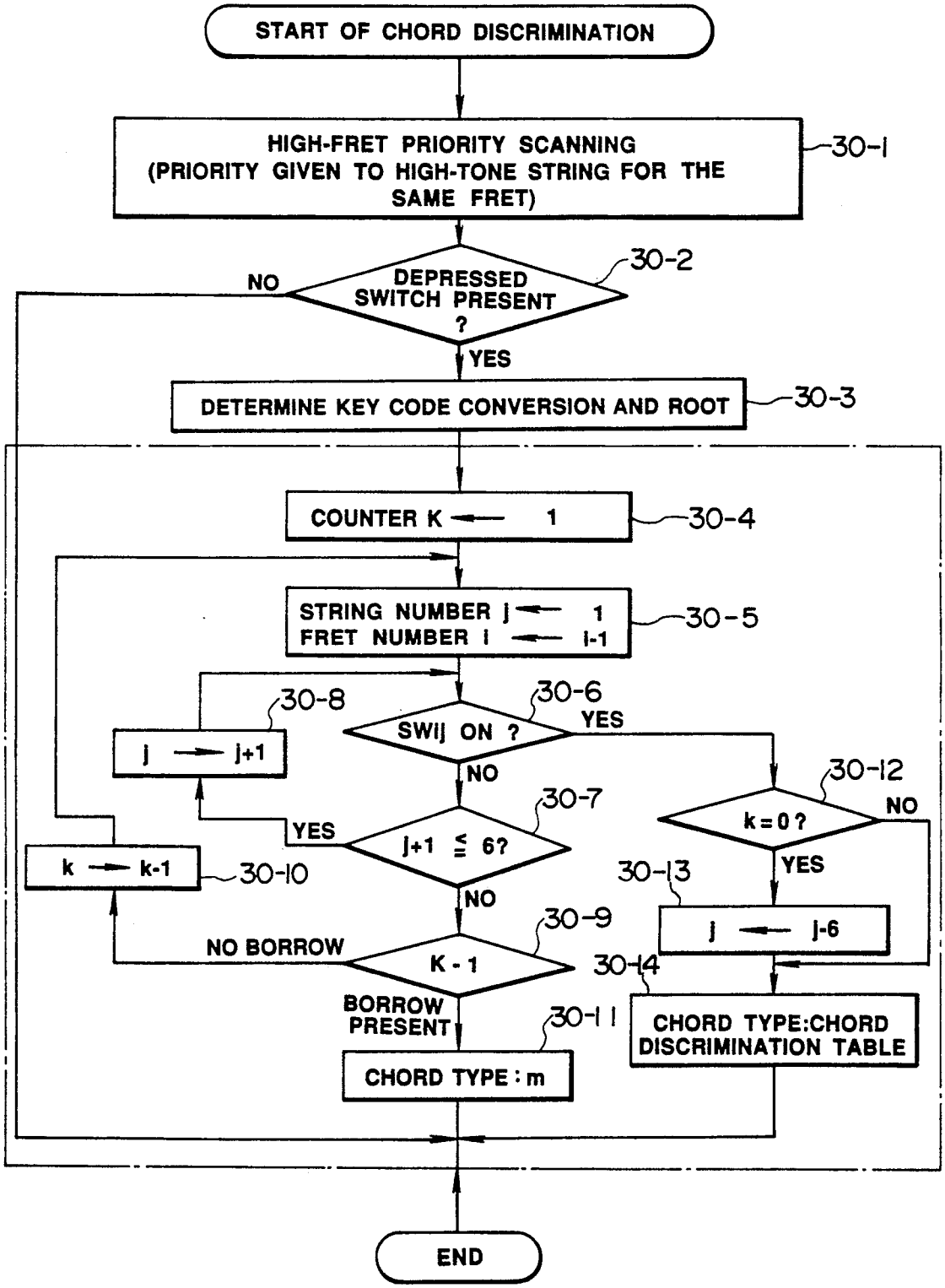
FIG. 30 is a flowchart for chord discrimination according to the chord designation method shown in FIGS. 28A to 28E.
Figures 31A, 31B, 31C, 31D, 31E, 31F:
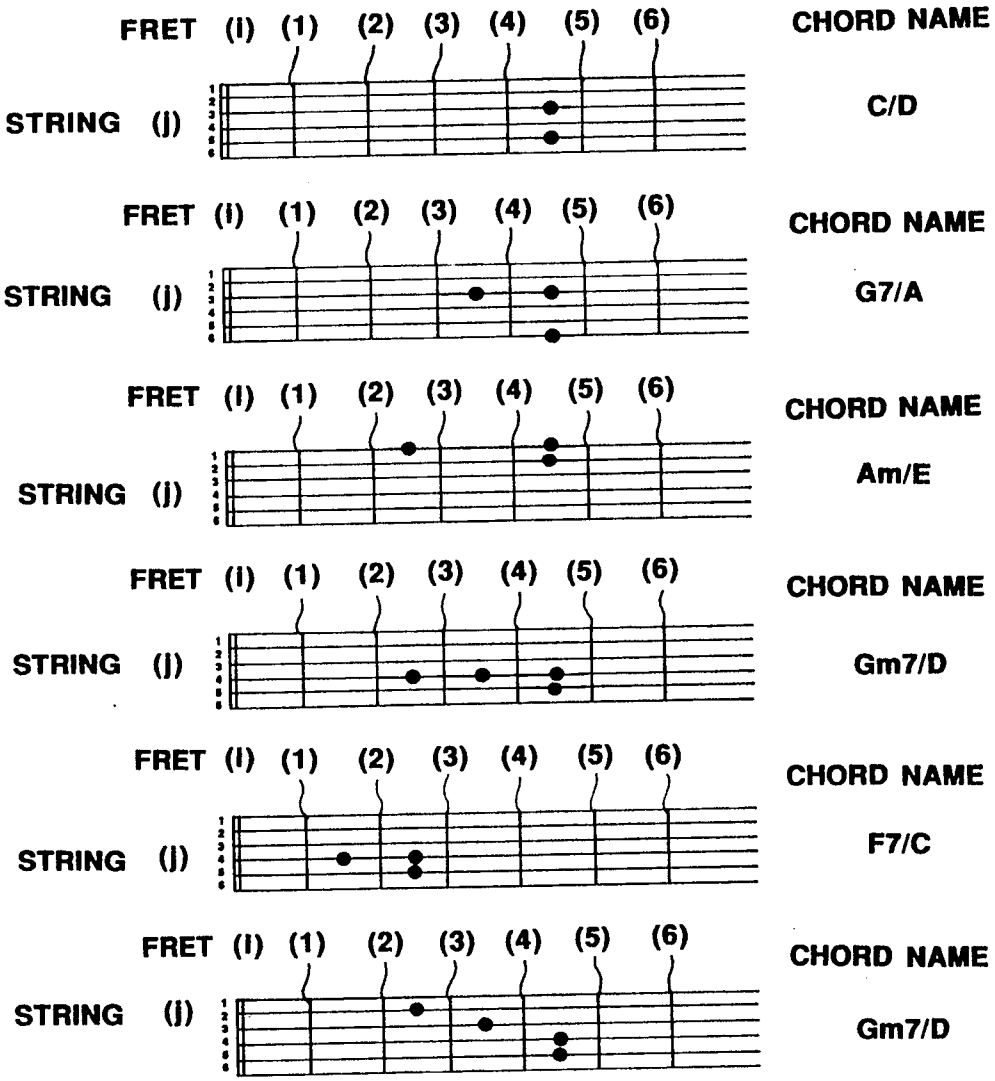
FIGS. 31A to 31F show diagrams illustrating a method of designating a bass-affixed chord or a fraction chord.

The chords designated according to the above chord designation method are discriminated in accordance with the flowchart shown in FIG. 30. Steps 30-1 to 30-3 constitute a process for discriminating the root, and they are the same as steps 24-1 to 24-3 shown in FIG. 24. Upon completion of this process, a type discriminating process, enclosed by the block 30-TYPE and consisting of steps 30-4 to 30-14, is executed. At the entry point of the 30-TYPE, a variable i indicates a fret number of the root designation position. A counter K is set with "1" in the first step 30-4 in the process 30-TYPE. It should be clear from the remaining part of the process 30-TYPE that K=1 means a fret column immediately to the left of the fret column having the root position, and K=0 means the fret column further to the left of the root fret column. In step 30-5, the fret column i to be scanned is moved to the left by one and the first string is selected. In the loop of the subsequent steps 30-6 to 30-8, 6 fret switches present in that fret column are checked one by one. If the fret column contains an activated fret switch, this event is detected in step 30-6. If the fret column contains no activated fret switches, the counter K is discriminated by one (step 30-10) and the flow returns to step 30-5 where the fret column to be scanned is moved further to the left by one, followed by the scanning loop of steps 30-6 to 30-8. If no activated fret switches exist in the two fret columns, a borrow bit is output from the counter K and the decision in borrow-checking step 30-9 is affirmative. This is a case where only one position (to designate the root) is pressed on fingerboard as shown in FIG. 28A. According to the chord symbol at the far right in the FIG. 28A, the chord type is discriminated to be a major (step 30-11). For other cases as exemplified by FIGS. 28B to 28E, an operation position is included with two fret columns next to the root position and the associated fret switches are activated. The activation is detected in step 30-6 and the program advances to step 30-12 where the scanned fret column K is checked. If K=1, a string in the fret column left to the root position is being pressed. The value of the string or track is already held in a register j (fret column scanning steps 30-6 to 30-8). The term "j" is a chord type identifier itself a should be understood from FIG. 28A and the type table of FIG. 29. The value for j is saved in a proper register for storing a discriminated chord type. Although the box 30-14 in FIG. 30 contains a statement of a chord type being determined referring to the chord discrimination table, it is given in this diagram simply for diagrammatic clarification. If K=0 is detected in step 30-12, it means that the string with the number j is pressed at the fret column to the left of the root position by two on the fingerboard. The value of j needs to be converted into the numeral indicated on the fret column to the left, by two, of the black circle (root position) in FIG. 28A so that it represents a chord identifier (step 60-1). Accordingly, j is added with 6 (step 60-1) and the resultant data is stored in a chord type register.

The chord designation by a single operation position as shown in FIG. 28A may be eliminated. In this case, every chord can be designated by two points on the fingerboard.

NUMERATOR CHORD DISCRIMINATION—EXAMPLE 7

In the examples 1 to 6, a chord is assumed to have a single root. It is convenient from a point of discussion to call such a chord a monochord and consider the normalized pitches or vertical array. With the normalized array, a monochord is said to be closed and exist at the root position. At this position, the root forms the lowest chord note or bass and the remaining chord members are positioned above the root at as small pitch intervals as possible. For instance, with a major triad, the remaining chord members are located at the major third position and perfect fifth position from the root. A polychord, which has not yet discussed above, consists of two or more monochords. A polychord having all the monochords positioned close to one another in the vertical direction, for example, a polychord having all the members disposed within one octave, is not generally preferable. With a typical polychord or bichord having two monochords, the second monochord (called an upper structured chord) is formed above the first monochord (called a lower structured chord). Part of the members of a polychord is often dropped in an actual performance. This polychord consisting of monochords can be generally expressed in the form of X/Y (which can be read as "X ON Y"). The denominator Y represents the lower structured chord and the numerator chord X the upper structured chord. When one of the members of the lower structured chord Y is sounded, the polychord is then called "on-bass chord," "bass-affixed chord," "chord on bass" or "fraction chord." A normal monochord is considered as a chord having no numerator chord X or a chord (X/Y) having its numerator chord X replaced by the denominator chord Y. A certain member of a monochord (typically, root) is often used twice in the vertical direction with an interval of an integer multiple of an octave (e.g., C2, E3, G3, and C4 with respect to C major). An instrument, called a bass, is normally used to play the lowest part (called a bass line) of a polyphonic. In the previous case involving C2, E3, G3 and C4, the bass C2 can be played by a bass. In this case, it is said that a "bass-affixed chord" is played. This may be confused with the aforementioned "on-bass chord" so that a chord indicated by X/Y ($X \neq Y$) is called a fraction chord. With such a fraction chord, since one of the members of the denominator chord is selected and played, it is convenient to call the member as the root of the denominator chord, rather than the bass. Using these terms, the chord in the above case is a chord whose denominator chord is the same as the numerator chord, i.e., a monochord, and this chord can be designated (or discriminated) by specifying the root and type of the monochord. A fraction chord can be designated (or discriminated) by specifying the root of the denominator chord and the root and type of the numerator chord. In other words, if a note not included in a monochord is added under the monochord, a fraction chord having the monochord as its numerator chord is formed. If a note included in a monochord (e.g., root) is added under a set of notes of a monochord, the basic characteristic of the chord does not change and the monochord is maintained. It should by now be understood that the aforementioned examples of chord designation can be considered as covering the latter case. Further, the fraction chord can be considered as a monochord being expanded or a monochord plus one note. By slightly modifying the monochord designation/discriminating systems of the above-described examples, therefore, it is possible to provide a chord designation/discrimination system of an electronic string instrument which can designation (or discriminate) a fraction chord as well as a monochord.

FIGS. 31A to 31F illustrate an example of such a system; operation positions are marked on the fingerboard by black circles. In FIGS. 31A to 31F, two roots of the fraction chord are specified by those two of the operation positions marked by the black circles which are closest to the body. Referring to FIG. 15, with regard to pitch assignment within the same fret column, the lowest pitch is assigned to the sixth string, the second lowest pitch to the fifth string, and in this manner, the highest pitch is assigned to the first string (as in the case of an ordinary 6-string guitar). The root of a denominator chord of a fraction chord is lower than other chord tones and is therefore normally played as a bass. (It should be noted that the denominator chord is called a lower structured chord.) In this respect, it is Convenient that, of the two root operation positions shown in FIGS. 31A to 31F, the one with a black mark on the string with a larger numeral specifies the root of the denominator chord and the other with a black mark on the string with a smaller numeral specifies the root of the numerator chord. It should also be noted that the operation positions for specifying the fraction chord in FIGS. 31A to 31F are similar to those in FIGS. 23A to 23E for specifying a monochord. Specifically, removing the operation position (black circle) indicating the root of the denominator chord from the operation positions in FIGS. 31A to 31F, the result would be the same as the operation positions shown in FIGS. 23A to 23E. Therefore, the monochord designation method described with reference to FIGS. 23A to 23E can be combined with the denominator chord designation method explained here with reference to FIGS. 31A to 31F.

Figure 3A:
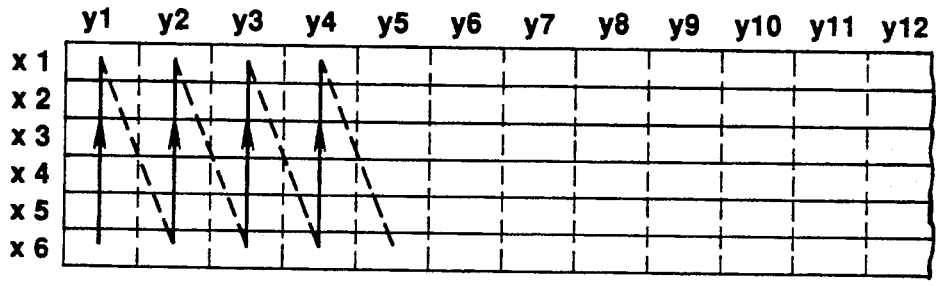
FIGS. 3A to 3D show diagrams exemplifying the sorting order employed in a sorter shown in FIG. 2.
Figure 3B:
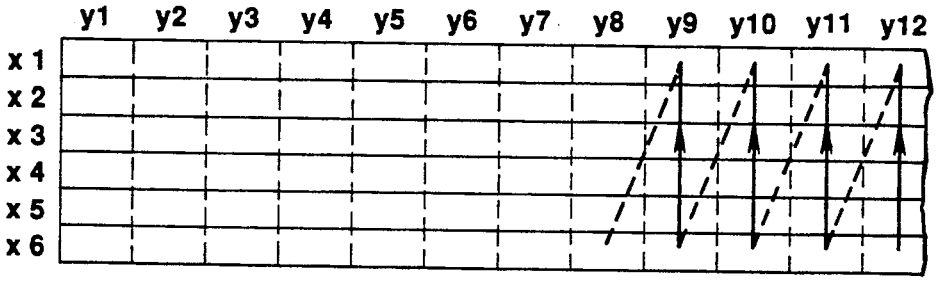
Figure 3C:
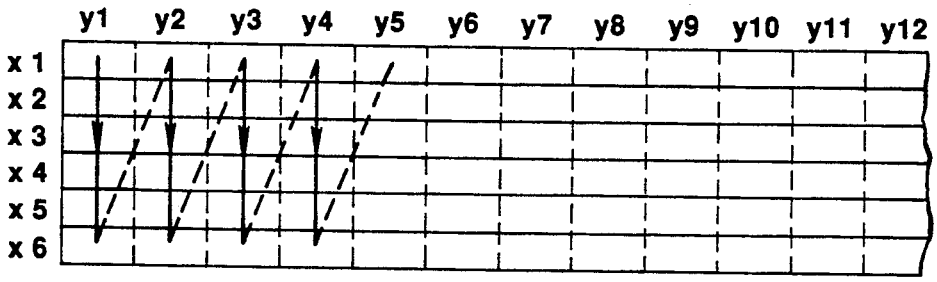
Figure 3D:
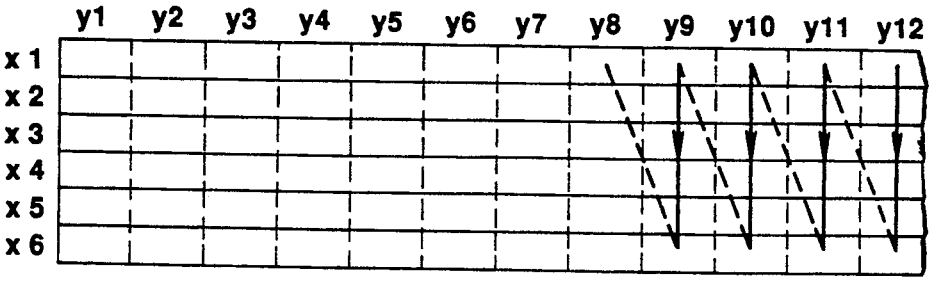
Figure 32:
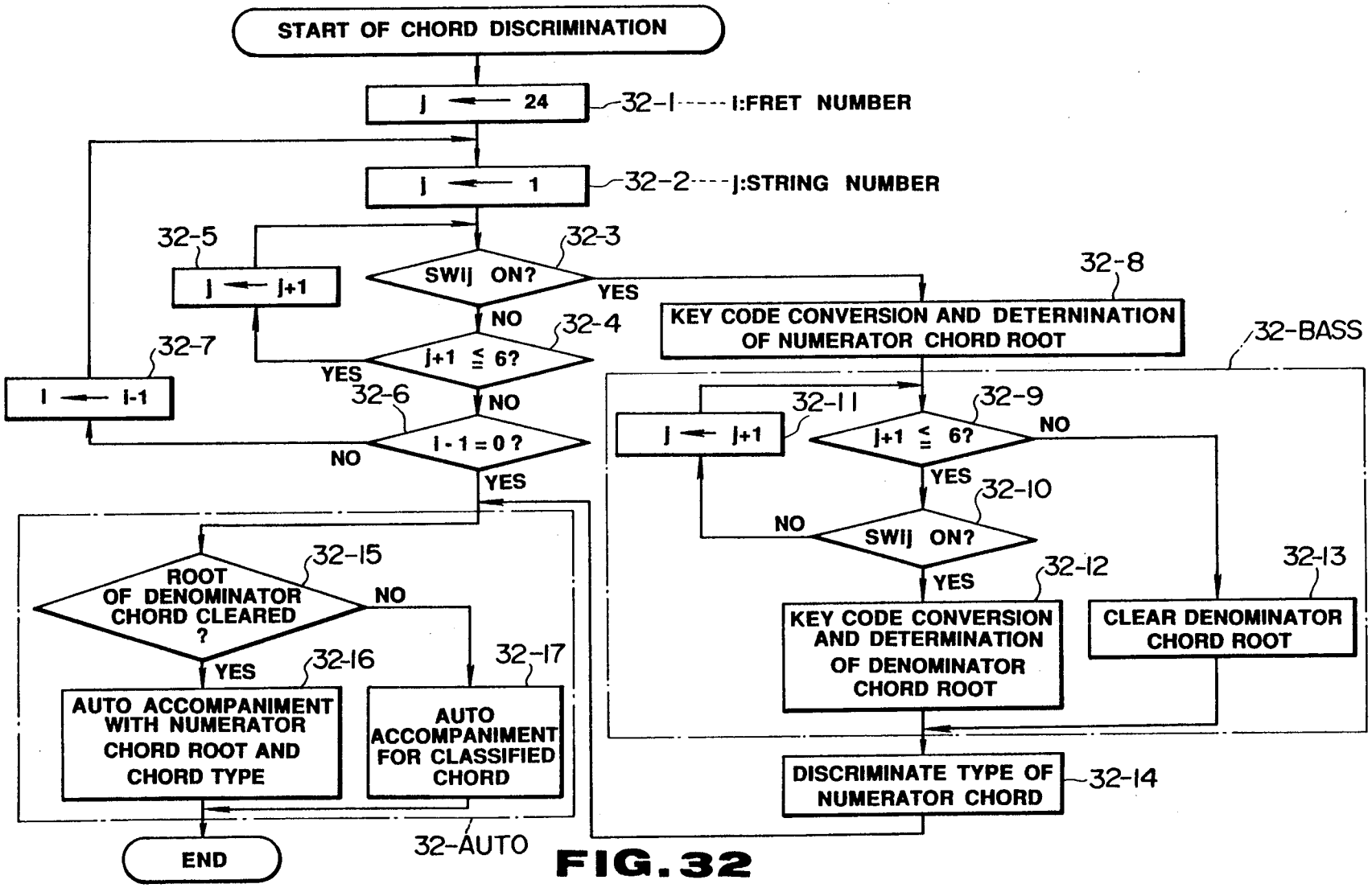
FIG. 32 is a flowchart for chord discrimination according to the chord designation method shown in FIGS. 31A to 31F.
Figures 33A, 33B, 33C, 33D, 33E:
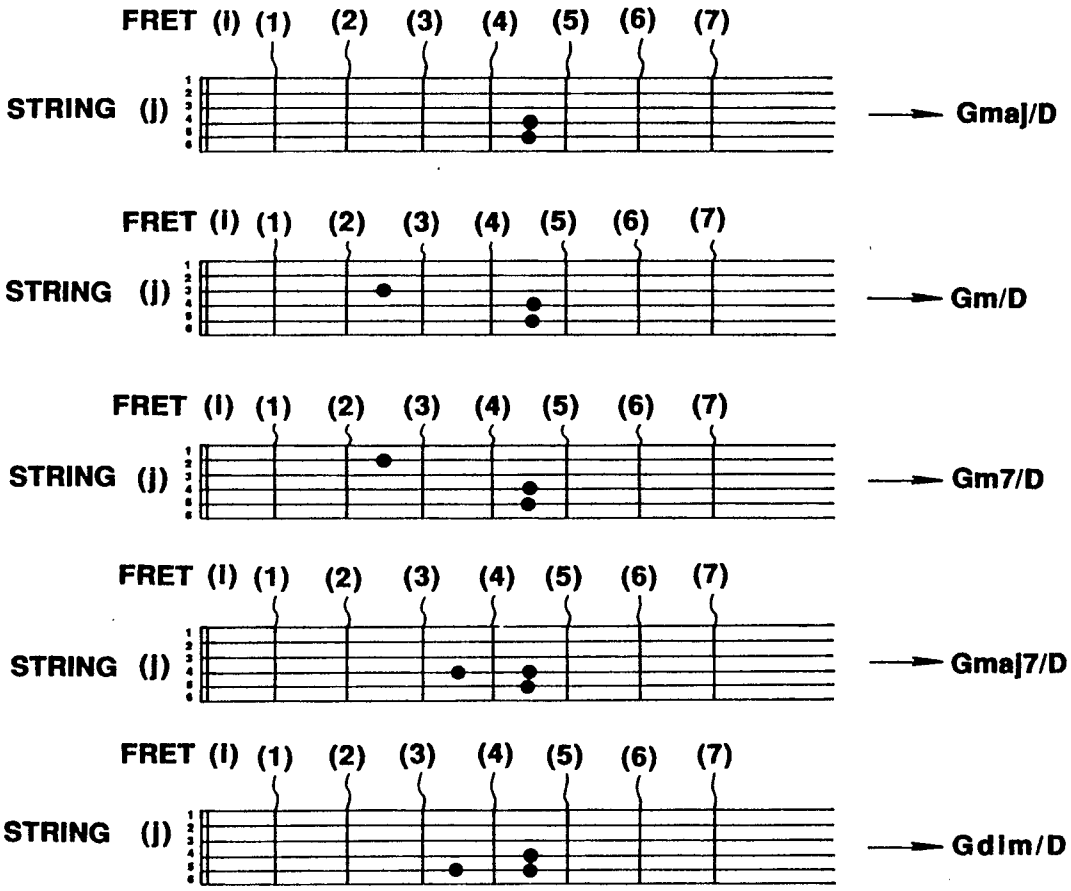
FIGS. 33A to 33E show diagrams illustrating another method of designating a bass-affixed chord or a fraction chord.
Figures 34A, 34B, 34C, 34D:
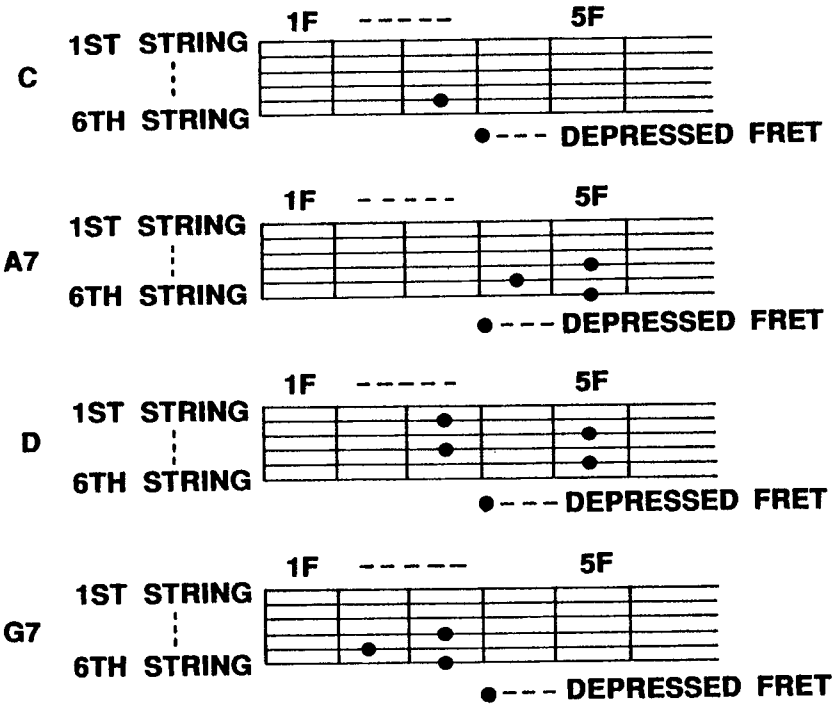
FIGS. 34A to 34D show diagrams illustrating a still further chord designation method.

FIG. 32 illustrates a flowchart of a chord discrimination program for discriminating a monochord or a fraction chord which is designated by such a monochord designation method or fraction chord designation method. The chord designation program is indicated by steps 32-1 to 32-14 which, excluding the block 32-BASS, is constituted by the monochord designation program shown in FIG. 24. Steps 32-1 to 32-7 in FIG. 32 describe in detail the width-first scanning of the type as shown in FIG. 3D, and they are indicated simply by boxes 24-1 and 24-2 in FIG. 24. Step 32-8 describes that the pitch of the root of a monochord or numerator chord) is prepared from the scanning result. Step 32-14 describes discrimination of the type of a monochord (or numerator chord) and this discrimination is realized by the process illustrated in the block 24-TYPE if the chord designation methods shown in FIGS. 23A to 23E and FIGS. 31A to 31F are used.

The process 32-BASS is located between the process for discriminating the root of a monochord or numerator chord, described in steps 32-1 to 32-8, and the process for discriminating the type of a monochord or numerator chord, described in step 32-14. This process 32-BASS discriminates whether a designated chord is a monochord or a fraction chord, and finds the root of a denominator chord if the discriminated chord is a fraction chord. This will be discussed in detail below. Prior to execution of the routine 32-BASS, a combination of the fret number i and string number j represents the root position of a monochord or the root position of a numerator chord in the case a fraction chord is involved. As should be understood from FIGS. 23A to 23E and FIGS. 31A to 31F, if the designated chord is a fraction chord, an operation position should be located below the fret column i; if not, it means that a monochord has been designated. The process for checking the remaining fret switches in this fret column is executed by the column scanning loop constituted by steps 32-9 to 32-11. If an activated switch is detected during the scanning, the position of that switch is where the root of the denominator chord should be designated. This operation position is therefore converted into pitch data (key chord) in accordance with pitch assignment, and the pitch data is saved into a proper register for storing a denominator root (step 32-12). When the fret column scanning is completed without detecting any activated switch, the discriminated chord is a monochord so that the content of the denominator root register is cleared (step 32-13). Instead of clearing the register's content, the root data of the monochord acquired in step 32-8 may be set in the register.

The discriminated chord can be used for automatic accompaniment, which is schematically described in the block 32-AUTO in FIG. 32. According to the block 32-AUTO, it is checked whether the chord discriminated in step 32-15 is a monochord or a fraction chord and an automatic accompaniment is performed according to the checking result (steps 32-16 and 32-17). This is illustrated for ease of understanding the general operation of the system. Actually, the content of a register for storing pitch data of a bass note for producing a bass line is read out and a bass note having the stored pitch is produced at the generation timing indicated by an automatic bass pattern, thereby automatically forming a bass line; the aforementioned denominator root register may serve as this register. Accordingly, while a fraction chord is designated, a bass note corresponding to the root of the discriminated denominator chord is sounded in accordance with the rhythm of the bass pattern, and while a monochord is designated, a bass note corresponding to a member (e.g., root) of the monochord is timely sounded.

FIGS. 33A to 33E illustrate a fraction chord designation method which is an expanded version of the monochord designation method, shown in FIGS. 28A to 28E, for designating the type of a chord which depends on both of the X component (length component of the fingerboard) and Y component (string number). In this example, the position on the fingerboard to designate the root of a denominator chord is also prepared below the fret column which contains the position for designating the root of a numerator chord (see two black circles vertically disposed in FIGS. 33A to 33E.

Discrimination of a chord designated by the chord designation methods shown in FIGS. 28A to 28E and FIGS. 33A to 33E can be realized in accordance with the flowchart of FIG. 32 which uses the type discrimination module 30-TYPE shown in FIG. 30 for the chord type discrimination routine 32-14.

CHORD DISCRIMINATION—EXAMPLE 8

FIGS. 34A to 34D illustrate the eighth chord designation/discrimination method. In this example, the type of a chord is specified by the number of operation positions (marked by the black circles in FIGS. 34A to 34D) on the fingerboard. In the diagram, one operation position specifies a major, two operation positions (not shown) specify a minor, three operation positions specify a 7th, and four operation positions specify a m7th. The root of a chord is specified by the lowest one of the pitches assigned to these operation positions in accordance with the pitch assignment map (see FIG. 15).

Figure 35:
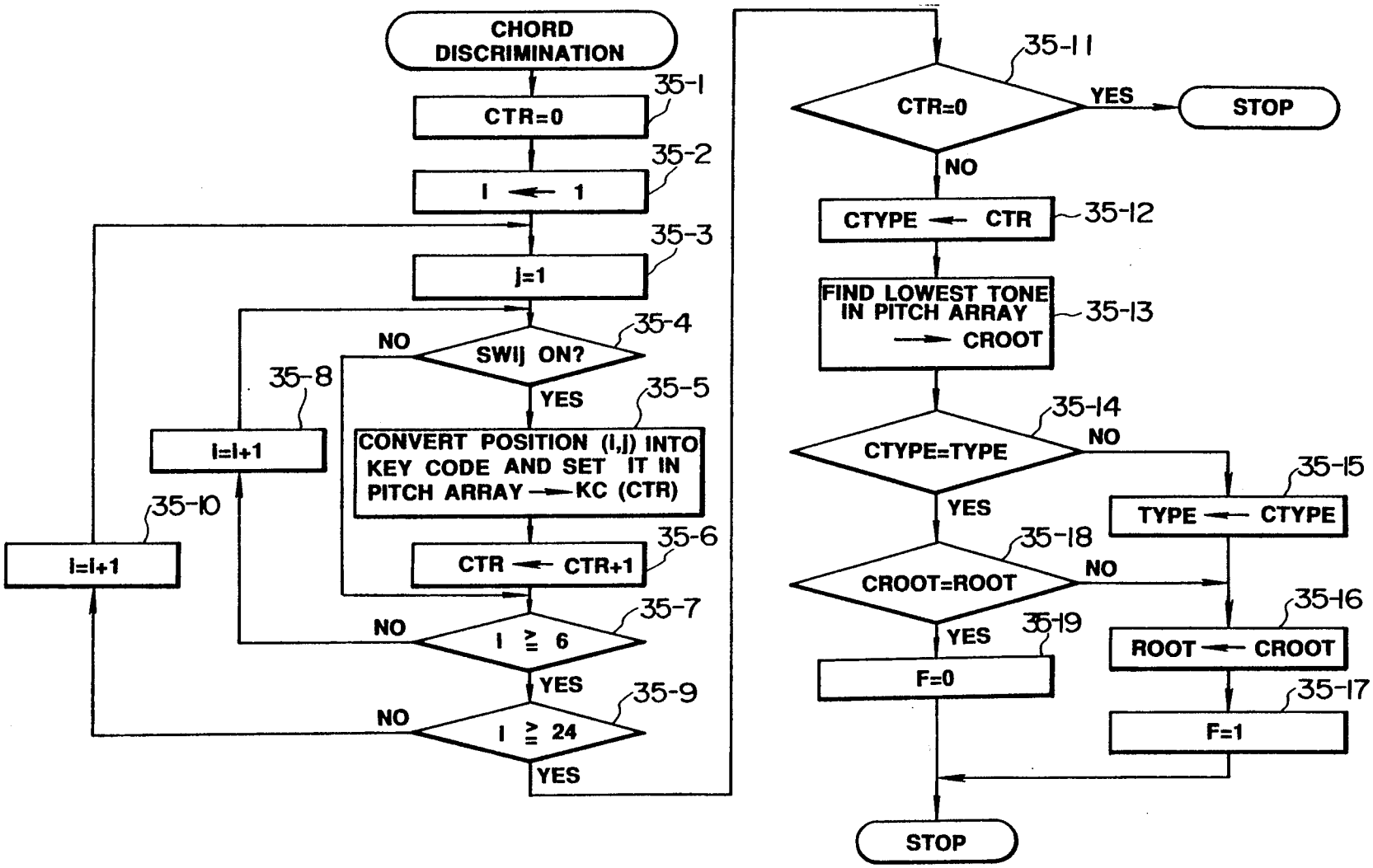
FIG. 35 is a flowchart for chord discrimination according to th chord designation method shown in FIGS. 34A to 34D.

FIG. 35 illustrates a process for discriminating a chord from operation positions on the fingerboard in accordance with this chord designation method. Referring to FIG. 35, CTR is a counter for counting operation positions on the fingerboard. This counter CTR is initialized in step 35-1. In the subsequent steps 35-2 to 35-10, the fingerboard is scanned in accordance with the width-first scanning of the type shown in FIG. 3A. Every time an operation position is detected during the scanning, it is converted into a pitch (key chord) before being set in a pitch array (step 35-5), and the content of the counter CTR is incremented (step 35-6). Upon completion of scanning the fingerboard, the content of the counter CTR is checked (step 35-11). If the count is not zero, the value is set in a present type register CTYPE, and the lowest pitch is selected from the pitch array KC ( ) and is set in a current root register CROOT (steps 35-12 and 35-13). In the subsequent steps 35-14 to 35-18, the current type is compared with the previous type or the effective type "TYPE" and the current root is compared with the previous root or the effective "ROOT." If no coincidence occurs, the effective type and the effective root are replaced respectively with the current type and the current root, and a flag F is set. If the current chord is the same as the previous one, the flag F is reset. The flag F may be referred to in a process which uses discriminated chords.

The scanning of the fingerboard may be executed in accordance with the pitch priorities conforming to the pitch assignment map instead of the aforementioned width-first priorities. The results of such pitch-ordered scanning are stored in the pitch array KC ( ). After the scanning is completed, the first element in the pitch array KC ( ) (in the case where the scanning has started with the position of the lowest note on the fingerboard in accordance with the pitch assignment map) or the last element in the pitch array (in the case where the scanning has started with the position of the highest note) specifies the pitch of the root. A pitch counter (on software) is prepared so that it can operate in synchronism with the pitch-priority scanning. If an activated switch is found during scanning, the count of the pitch counter is hopped in a pitch stack or the pitch array KC ( ).

Utilization of Discriminated Chords

The present electronic string instrument 10 is designed so as to utilize chords, discriminated in the above-described manner, for an accompaniment according to the operation mode of the instrument 10.

Figure 36:
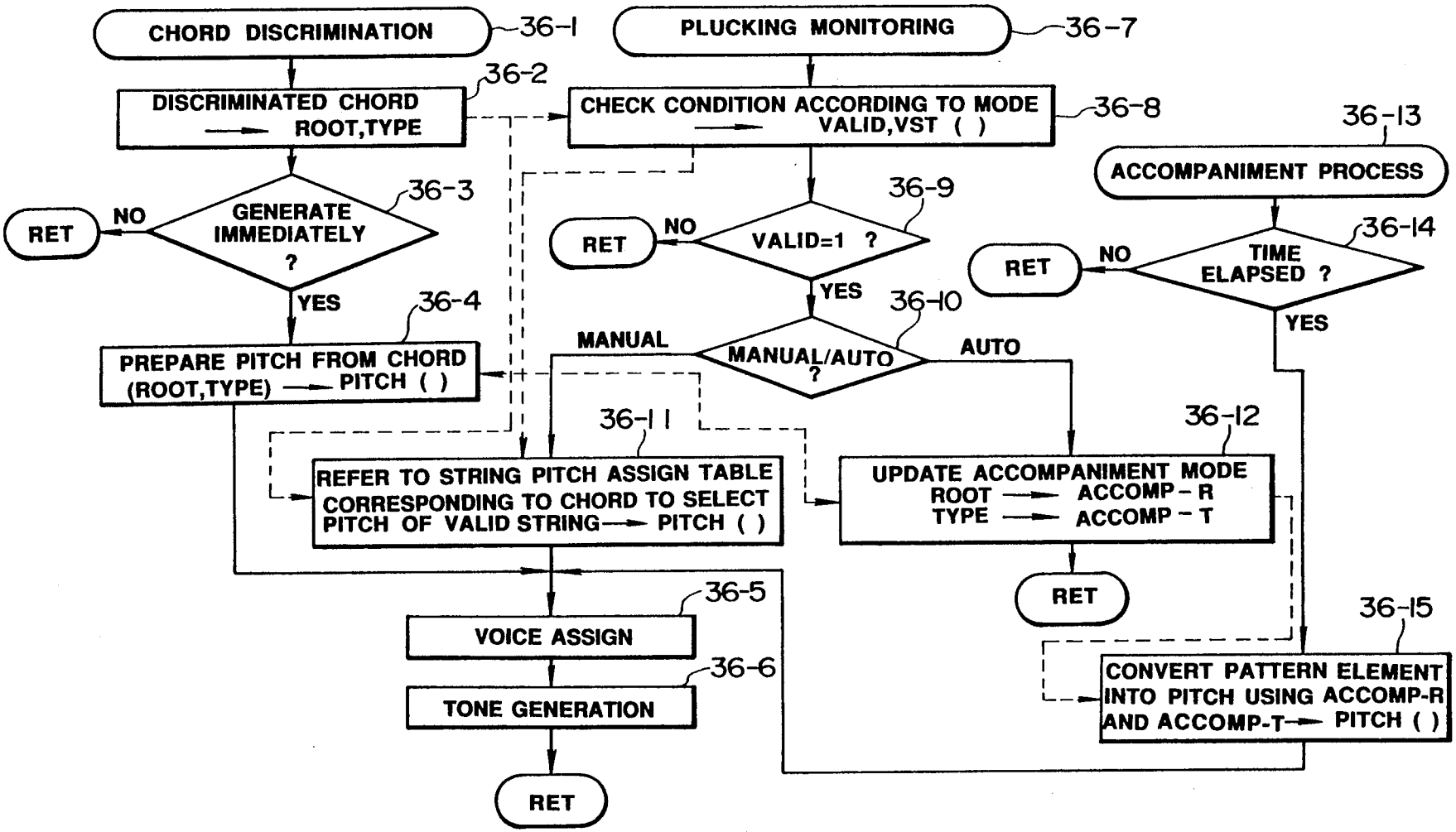
FIG. 36 is a flowchart for using discriminated chords.

FIG. 36 illustrates a simplified flowchart for using chords. A chord discrimination process 36-1 executes the chord discriminations as described in the examples 1 through 8. The results are saved in the registers ROOT and TYPE (step 36-2). The chord specific data ROOT and TYPE are referred to in the process in FIG. 36 which is indicated by the arrow of the broken line. In one operation mode, it is demanded to immediately sound a musical tone having the pitch of a new chord in response to the discrimination of the new chord. In this mode, the mode checking step 36-3 is satisfied, and the pitch of a chord member is produced from the discriminated ROOT and TYPE and is stored in the array PITCH ( ). The presence of pitch data in the array PITCH ( ) means note ON requests by the number of the pitch data. Therefore, a voice assignment is executed for these notes (step 36-5), and tone generation commands including the individual pitch data of the pitch array are sent to the individual voice channels of a polyphonic sound source, thus generating musical tones having the associated reference frequencies through these voice channels of the sound source (step 36-6). In the meantime, the statuses of the individual strings of the string instrument are monitored in a string monitoring process 36-7. When a string is plucked, for instance, the string vibrates, and the vibration is detected, followed by generation of data TRIG (ST) (indicating the start of the vibration of the string specified by ST) in the process 36-7. The flow then advances to a process 36-8. In one operation mode, the process 36-8 sets a valid flag VALID even if any of a plurality of strings (six strings in this example) is plucked. In another operation mode, in response to the same string conditions, the process 36-8 stores, in an array VST ( ), an effective string number determined by the chord (ROOT, TYPE); these two parameters have acquired in the chord discrimination process 36-1 and 36-2. In a further operation mode which is effective for those players well experienced in string instruments, the process 36-8 sets the flag VALID only when a plurality of effective strings determined by the chord (ROOT, TYPE) are substantially simultaneously plucked. In any one of the modes, the process 36-8 resets the flag VALID to a value of "INVALID" unless the desired trigger conditions are not satisfied. The flag VALID is then checked in the next step 36-9. If the flag VALID is set, it is then checked in step 36-10 whether the operation mode is a manual mode in which the rhythm of an accompaniment is controlled by string plucking or it is an auto mode in which the accompaniment's rhythm is controlled by an accompaniment pattern. If the present mode is the manual mode, a process 36-11 is executed. In the process 36-11, the string/pitch assignment table specified by the chord (ROOT, TYPE) is referred to and pitch data for the effective strings indicated by the array VST ( ) is selected. The pitch data is then stored in the array PITCH ( ), and is then referred to in the sound source controlling process 36-5 and 36-6, thus causing the sound source to generate musical tones having these pitches. If it is discriminated in step 36-10 that the string mode is the manual mode, the content of the register ROOT is copied in an accompaniment root register ACCOMP-R and the content of the register TYPE is copied in an accompaniment type register ACCOMP-T (step 36-12). In this manner, an accompaniment chord for an automatic accompaniment is updated in response to a string trigger event which satisfies conditions determined in advance according to the operation mode. In an accompaniment process 36-13 to 36-15, an accompaniment pattern is read out from a memory in a usual manner, and timing data included in the pattern and representing the rhythm of the accompaniment is checked. When the time comes to generate a musical tone, one or more pieces of pitch attribute data associated with that time are decoded based on the accompaniment chord (ACCOMP-R and ACCOMP-T) updated in the process 36-12, and the decoded data is converted into pitch data and stored in the array PITCH ( ). Consequently, the processes 36-5 and 36-6 are executed and the sound source is so controlled as to generate one or more musical tones having the pitches specified by the data in the array PITCH ( ).

The above completes the description of the preferred embodiments of this invention. Needless to say, this invention may be modified in various manners within the scope and spirit of the invention. It would be easy for those skilled in the art to make such modifications.

For instance, a plurality of different modes of an electronic string instrument may be assigned to a plurality of different areas on the fingerboard so that fingering with respect to each area would cause the string instrument to produce an intrinsic response associated with the mode assigned to that area. For example, an ordinary mode in which a melody or the like is played is assigned to the right half of the fingerboard (e.g., the 13th fret to 24th fret), and a chord mode which ensures chord designation by simplified fingering is assigned to the left half of the fingerboard (e.g., the 1st fret to 12th fret). Assume now that a player executes the positioning of proper strings at proper positions with respect to the left half of the fingerboard. Then, the electronic string instrument discriminates a chord intended by the fingering in accordance with the selective chord mode assigned to the left hand of the fingerboard. Assuming that the player now plucks strings with his right hand, then, the electronic string instrument generates and sounds musical tones in accordance with the assigned chord mode and the discriminated chord, for example. In this manner, the player plays an accompaniment through the fingering with respect to the left half of the fingerboard (in synchronism with the timing of the string plucking in this case). Suppose that the player now desires to play solo. Then, the player plucks proper strings at a proper timing while executing fingering with respect to the right half of the fingerboard. Since the normal operation mode is assigned to the right half of the fingerboard, upon each plucking of a string, the electronic string instrument produces a musical tone having the pitch associated with the position of that string on the fingerboard. The area on the fingerboard to which the chord mode is assigned may be set smaller, or it may be assigned, if desired, to that part of the fingerboard which is closer to the body of the string instrument.

What is claimed is:

1. A chord output apparatus for outputting a chord corresponding to fingering on a fingerboard, comprising:

operation position detecting means for detecting two-dimensional operation positions on the fingerboard corresponding to the fingering;

memory means for storing the two-dimensional relative positions between one of the two-dimensional operation positions on the fingerboard as a reference position and relative two-dimensional positions of another fingering position with respect to the reference position and an associated chord type;

root determining means for determining a root of a chord to be outputted based on a root position determined according to one of the two-dimensional operation positions detected by said operated position detecting means; and chord type determining means for determining a type of a chord to be outputted based on a two-dimensional relative positional relationship between the root position and the detected two-dimensional operation positions other than the root position and a memory content of said memory means.

2. A chord output apparatus for analyzing fingering on a fingerboard to output a chord corresponding to the fingering comprising:

operation position detecting means for detecting two-dimensional positions of operations done by fingering on a fingerboard;

root determining means for determining a root of a chord to be output based on one of the operation positions detected by said operation position detecting means;

defining means for defining fixed relationships between numbers of operation positions detected by said operation portion detecting means and a type of a chord; and chord type determining means for determining a type of a chord to be output based on the number of the operation positions detected by said operation position detecting means and a corresponding fixed relationship defined by said defining means.

3. An automatic accompaniment apparatus for performing an automatic accompaniment corresponding to a chord designated by fingering on a fingerboard, comprising:

operation position detecting means for detecting two-dimensional operation positions on the fingerboard corresponding to the fingering;

memory means for storing the two-dimensional relative positions between one of the two-dimensional positions on the fingerboard as a reference position and relative two-dimensional positions of another fingering position with respect to the reference position and an associated chord type;

root determining means for determining a root of a chord to be outputted based on a root position determined according to one of the two-dimensional operation positions detected by said operation position detecting means;

chord type determining means for determining a type of a chord to be outputted based on two-dimensional relative positional relationship between the root position and the detected two-dimensional operation positions other than the root position and a memory content of said memory means;

automatic accompaniment pattern outputting means for outputting an automatic accompaniment pattern; and automatic accompanying means for performing an automatic accompaniment based on (i) the automatic accompaniment pattern outputted from said automatic accompaniment pattern outputting means, (ii) the root determined by said root determining means, and (iii) the chord type determined by said chord type determining means.

4. An automatic accompaniment apparatus having a fingerboard, comprising:

operation position detecting means for detecting two-dimensional positions of operations done by fingering on a fingerboard;

root determining means for determining a root of a chord to be output based on one of the operation positions detected by said operation position detecting means;

chord type determining means for determining a type of a chord to be output based on the number of the operation positions detected by said operation position detecting means;

automatic accompaniment pattern outputting means for outputting an automatic accompaniment pattern; and automatic accompanying means for performing an automatic accompaniment based on (i) the automatic accompaniment pattern outputted from said automatic by said root determining means, and (iii) the chord type determined by said chord type determining means.

5. An automatic accompaniment apparatus having a fingerboard, comprising:

operation position detecting means for detecting two-dimensional positions of operations done by fingering on a fingerboard;

root determining means for determining a root of a chord to be output based on one of the operation positions detected by said operation position detecting means;

chord type determining means for determining a type of a chord to be output based on the number of the operation positions detected by said operation position detecting means and a relationship between the operation positions;

automatic accompaniment pattern outputting means for outputting an automatic accompaniment pattern; and automatic accompanying means for performing an automatic accompaniment based on (i) the automatic accompaniment pattern outputted from said automatic accompaniment pattern outputting means, (ii) the root determined by said root determining means, and (iii) the chord type determined by said chord type determining means.

6. An electronic stringed instrument having strings and a fingerboard for generating a musical tone corresponding to a chord determined by fingering on the fingerboard, comprising:

operation position detecting means for detecting two-dimensional operation positions on the fingerboard corresponding to the fingering;

memory means for storing the two-dimensional relative positions between one of the two-dimensional operation positions on the fingerboard as a reference position and relative two-dimensional positions of another fingering position with respect to the reference position and an associated chord type;

root determining means for determining a root of a chord to be outputted based on a root position determined according to one of the two-dimensional operation positions detected by said operation position detecting means;

chord type determining means for determining a type of a chord to be outputted based on two-dimensional relative positional relationship between the root position and the detected two-dimensional operation positions other than the root position and a memory content of said memory means;

plucking detecting means detecting plucking of the strings; and tone generating means for generating a musical tone corresponding to a chord specified by the root determined by said root determining means and the chord type determined by said chord type determining means at a timing at which the plucking is detecting by said plucking detecting means.

7. An electronic stringed instrument having strings and a fingerboard for generating a musical tone corresponding to a chord designated by fingering on the fingerboard, comprising:

operation position detecting means for detecting two-dimensional positions of operations done by fingering on said fingerboard;

root determining means for determining a root of a chord to be output based on one of the operation positions detected by said operation position detecting means;

chord type determining means for determining a type of a chord to be output based on the number of operation positions detected by said operation position detecting means;

plucking detecting means for detecting plucking of the strings; and tone generating means for generating a musical tone corresponding to a chord specified by the root determined by said root determining means and the chord type determined by said chord type determining means at a timing at which the plucking is detected by said plucking detecting means.

8. An electronic stringed instrument having strings and a fingerboard for generating a musical tone corresponding to a chord designated by fingering on the fingerboard, comprising:

operation position detecting means for detecting two-dimensional positions of operations done by fingering on said fingerboard;

root determining means for determining a root of a chord to be output based one of the operation positions detected by said operation position detecting means;

chord type determining means for determining a type of chord to be output based on the number of the operation positions detected by said operation position detecting means and a relationship between the operation positions;

plucking detecting means for detecting plucking of the strings; and tone generating means for generating a musical tone corresponding to a chord specified by the root determined by said root determining means and the chord type determined by said chord type determining means at a timing at which the plucking is detected by said plucking detecting means.

9. A chord output apparatus for outputting a chord corresponding to fingering on a fingerboard, comprising:

operation position detecting means for detecting two-dimensional operation positions on the fingerboard corresponding to the fingering;

defining means for defining fixed relationships between a type of a chord and two-dimensional relative positions of other operation positions with respect to a reference position which is one of the two-dimensional operation positions on the fingerboard;

root determining means for determining a root of a chord to be outputted based on a root position determined according to one of the two-dimensional operation positions detected by said operation position detecting means; and chord type determining means for determining a type of a chord to be outputted based on two-dimensional relative positions between the root position and the detected two-dimensional operation positions other than the root position and a corresponding fixed relationship defined by said defining means.

10. An automatic accompaniment apparatus for performing an automatic accompaniment corresponding to a chord designated by fingering on a fingerboard, comprising:

operation position detecting means for detecting two-dimensional operation positions on the fingerboard corresponding to the fingering;

defining means for defining fixed relationships between a type of a chord and two-dimensional relative positions of other operation positions with respect to a reference position which is one of the two-dimensional operation positions on the fingerboard;

root determining means for determining a root of a chord to be outputted based on a root position determined according to one of the two-dimensional operation positions detected by said operation position detecting means;

chord type determining means for determining at type of a chord to be outputted based on two-dimensional relative positions between the root position and the detected two-dimensional operation positions other than the root position and a corresponding fixed relationship defined by said defining means;

automatic accompaniment pattern outputting means for outputting an automatic accompaniment pattern; and automatic accompanying means for performing an automatic accompaniment based on (i) the automatic accompaniment pattern outputted from said automatic accompaniment pattern outputting means, (ii) the root determined by said root determining means, and (iii) the chord type determined by said chord type determining means.

11. An electronic stringed instrument having strings and a fingerboard for generating a musical tone corresponding to a chord designated by fingering on the fingerboard, comprising:

operation position detecting means for detecting two-dimensional operation positions on the fingerboard corresponding to the fingering;

defining means for defining fixed relationships between a type of a chord and two-dimensional relative positions of other operation positions with respect to a reference position which is one of the two-dimensional operation positions on the fingerboard;

root determining means for determining a root of a chord to be outputted based on a root position determined according to one of the two-dimensional operation positions detected by said operation position detecting means;

chord type determining means for determining a type of a chord to be outputted based on two-dimensional relative positions between the root position and the detected two-dimensional operation positions other than the root position and a corresponding fixed relationship defined by said defining means;

plucking detecting means for detecting plucking of the strings; and tone generating means for generating a musical tone corresponding to a chord specified by the root determined by said root determining means and the chord type determined by said chord type determining means at a timing at which the plucking is detected by said plucking means.

12. An automatic accompaniment apparatus having a fingerboard, comprising:

operation position detecting means for detecting two-dimensional positions of operations done by fingering on a fingerboard;

root determining means for determining a root of a chord to be output based on one of the operation positions detected by said operation position detecting means;

defining means for defining fixed relationships between the number of operation positions and a type of a chord;

chord type determining means for determining a type of a chord to be outputted based on the number of the operation positions detected by said operation position detecting means and a corresponding fixed relationship defined by said defining means;

automatic accompaniment pattern outputting means for outputting an automatic accompaniment pattern; and automatic accompanying means for performing an automatic accompaniment based on (i) the automatic accompaniment pattern outputted from said automatic accompaniment pattern outputting means, (ii) the root determined by said root determining means, and (iii) the chord type determined by said chord type determining means.

13. An electronic stringed instrument having strings and a fingerboard for generating a musical tone corresponding to a chord designated by fingering on the fingerboard, comprising:

operation position detecting means for detecting two-dimensional positions of operations done by fingering on said fingerboard;

root determining means for determining a root of a chord to be outputted based on one of the operation positions detected by said operation position detecting means;

defining means for defining fixed relationships between the number of operation positions and a type of a chord;

chord type determining means for determining a type of a chord to be output based on the number of the operation positions detected by said operation position detecting means and a corresponding fixed relationship defined by said defining means;

plucking detecting means for detecting plucking of the strings; and tone generating means for generating a musical tone corresponding to a chord specified by the root determined by said root determining means and the chord type determined by said chord type determined means at the timing at which the plucking is detected by said plucking detecting means.

* * * * *